US010040292B2

(12) United States Patent
Okushima et al.

(10) Patent No.: US 10,040,292 B2
(45) Date of Patent: Aug. 7, 2018

(54) LIQUID EJECTION SUBSTRATE, LIQUID EJECTION HEAD, AND LIQUID EJECTION APPARATUS

(71) Applicant: CANON KABUSHIKI KAISHA, Tokyo (JP)

(72) Inventors: Shingo Okushima, Kawasaki (JP); Seiichiro Karita, Saitama (JP); Takatsuna Aoki, Yokohama (JP); Noriyasu Nagai, Tokyo (JP); Yumi Komamiya, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/863,322

(22) Filed: Jan. 5, 2018

(65) Prior Publication Data

US 2018/0126740 A1 May 10, 2018

Related U.S. Application Data

(63) Continuation of application No. 15/389,083, filed on Dec. 22, 2016, now Pat. No. 9,902,157.

(30) Foreign Application Priority Data

Jan. 8, 2016 (JP) ..... 2016-002704
Dec. 9, 2016 (JP) ..... 2016-239794

(51) Int. Cl.
*B41J 2/175* (2006.01)
*B41J 2/14* (2006.01)

(52) U.S. Cl.
CPC ..... *B41J 2/175* (2013.01); *B41J 2/1404* (2013.01); *B41J 2/14145* (2013.01); *B41J 2002/14467* (2013.01); *B41J 2202/12* (2013.01)

(58) Field of Classification Search
CPC ..... B41J 2/17596; B41J 2/18; B41J 2/17503; B41J 2/1404; B41J 2/1433; B41J 2/145; B41J 2202/12
See application file for complete search history.

(56) References Cited

U.S. PATENT DOCUMENTS 6,554,404 B2 4/2003 Giere et al.
7,128,406 B2 10/2006 Dixon et al.
(Continued)

FOREIGN PATENT DOCUMENTS

EP 2 371 545 A1 5/2011
JP 4722826 B2 7/2011
(Continued)

OTHER PUBLICATIONS

European Search Report dated Jun. 19, 2017, in counterpart European Application No. EP 170000228. (8 pages).
(Continued)

*Primary Examiner* — Juanita D Jackson
(74) *Attorney, Agent, or Firm* — Fitzpatrick, Cella, Harper & Scinto

(57) ABSTRACT

A first passage layer is provided with a plurality of supply passages each communicating with one portion of each of a plurality of pressure chambers and a plurality of collection passages each communicating with the other portion of each of the plurality of pressure chambers. A second passage layer is provided with a common supply passage communicating with the plurality of supply passages and a common collection passage communicating with the plurality of collection passages.

20 Claims, 55 Drawing Sheets

(56) References Cited

U.S. PATENT DOCUMENTS

| | | | | |
|---|---|---|---|---|
| 7,806,515 | B2 * | 10/2010 | Harvey et al. | 347/89 |
| 8,517,518 | B2 * | 8/2013 | Kashu et al. | 347/89 |
| 8,591,003 | B2 | 11/2013 | Kusakari et al. | |
| 8,746,844 | B2 | 6/2014 | Kusakari et al. | |
| 2002/0118256 | A1 | 8/2002 | Dixon et al. | |
| 2010/0327025 | A1 | 12/2010 | Yokoyama et al. | |
| 2011/0187773 | A1 | 8/2011 | Kusakari et al. | |
| 2011/0234668 | A1 | 9/2011 | Hoisington et al. | |
| 2012/0162316 | A1 | 6/2012 | Kusakari et al. | |
| 2012/0113197 | A1 | 10/2012 | Kashu et al. | |
| 2013/0300811 | A1 | 11/2013 | Kashu et al. | |
| 2014/0063132 | A1 | 3/2014 | Scheffelin et al. | |
| 2014/0085381 | A1 | 3/2014 | Yamamoto | |
| 2014/0300665 | A1 | 10/2014 | Kashu et al. | |

FOREIGN PATENT DOCUMENTS

| | | | |
|---|---|---|---|
| JP | 5264000 | a | 8/2013 |
| WO | 2013/002775 | A1 | 1/2013 |

OTHER PUBLICATIONS

Decision to Grant and search report dated May 16, 2018, in counterpart RU application No. 2016151773 (25 pages).

* cited by examiner

LIQUID EJECTION SUBSTRATE, LIQUID EJECTION HEAD, AND LIQUID EJECTION APPARATUS

CROSS-REFERENCE TO RELATED APPLICATIONS

This application is a continuation of U.S. patent application Ser. No. 15/389,083, filed on Dec. 22, 2016, which claims the benefit of priority from Japanese Application No. 2016-239794, filed Dec. 9, 2016, and Japanese Application No. 2016-002704, filed Jan. 8, 2016. The contents of the aforementioned applications are incorporated herein by reference in their entireties.

BACKGROUND OF THE INVENTION

Field of the Invention

The present invention relates to a liquid ejection substrate, a liquid ejection head, and a liquid ejection apparatus used to eject various liquids including ink.

Description of the Related Art

For example, in an inkjet printing head capable of selectively ejecting ink from a plurality of ejection openings, the ejection openings need to be densely arranged to print a high-quality image with high accuracy. Further, since the ink is thickened due to the evaporation of moisture in the ink from the ejection openings, there is a need to provide a countermeasure for an influence on a high-quality printing operation.

In order to handle such a demand Japanese Patent No. 4722826 discloses a method of circulating ink through a pressure chamber so that ink thickened inside the pressure chamber communicating with an ejection opening does not stay therein. Japanese Patent No. 4722826 discloses a configuration in which a member having a curved ink passage is formed by extruding aluminum and the ink is caused to forcedly flow into the pressure chamber corresponding to each of the plurality of ejection openings though the ink passage formed inside the member. Japanese Patent No. 5264000 discloses a configuration in which a member having a three-dimensionally curved ink passage is formed and the ink is caused to forcedly flow into the pressure chamber corresponding to each of the plurality of ejection openings through the ink passage formed inside the member.

However, in Japanese Patent No. 4722826 and Japanese Patent No. 5264000, the ink passage has a complex shape and thus a plurality of the ink passages cannot be easily and densely arranged so that the ink is circulated through the pressure chamber corresponding to each of the plurality of ejection openings densely arranged.

SUMMARY OF THE INVENTION

The invention provides a liquid ejection substrate, a liquid ejection head, and a liquid ejection apparatus capable of circulating a liquid through pressure chambers respectively corresponding to a plurality of ejection openings even when the ejection openings are densely arranged.

In the first aspect of the present invention, there is provided a liquid ejection substrate including an ejection opening that ejects a liquid, an ejection energy generation element that generates energy used to eject the liquid, and a pressure chamber that has the ejection energy generation element provided therein, wherein the liquid ejection substrate includes a first portion and a second portion deviated from each other in a thickness direction of the liquid ejection substrate, wherein the first portion is provided with a supply passage disposed at one side of the pressure chamber to supply the liquid to the pressure chamber and a collection passage disposed at the other side of the pressure chamber to collect the liquid from the pressure chamber, and wherein the second portion is provided with a common supply passage communicating with a plurality of the supply passages and a common collection passage communicating with a plurality of the collection passages.

In the second aspect of the present invention, there is provided a liquid ejection substrate including an ejection opening that ejects a liquid, an ejection energy generation element that generates energy used to eject the liquid, and a pressure chamber that has the ejection energy generation element provided therein, the liquid ejection substrate comprising:

a supply passage that is disposed at one side of the pressure chamber and extends in a direction intersecting a face provided with the ejection energy generation element;

a collection passage that is disposed at the other side of the pressure chamber and extends in a direction intersecting the face provided with the ejection energy generation element;

a common supply passage that communicates with a plurality of the supply passages; and a common collection passage that communicates with a plurality of the collection passages, wherein in a case where a passage resistance per unit length from a downstream end of the supply passage to an upstream end of the collection passage through the pressure chamber is indicated by R, a flow amount of the liquid flowing through the pressure chamber while the liquid is not ejected from the ejection opening is indicated by Q1, and a maximal negative pressure capable of ejecting the liquid from the ejection opening is indicated by P, a gap W between the downstream end of the common supply passage and the upstream end of the common collection passage satisfies a relation of $W<(2\times P)/(Q1\times R)$.

In the third aspect of the present invention, there is provided a liquid ejection substrate including an ejection opening that ejects a liquid, an ejection energy generation element that generates energy used to eject the liquid, and a pressure chamber that has the ejection energy generation element provided therein, the liquid ejection substrate comprising:

a supply passage that is disposed at one side of the pressure chamber and extends in a direction intersecting a face provided with the ejection energy generation element;

a collection passage that is disposed at the other side of the pressure chamber and extends in a direction intersecting the face provided with the ejection energy generation element;

a common supply passage that communicates with a plurality of the supply passages; and a common collection passage that communicates with a plurality of the collection passages, wherein in a case where a passage resistance per unit length from a downstream end of the supply passage to an upstream end of the collection passage through the pressure chamber is indicated by R, a maximal ejection amount of the liquid ejected from the ejection opening is indicated by Q2, and a maximal negative pressure capable of ejecting the liquid from the ejection opening is indicated by P, a gap W between the downstream end of the common supply passage and the upstream end of the common collection passage satisfies a relation of $W<(2\times P)/(Q2\times R)$.

In the fourth aspect of the present invention, there is provided a liquid ejection head having a liquid ejection substrate, the liquid ejection substrate including an ejection opening that ejects a liquid, an ejection energy generation element that generates energy used to eject the liquid, and a pressure chamber that has the ejection energy generation element provided therein, the liquid ejection head, wherein the liquid ejection substrate includes a first portion and a second portion deviated from each other in a thickness direction of the liquid ejection substrate, wherein the first portion is provided with a supply passage disposed at one side of the pressure chamber to supply the liquid to the pressure chamber and a collection passage disposed at the other side of the pressure chamber to collect the liquid from the pressure chamber, and wherein the second portion is provided with a common supply passage communicating with a plurality of the supply passages and a common collection passage communicating with a plurality of the collection passages.

In the fifth aspect of the present invention, there is provided a liquid ejection apparatus comprising:

a liquid ejection head including:

an ejection opening that ejects a liquid, an ejection energy generation element that generates energy used to eject the liquid, and a pressure chamber that has the ejection energy generation element provided therein, the liquid ejection head comprising:

an ejection opening array in which a plurality of the ejection openings are arranged;

a first passage that communicates with one side of the pressure chamber;

a second passage that communicates with the other side of the pressure chamber;

a supply passage array in which a plurality of supply passages supplying the liquid to the first passage are arranged in an arrangement direction of the plurality of ejection openings, the plurality of supply passage extending in a direction intersecting a face provided with the ejection energy generation element;

a collection passage array in which a plurality of collection passages collecting the liquid inside the second passage are arranged in the arrangement direction of the plurality of ejection openings, the plurality of collection passages extending in the intersection direction;

a common supply passage that extends in the arrangement direction of the plurality of ejection openings and communicates with the plurality of supply passages;

a common collection passage that extends in the arrangement direction of the plurality of ejection openings and communicates with the plurality of collection passages;

a controller configured to control a plurality of the ejection energy generation elements; and a differential pressure generator configured to generate a differential pressure between the common supply passage and the common collection passage so that a liquid flows through the common supply passage, the supply passage, the pressure chamber, the collection passage, and the common collection passage.

In the sixth aspect of the present invention, there is provided a liquid ejection head comprising:

an ejection opening that ejects a liquid, an ejection energy generation element that generates energy used to eject the liquid, a pressure chamber that has the ejection energy generation element provided therein, the liquid ejection head comprising:

an ejection opening array in which a plurality of the ejection openings are arranged;

a first passage that communicates with one side of the pressure chamber;

a second passage that communicates with the other side of the pressure chamber;

a supply passage array in which a plurality of supply passages supplying the liquid to the first passage are arranged in an arrangement direction of the plurality of ejection openings, the plurality of supply passage extending in a direction intersecting a face provided with the ejection energy generation element;

a collection passage array in which a plurality of collection passages collecting the liquid inside the second passage are arranged in the arrangement direction of the plurality of ejection openings, the plurality of collection passages extending in the intersection direction;

a common supply passage that extends in the arrangement direction of the plurality of ejection openings and communicates with the plurality of supply passages; and a common collection passage that extends in the arrangement direction of the plurality of ejection openings and communicates with the plurality of collection passages.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings. A liquid ejection substrate, a liquid ejection head, and a liquid ejection apparatus of the embodiments below are application examples of an ink ejection substrate (a substrate for an inkjet printing head), an inkjet printing head, and an inkjet printing apparatus ejecting ink as a liquid.

Additionally, the liquid ejection head and the liquid ejection apparatus of the present invention can be applied to a printer, a copying machine, a facsimile having a communication system, a word processor having a printer, and an industrial printing apparatus combined with various processing devices. For example, the liquid ejection head and the liquid ejection apparatus can be used to manufacture a biochip or print an electronic circuit. Further, since the embodiments to be described below are detailed examples of the invention, various technical limitations thereof can be made. However, embodiments of the present invention are not limited to the embodiments or the other detailed methods of the specification and can be modified within the spirit of the present invention.

First Embodiment

FIGS. 1 to 10 are explanatory diagrams illustrating a liquid ejection unit 300 according to a first embodiment of the present invention. Here, the liquid ejection unit 300 constitutes an inkjet printing head and the printing head is mounted on an inkjet printing apparatus as will be described later.

Figure 1:
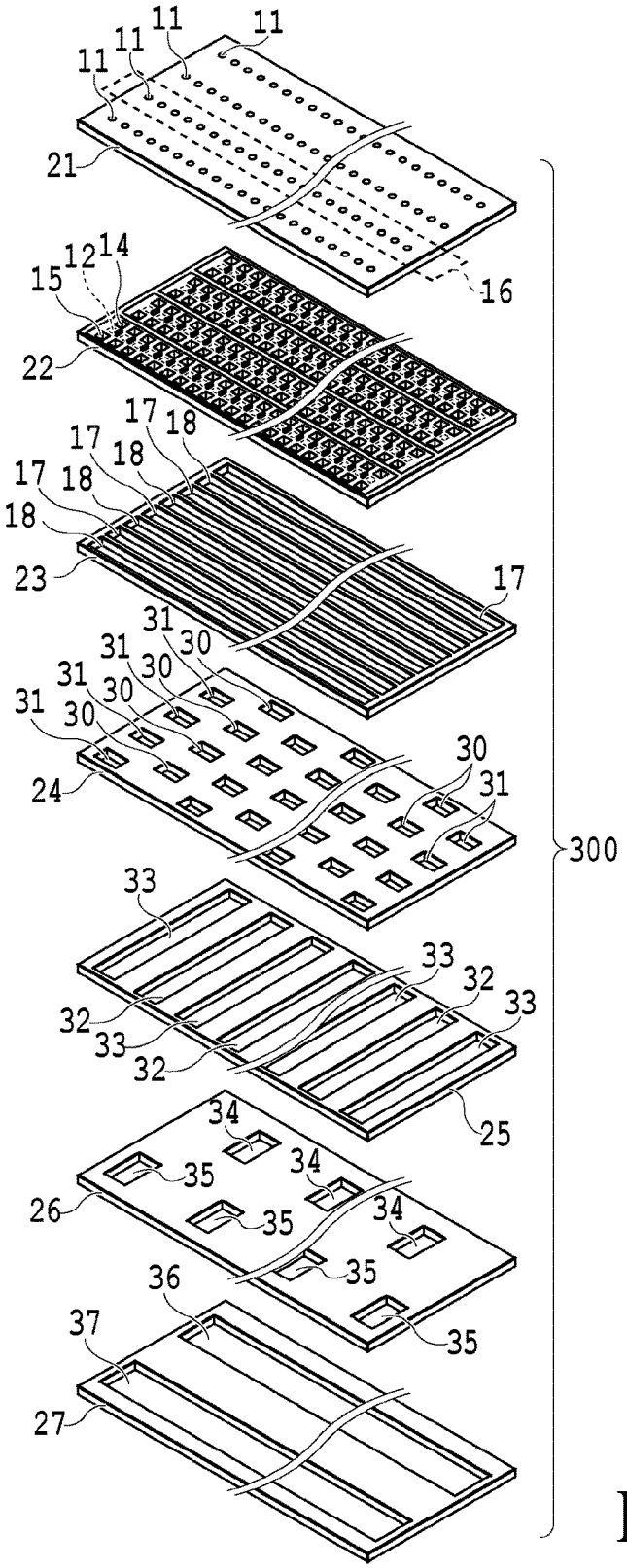
FIG. 1 is an exploded perspective view illustrating a liquid ejection substrate of a first embodiment of the present invention.
Figure 2:
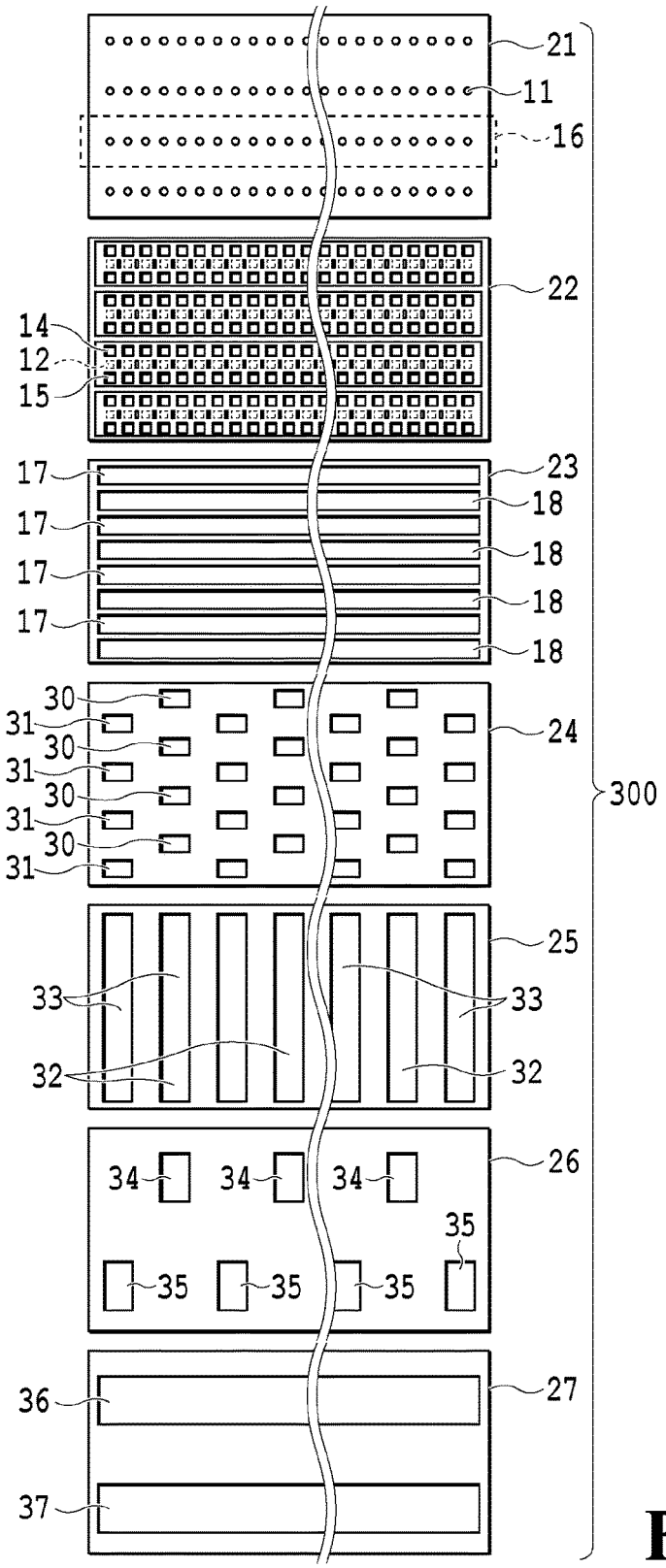
FIG. 2 is an exploded top view illustrating the liquid ejection substrate of FIG. 1.

As illustrated in FIGS. 1 and 2, the liquid ejection unit 300 of the embodiment has a six laminated passages structure including an orifice plate 21, a first passage layer 22, a second passage layer 23, a third passage layer 24, a fourth passage layer 25, a fifth passage layer 26, and a sixth passage layer 27. The first passage layer 22 is provided with an ejection energy generation element 12 which generates ejection energy for ejecting ink as a liquid and thus ink inside a pressure chamber 13 can be ejected from an ejection opening 11 of the orifice plate 21 by the ejection energy. When the ink inside the pressure chamber 13 is in a static state, the pressure inside the pressure chamber 13 is kept at a negative pressure in which a meniscus of the ink is formed at the ejection opening 11. When a change in pressure is generated inside the pressure chamber 13, an ink ejection speed or an ink ejection amount (volume) changes and thus ink ejection characteristics are influenced. Particularly, when the pressure inside the pressure chamber 13 becomes lower than a predetermined pressure, the ink cannot be easily ejected.

As the ejection energy generation element 12, an electrothermal conversion element (a heater) or a piezo element can be used. In a case where the heater is used, the ink inside the pressure chamber 13 is changed into bubbles by the heat and the ink can be ejected from the ejection opening 11 by using the foaming energy.

Figure 3:
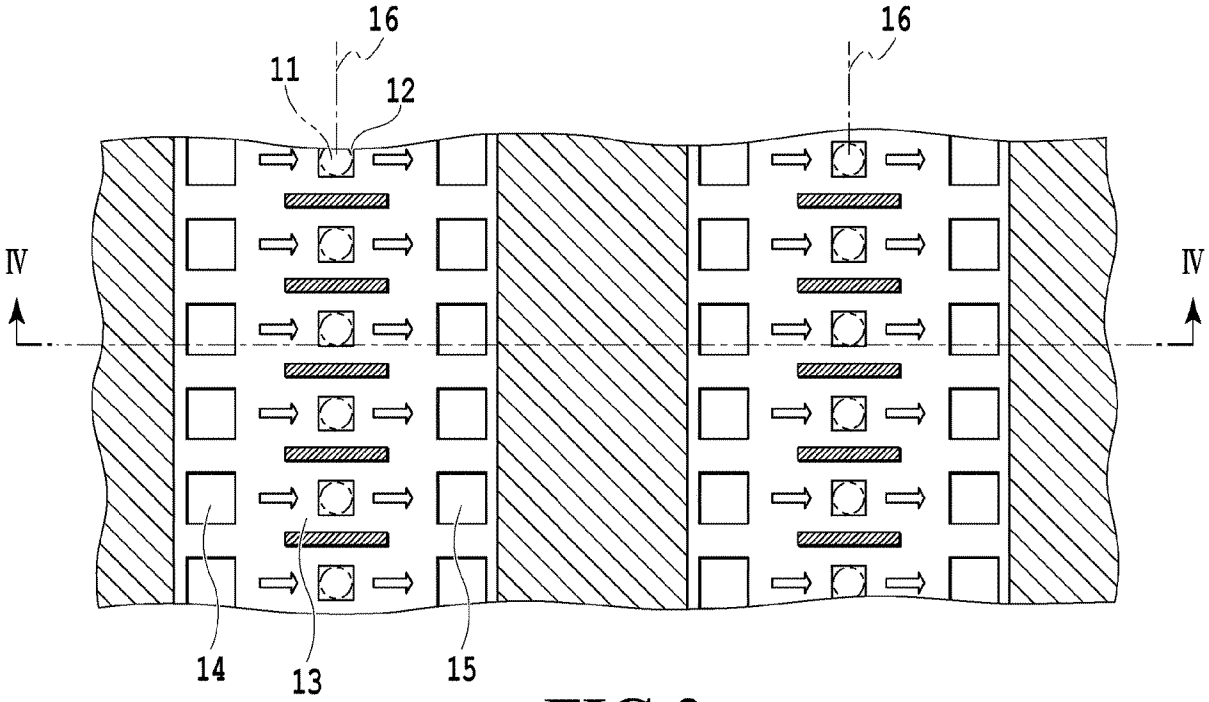
FIG. 3 is a top view illustrating a main part of the liquid ejection substrate of FIG. 1.
Figure 4:
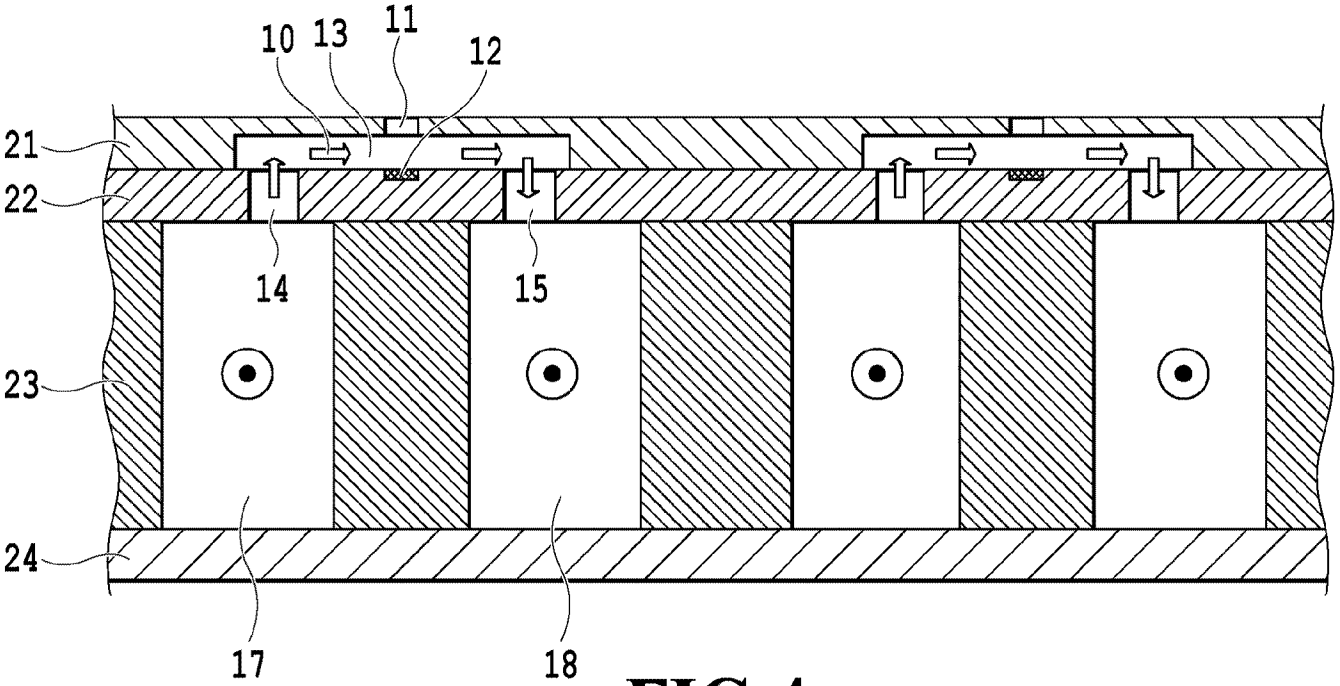
FIG. 4 is a cross-sectional view taken along a line IV-IV of FIG. 3.

As illustrated in FIG. 3, a plurality of the ejection openings 11 are arranged densely to form an ejection opening array 16. In this example, four ejection opening arrays 16 are formed. As illustrated in FIG. 4, a first common supply passage 17 of the second passage layer 23 communicates with one side (the left side of FIG. 4) of each pressure chamber 13 through an individual supply passage 14 and a passage 10 corresponding to each pressure chamber 13. Similarly, a first common collection passage 18 of the second passage layer 23 communicates with the other side (the right side of FIG. 4) of each pressure chamber 13 through the passage 10 and an individual collection passage 15 from the pressure chamber 13. The plurality of supply passages 14 and the plurality of collection passages 15 extend in the thickness direction of the first passage layer 22 and are arranged in the extending direction (first direction) of the ejection opening arrays 16, so that a supply passage array and a collection passage array are formed. The thickness direction of the first passage layer 22 corresponds to a direction intersecting (in this example, orthogonal to) a face of a liquid ejection substrate on which the ejection energy generation elements 12 are disposed. The first common supply passage 17 communicates with a first supply opening 30 formed in the third passage layer 24 and receives the ink supplied from the first supply opening 30. Similarly, the first common collection passage 18 communicates with a first collection opening 31 formed in the third passage layer 24. A plurality of the first supply openings 30 are arranged along the extending direction (first direction) of the ejection opening array 16 so as to form a first supply opening array. Similarly, a plurality of the first collection openings 31 are arranged along the extending direction of the ejection opening array 16 so as to form a first collection opening array. In the third passage layer 24, four first supply opening arrays and four first collection opening arrays are alternately arranged in parallel. The fourth passage layer 25 is provided with second common supply passages 32 and second common collection passages 33, and the fifth passage layer 26 is provided with second supply openings 34 and second collection openings 35. The sixth passage layer 27 is provided with a third common supply passage 36 and a third common collection passage 37.

The first common supply passage 17 has a configuration in which one side (a side facing the first passage layer 22) in the thickness direction of the second passage layer 23 communicates with the plurality of supply passages 14 and the other side (a side facing the third passage layer 24) communicates with the plurality of first supply openings 30. Similarly, the first common collection passage 18 has a configuration in which one side in the thickness direction of the second passage layer 23 communicates with the plurality of collection passages 15 and the other side communicates with the plurality of first collection openings 31. The second common supply passage 32 has a configuration in which one side in the thickness direction of the fourth passage layer 25 communicates with the plurality of first supply openings 30 and the other side communicates with the plurality of second supply openings 34. Similarly, the second common collection passage 33 has a configuration in which one side in the thickness direction of the fourth passage layer 25 communicates with the first collection opening 31 and the other side communicates with the second collection opening 35. Further, the third common supply passage 36 communicates with the plurality of second supply openings 34, and the third common collection passage 37 communicates with the plurality of second collection openings 35.

The arrangement density of the plurality of second supply openings 34 and the arrangement density of the plurality of second collection openings 35 are lower than the arrangement density of the plurality of first supply openings 30 and the arrangement density of the plurality of first collection openings 31. Further, the arrangement density of the plurality of first supply openings 30 and the arrangement density of the plurality of first collection openings 31 are lower than the arrangement density of the plurality of supply passages 14 and the arrangement density of the plurality of collection passages 15. The first common supply passage 17 and the first common collection passage 18 are formed in parallel to follow the first direction. The second common supply passage 32 and the second common collection passage 33 are formed in parallel to follow the second direction. The third common supply passage 36 and the third common collection passage 37 are formed in parallel to follow the first direction.

In this way, the liquid ejection unit 300 of this example is formed by laminating the plurality of passage members. The passage forming density in these passage layers increases in order of the sixth passage layer 27, the fifth passage layer 26, the fourth passage layer 25, the third passage layer 24, the second passage layer 23, and the first passage layer 22. Accordingly, the liquid ejection unit 300 can have a configuration in which the plurality of ejection opening arrays 16 are provided densely while an increase in size of each of the element substrates and the passage members is suppressed.

The first passage layer 22 and the second passage layer 23 are formed in a liquid ejection substrate 100 in this embodiment. In the present invention, the configurations of the third passage layer 24 to the sixth passage layer 27 are not particularly limited. Specifically, first and second configuration examples below can be exemplified. In the first configuration example, the third passage layer 24 is formed in a cover plate (a lid member) 20 or 2020 of the following embodiments of FIG. 36C or FIG. 45C, and a part of the fourth passage layer 25 is formed in a support member 400 of the following embodiments from FIGS. 24A to 24E. The other part of the fourth passage layer 25 is formed in a first passage member 500 or 50 of the following embodiments of FIGS. 24A to 24E or FIG. 31, and a part of the fifth passage layer 26 and the sixth passage layer 27 are formed in a second passage member 600 or 60 of the following embodiments from FIGS. 24A to 24E or FIG. 31. The other part of the sixth passage layer 27 is formed in a third passage member 370 of the embodiment of FIG. 31 to be described later. Meanwhile, in the second configuration example, the third passage layer 24 is formed in the cover plate 20 or 2020, and a part of the fourth passage layer 25 is formed in the support member 400. The other part of the fourth passage layer 25 and the fifth passage layer 26 are formed in the first passage member 500 or 50, and the sixth passage layer 27 is formed in the second passage member 600 or 60. Additionally, the second common supply passage 32, the second common collection passage 33, the second supply opening 34, and the second collection opening 35 are also not limited to the configuration of this example.

The ink which is supplied from the outside is led from the third common supply passage 36 communicating with an ink inflow opening to the pressure chamber 13 while sequentially passing through the second supply opening 34, the second common supply passage 32, the first supply opening 30, the first common supply passage 17, and the supply passage 14. The ink inside the pressure chamber 13 flows to the outside from a collection opening communicating with the third common collection passage 37 while sequentially passing through the collection passage 15, the first common collection passage 18, the first collection opening 31, the second common collection passage 33, the second collection opening 35, and the third common collection passage 37. Since the ink is circulated in this way, the thick ink which is apt to stay inside the pressure chamber 13 flows to the outside. Accordingly, it is possible to suppress a change in color concentration of the ink and a decrease in ink ejection speed from the ejection opening 11. Hereinafter, such a forced flow of the ink will be referred to as an "ink circulation flow".

Figure 5:
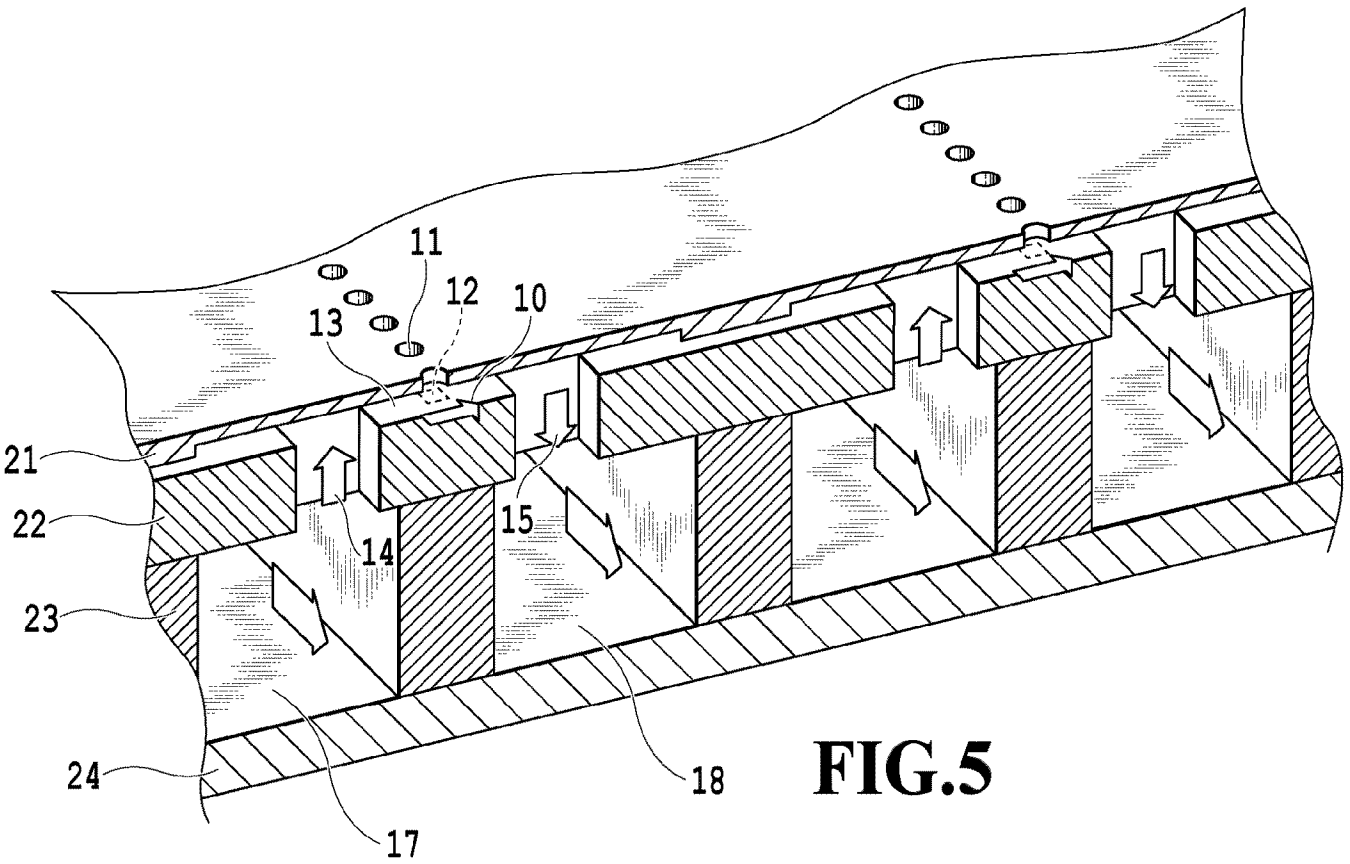
FIG. 5 is a cross-sectional perspective view illustrating a main part of the liquid ejection substrate of FIG. 1.

In this example, as illustrated in FIGS. 3, 4, and 5, the supply passage 14 and the collection passage 15 are disposed to face each other with the ejection opening 11 interposed therebetween. Since the supply passage 14 and the collection passage 15 face each other in this way, a highly efficient ink circulation flow is generated inside the pressure chamber 13 and the ejection opening 11. Accordingly, it is possible to highly efficiently suppress a decrease in ink ejection speed and a change in color concentration of the ink. Further, the supply passage 14 and the collection passage 15 are separately formed at a plurality of positions in the first direction corresponding to the extending direction of the ejection opening array 16 so as to correspond to each of the pressure chambers 13. Since the supply passage 14 and the collection passage 15 are separately formed at a plurality of positions in this way, an electric wire for driving the ejection energy generation element 12 can be disposed between the adjacent supply passages 14 and between the adjacent collection passages 15. For that reason, there is no need to dispose a wire extending in the first direction between the supply passage 14 and the ejection opening 11 and between the collection passage 15 and the ejection opening 11. Accordingly, a portion therebetween can be further decreased in size. A relation in number between the supply passage 14 and the ejection opening 11 may be one to one, one to two, or one to five, and the number of the pressure chambers 13 communicating with the supply passage 14 is not limited to one as in this example.

In this example, since the ink circulation flow is generated inside the pressure chamber 13 and the ejection opening 11, the passage is formed as below.

As illustrated in FIG. 2, the first common supply passage 17 extends in the first direction to communicate with the plurality of supply passages 14 and communicates with the pressure chamber 13 through each supply passage 14. Similarly, the first common collection passage 18 extends in the first direction to communicate with the plurality of collection passages 15 and communicates with the pressure chamber 13 through each collection passage 15.

In this way, the first passage layer 22 and the second passage layer 23 are provided with a series of ink passages including the supply passage 14, the collection passage 15, the first common supply passage 17, and the first common collection passage 18 and corresponding to the ejection opening array 16. Through such ink passages, the ink circulation flow can be generated inside the pressure chamber 13 of the liquid ejection substrate 100 and the ejection opening 11 of the orifice plate 21.

Figure 6A:
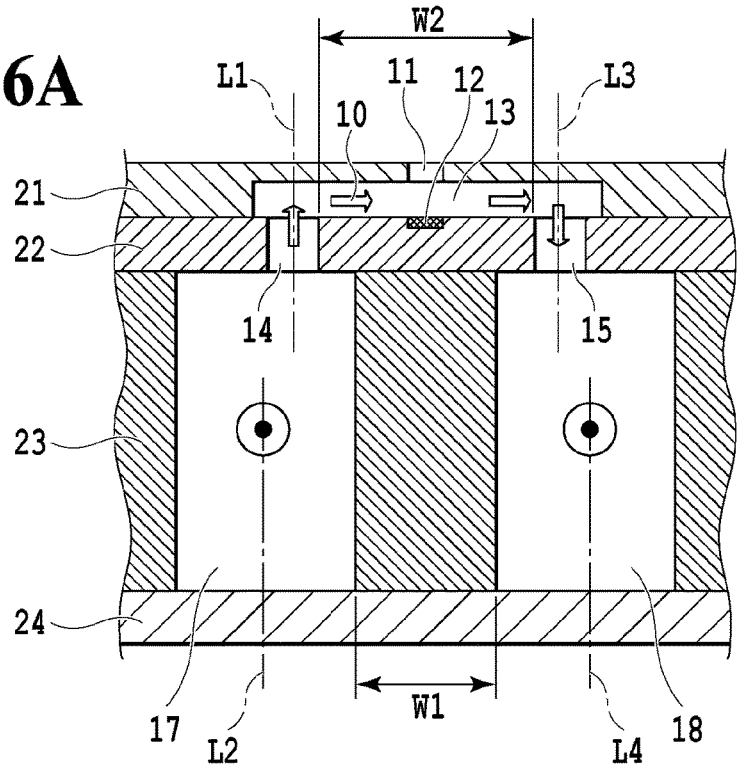
FIG. 6A is a longitudinal sectional view illustrating a main part of the liquid ejection substrate of FIG. 1.

Further, as illustrated in FIG. 6A, side walls forming the supply passage 14, the collection passage 15, the first common supply passage 17, and the first common collection passage 18 are substantially orthogonal to the front and rear faces (the upper and lower faces of the drawing) of the first passage layer 22. Here, the substantial orthogonal state includes an inclination of a taper shape formed when the first passage layer 22 and the second passage layer 23 are processed. The supply passage 14, the collection passage 15, the first common supply passage 17, and the first common collection passage 18 may be formed by, for example, dry etching. Further, these passages may be formed by laser processing or a combination of dry etching and laser processing. The depth direction (the vertical direction of FIG. 6A) of each of the supply passage 14, the collection passage 15, the first common supply passage 17, and the first common collection passage 18 is substantially perpendicular to the front face of the first passage layer 22. Accordingly, when the ink passages are densely formed with high efficiency, the ink circulation flow can be generated highly efficiently inside the pressure chamber 13 and the ejection opening 11 densely formed in the first passage layer 22.

(Relation (1) Between First Common Supply Passage 17 and First Common Collection Passage 18)

The first common supply passage 17 and the first common collection passage 18 are formed as below.

Figure 6B:
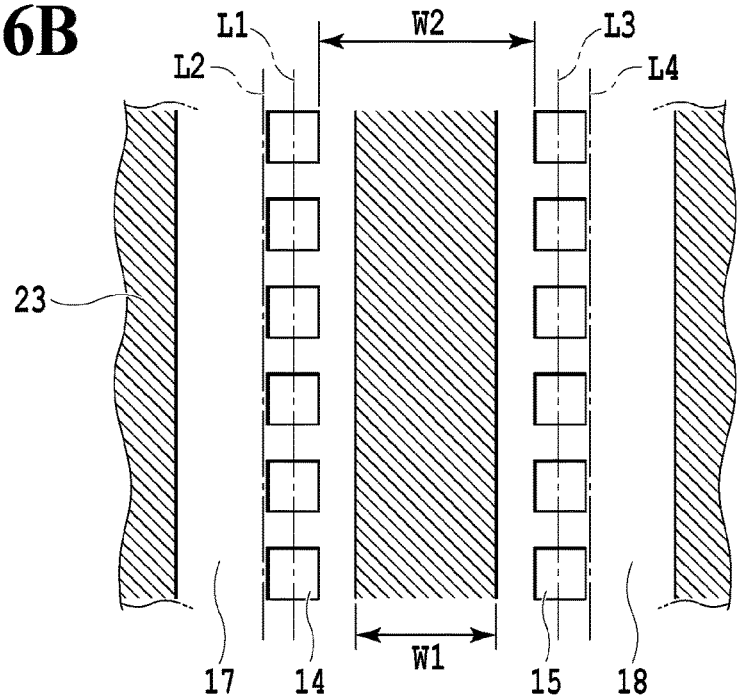
FIG. 6B is a side view illustrating a main part of the liquid ejection substrate of FIG. 1.

As illustrated in FIGS. 6A and 6B, a gap (a beam width) between the downstream end of the first common supply passage 17 and the upstream end of the second common collection passage 18 is indicated by W1, and a distance between the supply passage 14 and the collection passage 15 is indicated by W2. Further, the passage resistance per unit length from the downstream end of the supply passage 14 to the upstream end of the collection passage 15 through the passage 10, the pressure chamber 13, and the passage 10 is indicated by R, and the flow amount of the ink circulation flow generated inside each pressure chamber 13 is indicated by Q1. The passage resistance R is expressed by an equation including a term (including a component of a time) representing the viscosity of the ink. Further, a maximal negative pressure inside the pressure chamber 13 within a range in which the meniscus interface of the ink in the ejection opening 11 is not collapsed except or a maximal negative pressure inside the pressure chamber 13 within a range in which the ink can be appropriately ejected from the ejection opening 11 is indicated by Pmax. These components have a relation of Equation (1). Relative Equation (1) will be described below.

$$W2<(2\times P\max)/(Q1\times R) \quad \text{Equation(1)}$$

Figure 8A:
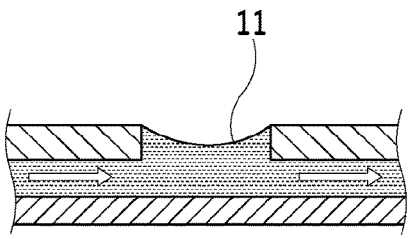
FIGS. 8A and 8B are explanatory diagrams respectively illustrating a meniscus interface of ink in an ejection opening.
Figure 8B:
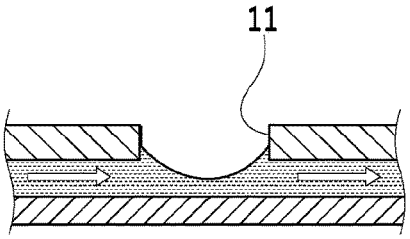
Figure 8C:
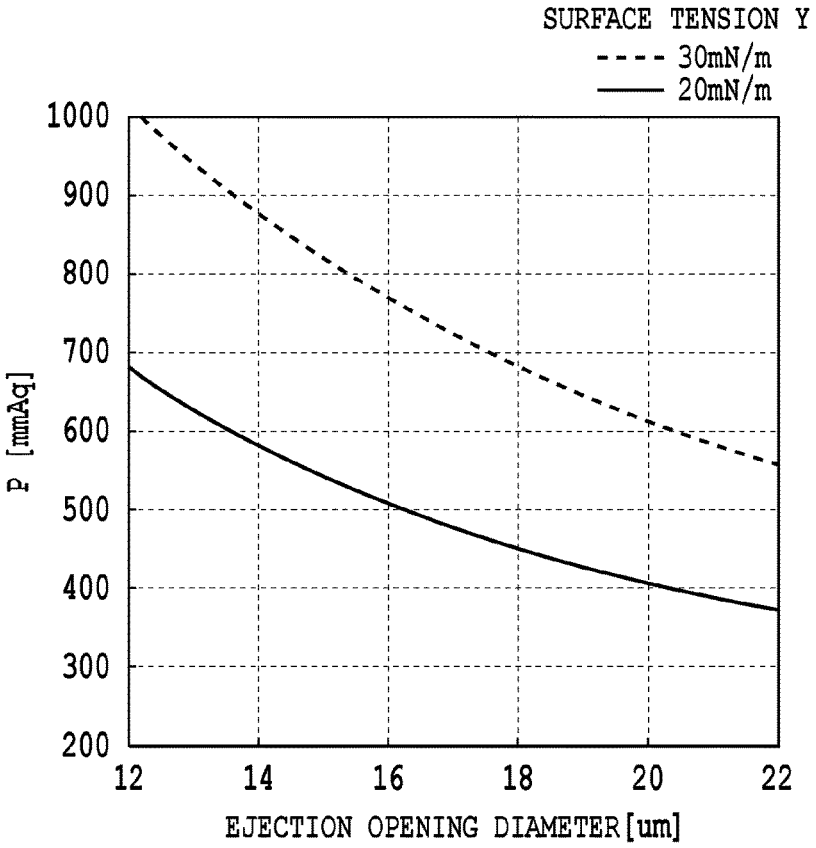
FIG. 8*c* is an explanatory diagram illustrating a relation between a hole diameter of an ejection opening and an allowable pressure limit.

In a case where the meniscus interface is depressed by the influence of the negative pressure as illustrated in FIG. 8A and the meniscus interface is destroyed in accordance with an increase in negative pressure as illustrated in FIG. 8B, the ink does not exist on the ejection energy generation element 12 and thus the ink cannot be easily ejected in a normal condition. In a case where the surface tension of the ink is 30 mN/m and 20 mN/m, the hole diameter of the ejection opening 11 and the allowable pressure limit in the ejection opening 11 have a relation illustrated in FIG. 8C. Generally, the meniscus of the ink in the ejection opening depends on the hole diameter of the ejection opening and the surface tension of the ink. However, the meniscus interface is destroyed when the pressure of −1000 mmAq or more is not kept. Thus, the maximal negative pressure within a range in which the meniscus interface is not destroyed is −1000 mmAq in a case where the hole diameter of the ejection opening is 12 μm and the surface tension of the ink is 30 mN/m as an example. Further, even in a range in which the meniscus interface is not destroyed, the amount of the ejected ink decreases due to the depression of the meniscus interface as illustrated in FIG. 8A. Accordingly, the ink ejection state is influenced so that many sub-droplets (satellites) of the ink are generated.

Here, an appropriate ink ejection state indicates a state where the ink is satisfactorily ejected in a degree in which distortion of a printed image is not visually recognized. Particularly, it is desirable to employ an ink ejection state in which a change in ink ejection amount is small and is not visually recognized. Further, in a case where main droplets and sub-droplets (satellites) of the ink are generated during the ink ejection operation, an ink ejection state is desirable in which at least a part of sub-dots of the ink formed by satellites contact a main dot of the ink formed by main droplets and landed on a print medium.

In this way, the maximal negative pressure Pmax indicates a negative pressure in which the meniscus interface is destroyed or the ink cannot be appropriately ejected when the pressure becomes higher than the maximal negative pressure. Further, when the satellites are generated, it is desirable that the satellites are landed on the print medium so that the sub-dots are located within the main dot. For example, the maximal negative pressure Pmax was 500 mmAq. Further, the ink circulation flow amount Q1 is a flow amount capable of suppressing a decrease in ink ejection speed and a change in color concentration of the ink. That is, the flow amount can suppress a possibility in which the ink ejection speed decreases and the ink landing position changes to a recognizable degree due to the evaporation of the moisture of the ink from the ejection opening 11. Further, the flow amount can suppress a possibility in which the color concentration of the ink changes and the printed image becomes uneven to a recognizable degree due to the evaporation of moisture of the ink from the ejection opening 11. For example, the ink circulation flow amount Q1 indicates a circulation flow amount capable of suppressing a decrease in ink ejection speed within 10% of the normal ejection state. In an experiment example, the ink circulation flow amount was calculated as a flow rate of 0.05 m/s or more within the pressure chamber 13. Further, the flow rate was 0.1 m/s in the other experiment examples.

When a relation of Equation (1) is satisfied, the pressure inside the first common supply passage 17 can be kept at a negative pressure. In the inkjet printing head, it is desirable that the pressure inside the passage of the printing head be kept at a negative pressure. In a case where the pressure is a positive pressure, possibilities below arise. That is, in a case where the pressure inside the ink passage of the printing head is a positive pressure, the ink easily leaks from the components of the printing head. Further, the ink easily leaks from the ejection opening 11. For example, even when the pressure inside the first common supply passage 17 is the positive pressure and the pressure inside the pressure chamber 13 is kept at the negative pressure due to the pressure loss caused by the ink circulation flow in the ink circulation state, there is concern that the pressure loss changes due to a change in ink circulation flow and the pressure inside the pressure chamber 13 may become the positive pressure. As an extreme example, when the ink circulation flow is stopped, the pressure of the pressure chamber 13 may become the positive pressure as in the first common supply passage. In order to prevent the pressure inside the pressure chamber 13 from becoming a positive pressure, a complex control of the ink supply system is needed.

(Description of Relative Equation (1))

Next, Equation (1) for keeping the pressure of the first common supply passage 17 at a negative pressure will be described in detail.

A differential pressure ΔP between the supply passage 14 and the collection passage 15 is expressed by Equation (2).

$$\Delta P=Q1\times R\times W2 \quad \text{Equation(2)}$$

Further, in a case where the pressure of the supply passage 14 is indicated by Pin and the pressure of the collection passage 15 is indicated by Pout, Equation (3) is established. Further, in a case where the ejection opening 11 is located at an intermediate position between the supply passage 14 and the collection passage 15, the pressure Pn of the ejection opening 11 is expressed by Equation (4).

$$\Delta P=P\text{in}-P\text{out} \quad \text{Equation(3)}$$

$$Pn=(P\text{in}+P\text{out})/2 \quad \text{Equation(4)}$$

From Equations (3) and (4), Equation (5) is established.

$$P\text{in}=Pn+(\Delta P/2) \quad \text{Equation(5)}$$

In order to keep the pressure of the first common supply passage 17 at the negative pressure, Equation (6) needs to be satisfied.

$$P\text{in}=Pn+(\Delta P/2)<0 \quad \text{Equation(6)}$$

Equation (6) can be modified into Equation (7).

$$-Pn>\Delta P/2 \quad \text{Equation(7)}$$

Since an equation of Pn>−PMAX needs to be satisfied in order to normally eject the ink, Equation (8) is established.

$$P\max>\Delta P/2 \quad \text{Equation(8)}$$

From Equations (2) and (8), the above Equation (1) can be derived.

Further, W1 and W2 have a relation of Equation (9).

$$W1<W2 \quad \text{Equation(9)}$$

From a relation of Equation (9), Equation (10) is established.

$$W1<(2\times P\max)/(Q1\times R) \quad \text{Equation(10)}$$

When the gap W1 is set in order to satisfy a relation of Equation (10), the pressure of the first common supply passage 17 can be kept at the negative pressure and thus the reliabilities of the substrate and the printing head can be improved.

Particularly, the gap (the beam width) W1 needs to be decreased further in the printing head in which the passage resistance of the pressure chamber 13 is high. In a printing head in which a piezoelectric element is used as the ejection energy generation element 12, the gap W1 may be increased since the passage resistance of the pressure chamber 13 decreases generally. Meanwhile, in a printing head in which a heater is used as the ejection energy generation element 12, the gap W1 needs to be further decreased since the passage resistance of the pressure chamber 13 increases generally.

(Relation (2) Between First Common Supply Passage 17 and First Common Collection Passage 18)

In a case where the maximal ejection amount of the ink ejected from the ejection opening 11 is indicated by Q2, it is desirable to set the first common supply passage 17 and the first common collection passage 18 to satisfy a relation of Equation (11).

$$W1<(2\times P\max)/(Q2\times R) \quad \text{Equation(11)}$$

When the ink circulation flow amount Q1 is set to be larger than the maximal ejection amount Q2, the reverse flow of the ink circulation flow can be suppressed even when the ink is ejected maximally. In a case where the reverse flow of the ink circulation flow is generated, heat generated by the ejection of the ink is not discharged by the ink circulation flow. Further, the ink may be excessively heated due to the reverse flow of the exhaust heat and an ink ejection failure may occur due to the reverse flow of sediments inside the ink passage. However, since the reverse flow of the ink circulation flow is suppressed, such states can be suppressed.

When the first common supply passage 17 and the first common collection passage 18 are set to satisfy a relation of Equation (11), the pressure inside the first common supply passage 17 can be kept at the negative pressure while the reverse flow of the ink circulation flow is suppressed. As a result, the reliabilities of the substrate and the printing head can be improved.

As a result of the experiment, when the height of the pressure chamber 13 is set to 20 μm, the viscosity of the ink is set to 10 cP, and the beam width W1 is set to 200 μm or less, the pressure inside the first common supply passage 17 can be kept at the negative pressure even when the ink circulation flow rate is 0.1 m/s for suppressing the reverse flow of the ink circulation flow. Further, when the beam width W is set to 100 μm or less, the pressure inside the first common supply passage 17 can be kept at the negative pressure while the reverse flow of the ink circulation flow is suppressed even when the ink of 10 pl is ejected at an ejection frequency (the driving frequency of the printing head) of 30 kHz.

(Arrangement Relation Between Passages 17 and 14 and Arrangement Relation Between Passages 18 and 15)

Further, the arrangement relation between the first common supply passage 17 and the supply passage 14 and the arrangement relation between the first common collection passage 18 and the collection passage 15 may be set as below. That is, as illustrated in FIG. 6B, a center L1 of the supply passage 14 in the second direction is set to a position near the ejection opening 11 in relation to a center L2 of the first common supply passage 17 in the second direction. Similarly, a center L3 of the collection passage 15 in the second direction is set to a position near the ejection opening 11 in relation to a center L4 of the first common collection passage 18 in the second direction. In this way, when the supply passage 14 and the collection passage 15 are provided near the ejection opening 11, the width W2 is set to be smaller even when the same beam width W1 is set and thus the pressure inside the ejection opening 11 can be kept easily at an appropriate pressure.

(Arrangement Relation Between Passage 17 and Passage 18)

It is desirable to set an arrangement relation between the first common supply passage 17 and the first common collection passage 18 as below.

Figure 9:
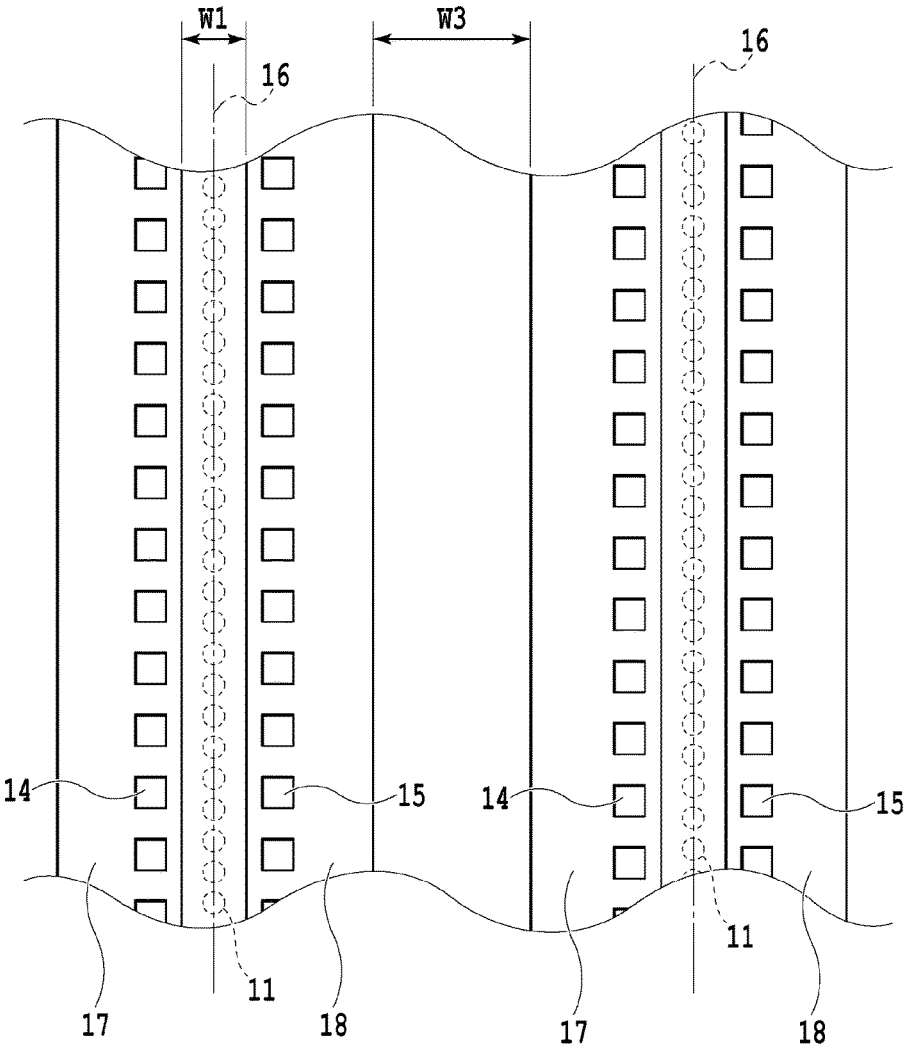
FIG. 9 is an explanatory diagram illustrating a positional relation between a first common supply passage and a first common collection passage.

That is, as illustrated in FIG. 9, in a case where a beam width between the first common supply passage and the first common collection passage 18 located between the adjacent ejection opening arrays 16 is indicated by W3, the beam width W3 is set to be larger than the beam width W1. When the beam width W3 is set to be large, the strength of the substrate can be improved. FIG. 9 is a diagram illustrating the liquid ejection substrate when viewed from the rear face side thereof in a state where the ejection opening 11 is visibly viewed. In this way, the first common supply passage 17 and the first common collection passage 18 communicating with the same ejection opening array 16 are formed close to each other so that the beam width W1 is set to be small. Meanwhile, the first common supply passage 17 communicating with one of the adjacent ejection opening arrays 16 is separated from the first common collection passage 18 communicating with the other thereof so that the beam width W2 is large. Accordingly, the strength of the substrate can be improved while the reverse flow of the ink circulation flow is suppressed so that the pressure inside the first common supply passage 17 is kept at the negative pressure.

(Structure (1) for Suppressing Change in Ink Circulation Flow Amount and Pressure)

Further, in the embodiment, a structure below is provided to suppress a change in ink circulation flow amount and a change in pressure of each pressure chamber 13.

That is, as illustrated in FIGS. 1 and 2, the plurality of first supply openings 30 communicate with one first common supply passage 17. Similarly, the plurality of first collection openings 31 communicate with one first common collection passage 18. The first supply opening 30 and the first collection opening 31 are disposed so that a change in ink circulation flow amount and a change in pressure of each pressure chamber 13 fall within a range in which the ink ejection characteristics are not influenced. Specifically, the first supply opening 30 and the first collection opening 31 are alternately arranged in the first direction in which the ejection opening array 16 extends. Accordingly, a gap between the first supply opening 30 and the first collection opening 31 in the first direction can be further decreased. Thus, even in a case where a passage width of each of the first common supply passage 17 and the first common collection passage 18 is relatively narrow, a change in ink circulation flow amount and a change in pressure of each pressure chamber 13 can be suppressed.

(Structure (2) for Suppressing Change in Ink Circulation Flow Amount and Pressure)

Furthermore, in the embodiment, a structure below is provided to suppress a change in ink circulation flow amount and a change in pressure of each pressure chamber 13.

That is, as illustrated in FIGS. 1 and 2, the second common supply passage 32 extends in the second direction and communicates with the plurality of first supply openings 30 arranged in the second direction. Similarly, the second common collection passage 33 extends in the second direction and communicates with the plurality of first collection openings 31 arranged in the second direction. Further, the plurality of second common supply passages 32 communicate with one third common supply passage 36 together through the second supply openings 34. Similarly, the plurality of second common collection passages 33 communicate with one third common collection passage 37 together through the second collection openings 35.

When the ink passages communicate with one another by a six-layer structure in this way, the plurality of first common supply passages 17 which are formed at a narrow pitch to match the plurality of ejection opening arrays 16 which are arranged densely are finally grouped into one third common supply passage 36 through the plurality of first supply openings 30. Similarly, the plurality of first common collection passage 18 which are formed at a narrow pitch to match the plurality of ejection opening arrays 16 which are arranged densely are finally grouped into one third common collection passage 37 through the plurality of first collection openings. Thus, the plurality of ejection opening arrays 16 can be densely arranged without widening the passage width of each of the first common supply passage 17 and the first common collection passage 18. Further, it is possible to suppress a change in ink circulation flow amount and pressure in each pressure chamber 13 corresponding to each ejection opening 11 of the plurality of ejection opening arrays 16 which are arranged densely in this way. Further, it is possible to supply the ink from an ink tank (not illustrated) and to cause the ink to be collected into the ink tank while suppressing a change in ink circulation flow amount and pressure of the pressure chamber 13 with respect to the ejection openings 11 which are arranged densely. Accordingly, not only the printing head and the printing apparatus including the same but also various liquid ejection heads and the liquid ejection apparatuses including the same can be provided in a compact size.

(Structure (3) for Suppressing Change in Ink Circulation Flow Amount and Pressure)

Further, a structure below is desirable in order to suppress a change in ink circulation flow amount and a change in pressure of each pressure chamber 13.

That is, the first supply openings 30 and/or the first collection openings 31 located at both ends of the ejection opening array 16 are formed to be smaller than the first supply openings 30 and/or the first collection openings 31 located at position other than both ends. That is, the openings of the first supply openings 30 and/or the first collection openings 31 of the former are formed to be smaller than the openings of the first supply openings 30/or the first collection openings 31 of the latter. In the vicinity of the first supply openings 30 located at both ends of the ejection opening array 16, the ejection opening 11 of the ejection opening array 16 is located only at one side in the first direction of the first supply openings 30 located at both ends of the ejection opening array 16. Therefore, the ink flow amount of the first supply openings 30 located at both ends of the ejection opening array 16 is smaller than the ink flow amount of the other first supply openings 30. Similarly, in the vicinity of the first collection openings 31 located at both ends of the ejection opening array 16, the ejection opening 11 of the ejection opening array 16 is located at only one side in the first direction of the first collection openings 31 located at both ends of the ejection opening array 16. Therefore, the ink flow amount of the first collection openings 31 located at both ends of the ejection opening array 16 is smaller than the ink flow amount of the other first collection openings 31.

In this way, the shapes of the first supply openings 30 and/or the first collection openings 31 formed at both ends of the ejection opening array 16 are formed in a small size so that the passage resistances increase. Accordingly, the pressure losses which are generated in the first supply openings 30 and/or the first collection openings 31 formed at both ends of the ejection opening array 16 can be adjusted to be similar to the pressure losses which are generated in the other first supply openings 30 and/or the first collection openings 31. Thus, it is possible to reduce a difference between the ink flow amount of the ink flowing in the pressure chamber 13 through the first supply openings 30 and/or the first collection openings 31 at both ends of the ejection opening array 16 and the ink flow amount of the ink flowing in the pressure chamber 13 through the other first supply openings 30 and/or the other first collection openings 31. As a result, a difference in ink circulation flow amount inside each pressure chamber 13 can be further suppressed.

(Structure (4) for Suppressing Change in Ink Circulation Flow Amount and Pressure)

Further, a structure below is desirable in order to suppress a change in ink circulation flow amount and a change in pressure of each pressure chamber 13.

Figure 7:
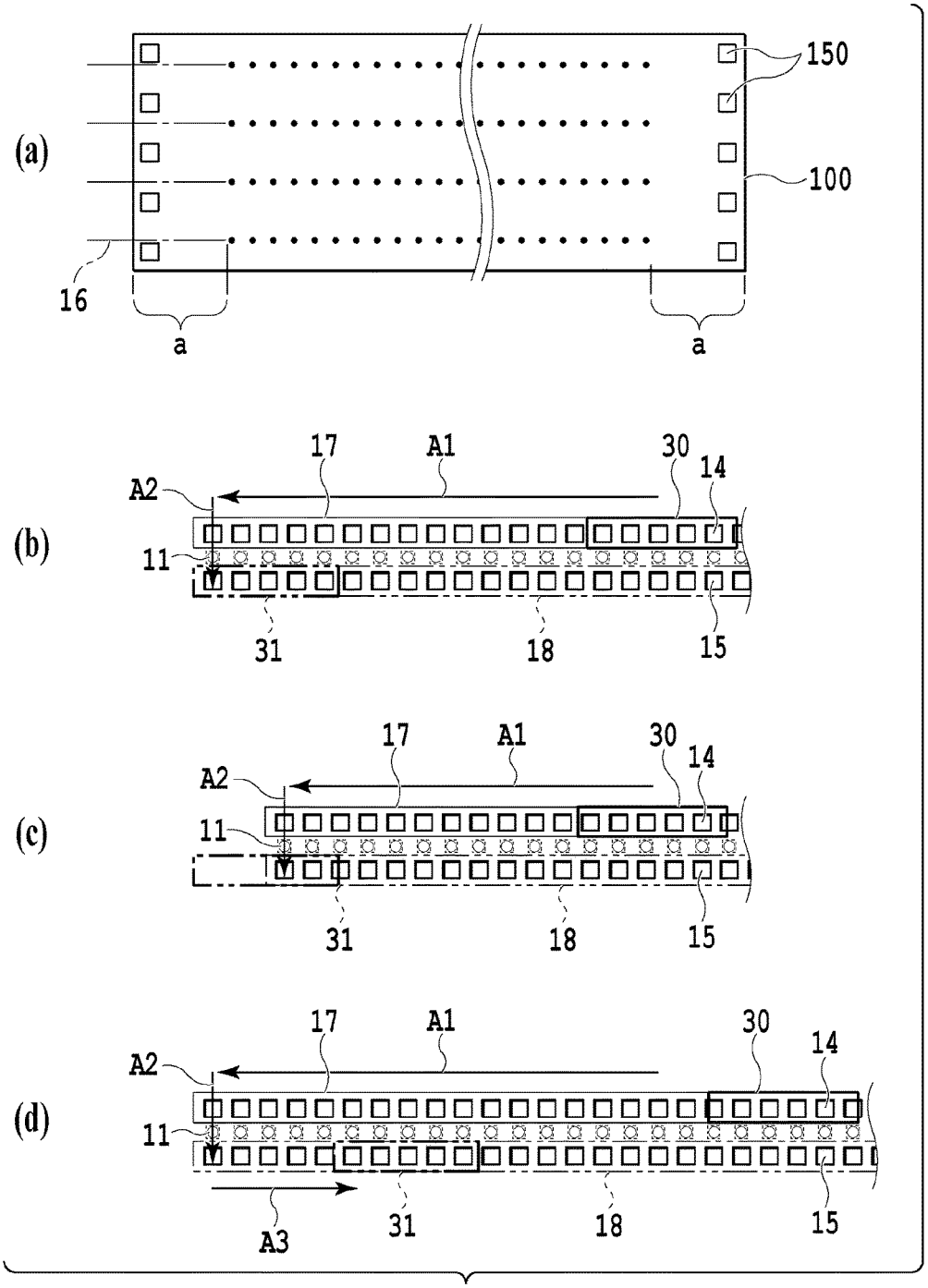
FIG. 7 is an explanatory diagram illustrating a main part of the liquid ejection substrate of FIG. 1.

That is, as illustrated in FIG. 7(*a*), an area "a" between the end of the ejection opening array 16 and the end of the liquid ejection substrate 100 is set to be large. For example, the area "a" can be used as an arrangement space for driving circuits of the ejection energy generation element 12 and a connection pad 150 transmitting and receiving electric signals to and from the liquid ejection substrate 100. Further, it is desirable to dispose the first collection opening 31 by using the area "a" as in the perspective views of a part (b) and (c) of FIG. 7 illustrating the liquid ejection substrate 100 when viewed from the ejection opening 11. That is, the first collection opening 31 is disposed so as to overlap the ejection opening 11 located at the end of the ejection opening array 16 in the first direction in which the ejection opening array 16 extends. In the part (b) of FIG. 7, the left end of the first common collection passage 18 and the left end of the first collection opening 31 are located at the same position. Further, in the part (c) of FIG. 7, the left ends of the first common collection passage 18 and the left ends of the first collection opening 31 are largely swollen leftward in relation to the collection passage 15 located at the left end.

In the parts (a) and (b) of FIG. 7, the ink which passes through the pressure chamber 13 located at the end of the ejection opening array 16 first flows from the first supply opening 30 into the first common supply passage 17 and the supply passage 14 as indicated by an arrow A1. Subsequently, the ink flows out from the first collection opening 31 after passing through the pressure chamber 13, the collection passage 15, and the first common collection passage 18 located at the end of the ejection opening array 16 as indicated by an arrow A2. The part (d) of FIG. 7 is a comparative example in a case where the first collection opening 31 is disposed not to overlap the ejection opening 11 located at the end of the ejection opening array 16 in the first direction. In the part (d) of FIG. 7, the ink which passes through the pressure chamber 13 located at the end of the ejection opening array 16 first flows from the first supply opening 30 into the first common supply passage 17 and the supply passage 14 as indicated by the arrow A1. Subsequently, the ink passes through the pressure chamber 13 and the collection passage 15 located at the end of the ejection opening array 16 as indicated by the arrow A2, and flows out from the first collection opening 31 after passing through the first common collection passage 18 as indicated by an arrow A3.

In the parts (b) and (c) of FIG. 7, the length of the ink passage of the ink flowing from the first supply opening 30 located at the end of the first direction and flowing out from the first collection opening 31 through the pressure chamber 13 can be shortened compared to the configuration of the part (d) of FIG. 7. That is, since the maximal pressure loss within the first common supply passage 17 and the first common collection passage 18 located in the vicinity of the end of the ejection opening array 16 decreases, a change in ink circulation flow amount inside each pressure chamber 13 can be suppressed. Additionally, in a case where the first supply opening 30 is located at the end of the first direction instead of the first collection opening 31, the first supply opening 30 may be disposed to overlap the ejection opening 11 located at the end of the ejection opening array 16 in the first direction.

(Temperature Distribution Suppressing Structure)

In the embodiment, a structure below is provided to suppress a temperature distribution within the printing head.

That is, as illustrated in FIGS. 1 and 2, the first collection opening 31 is disposed at both ends of the ejection opening array 16. In a case where the ink is forcedly circulated through each pressure chamber 13 as in this example, heat generated from the ejection energy generation element 12 and the like is collected by the ink. For this reason, the temperature of the ink inside the ink collection side passage is higher than that of each pressure chamber 13.

Further, even when a sufficient ink circulation flow amount is ensured in order to suppress an influence caused by the evaporation of moisture in the ink from the ejection opening 11, there is a case in which the ink ejection amount ejected simultaneously from the plurality of ejection openings 11 becomes larger than the ink circulation flow amount. In such a case, the ink is also supplied from the second common collection passage 37 into the pressure chamber 13. That is, the ink is supplied from the second common collection passage 37 into the pressure chamber 13 through the second collection opening 35, the second common collection passage 33, the first collection opening 31, the first common collection passage 18, and the collection passage 15. For that reason, there is a case in which the high-temperature ink inside the first collection opening 31 is supplied into the pressure chamber 13 when the ink is simultaneously ejected from the plurality of ejection openings 11. In such a case, since the temperature of the ink near the first collection opening 31 becomes higher than the temperature of the ink near the first supply opening 30, there is concern that a difference in ink ejection speed may occur between the ejection opening 11 near the first supply opening 30 and the ejection opening 11 near the first collection opening 31. Further, in a case where the first supply opening 30 is located at one end side of both ends of the ejection opening array 16 and the first collection opening 31 is located at the other end side thereof, an inclination of a temperature distribution in the arrangement direction of the ejection openings 11 occurs in the entire ejection opening array 16 and thus a temperature distribution width in the entire printing head increases. As a result, there is concern that a change in ink ejection characteristic may occur in each ejection opening 11.

In the embodiment, since the first collection opening 31 is disposed at both ends of the ejection opening array 16, such an inclination in temperature distribution is suppressed and thus a change in ink ejection characteristic can be suppressed. Additionally, the same effect can be obtained even when the first supply opening 30 is disposed at each of both ends of the ejection opening array 16. However, as in the embodiment, it is desirable to dispose the first collection opening 31 at each of both ends of the ejection opening array 16.

That is, in the liquid ejection substrate 100, as described above, the area "a" without being arranged with the ejection opening 11 is largely set between each of both ends of the ejection opening array 16 and the end of the liquid ejection substrate 100 and thus heat generated by the ink ejection operation is radiated from the area "a". For that reason, in a case where the plurality of ejection openings 11 eject the ink, there is a tendency that the temperature values of both ends of the ejection opening array 16 becomes lower than those of the other portions. Since the first collection opening 31 is disposed at each of both ends of the ejection opening array 16, the high-temperature ink can be supplied to both ends of the ejection opening array 16 in such a case. Thus, since the temperature values of both ends of the ejection opening array 16 are set to be higher, a temperature difference with respect to the other portions can be reduced. As a result, since the temperature distribution width in the entire printing head decreases, a change in ink ejection characteristic can be suppressed.

Figure 10:
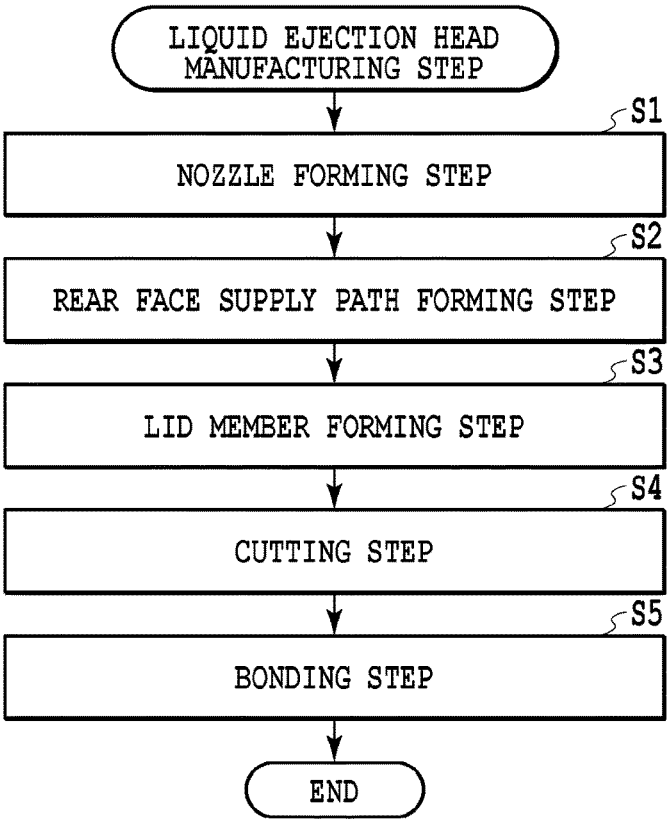
FIG. 10 is a flowchart illustrating a liquid ejection head manufacturing step.

FIG. 10 is a flowchart illustrating an example of a step of manufacturing the liquid ejection head of the embodiment.

First, nozzles are formed on the liquid ejection substrate 100 having the ejection energy generation element 12 and the necessary circuit formed thereon by a nozzle forming step S1. The nozzle is a portion that ejects the ink by using the ejection energy generation element 12 and includes the ejection opening 11 and the pressure chamber 13. Subsequently, the first common supply passage 17 and the first common collection passage 18 are formed on the rear face of the liquid ejection substrate 100 by a rear face supply path forming step S2. Next, the cover plate 20 (the lid member) or 2020 of the embodiment illustrated in FIG. 36C or 45C is formed on the rear face of the liquid ejection substrate 100 by a lid member forming step S3. Subsequently, the shape of the liquid ejection substrate 100 is processed from a wafer shape into a chip shape by a cutting step S4. Subsequently, the liquid ejection substrate 100 is bonded to the support member 400 and the first passage member 500 of the embodiments from FIGS. 24A to 24E by a bonding step S5.

In this way, since the cover plate serving as the third passage layer is formed on the rear face of the liquid ejection substrate 100 by the lid member forming step S3 before the bonding step S5, the first supply opening 30 and the first collection opening 31 can be formed in the wafer-shaped liquid ejection substrate 100. Since the cover plate is processed when the liquid ejection substrate 100 has a wafer shape, the processing accuracy is improved compared to machining or molding and thus microscopic holes can be formed with higher accuracy. Further, the cover plate can be formed to be thinner. Thus, the ejection openings 11 can be arranged with higher accuracy. Further, since the passage resistances of the first supply opening 30 and the first collection opening 31 are decreased with a small change in passage resistance, a differential pressure for generating the ink circulation flow can be stabilized and thus a change in circulation flow amount can be suppressed to be small.

The cover plate may be formed by a silicon substrate. That is, since the cover plate formed as the wafer-shaped silicon substrate is bonded to the wafer-shaped liquid ejection substrate 100, the number of steps can be decreased compared to a case where the cover plate is bonded to the chip-shaped liquid ejection substrate 100. Further, the cover plate may be formed of a resin film. As in the case of the silicon substrate, since the cover plate can be bonded in such a manner that a film-shaped resin is laminated on the wafer-shaped liquid ejection substrate 100, the number of steps can be decreased compared to a case where the cover plate is bonded to each chip-shaped liquid ejection substrate 100.

The sequence and the content of the steps of FIG. 10 are merely examples and do not limit the present invention. For example, the sequences of the nozzle forming step S1, the rear face supply path forming step S2, the lid member forming step S3, and the cutting step S4 are not limited to the examples of FIG. 10 as long as the lid member forming step S3 can be performed before the bonding step S5.

Second Embodiment

Figure 11:
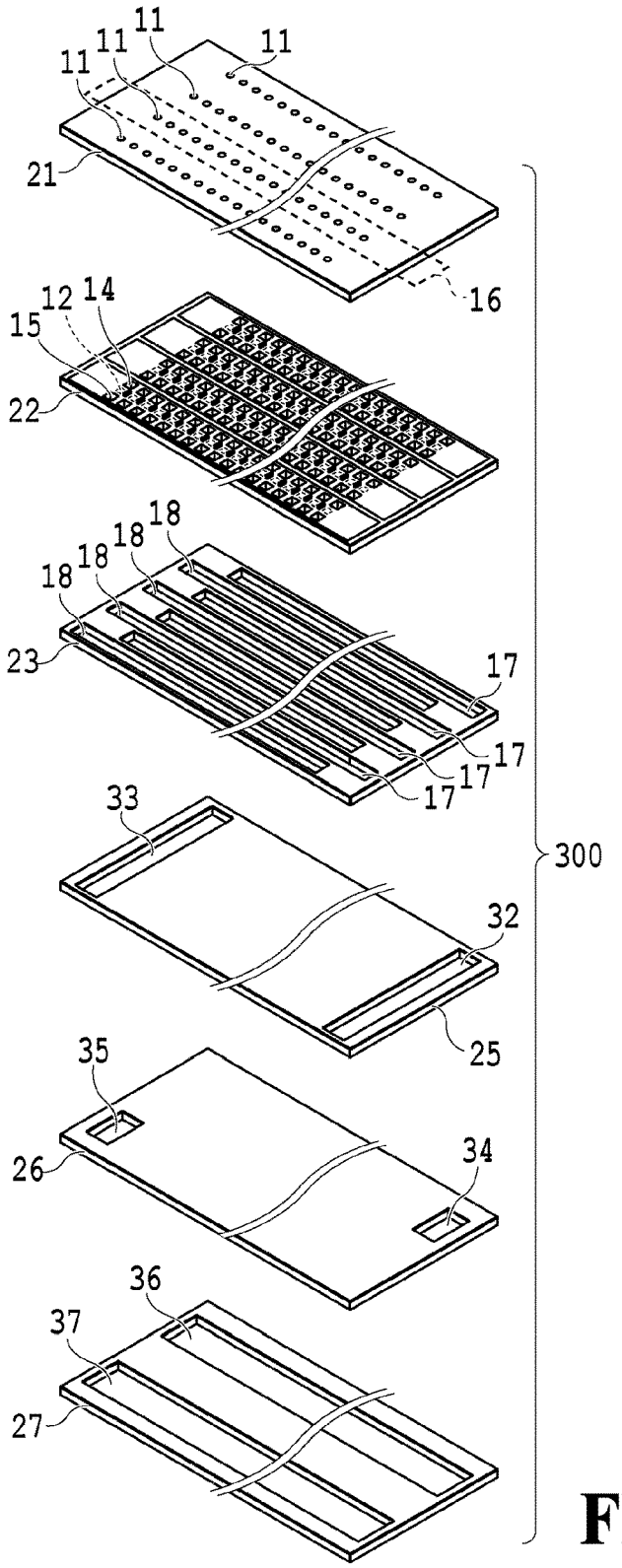
FIG. 11 is an exploded perspective view illustrating a liquid ejection substrate according to a second embodiment of the present invention.
Figure 12:
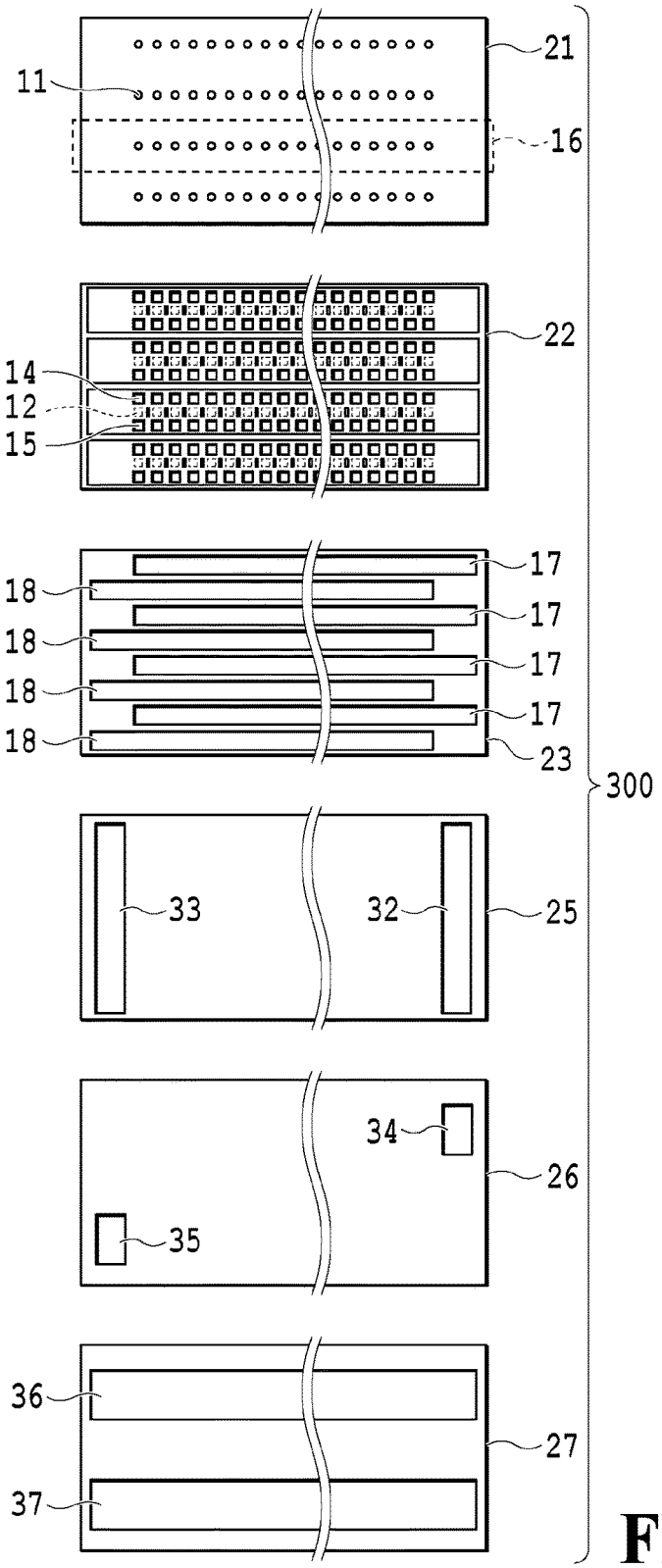
FIG. 12 is an exploded top view illustrating the liquid ejection substrate of FIG. 11.

FIGS. 11 and 12 are explanatory diagrams illustrating the liquid ejection unit 300 according to a second embodiment of the present invention and the same description as that of the above-described embodiment will be omitted while the same reference numerals are given thereto. FIG. 11 is an exploded perspective view illustrating the liquid ejection unit 300 and FIG. 12 is an exploded top view illustrating the liquid ejection unit 300.

In the embodiment, the first common supply passage 17 and the second common supply passage 32 communicate with each other at one end side of the ejection opening array 16 and the first common collection passage 18 and the second common collection passage 33 communicate with each other at the other end side thereof. In the embodiment, since the third passage layer 24 of the first embodiment is not provided and the first supply opening 30 and the first collection opening 31 of the first embodiment can be omitted, the structure of the passage can be simplified.

Third Embodiment

Figure 13:
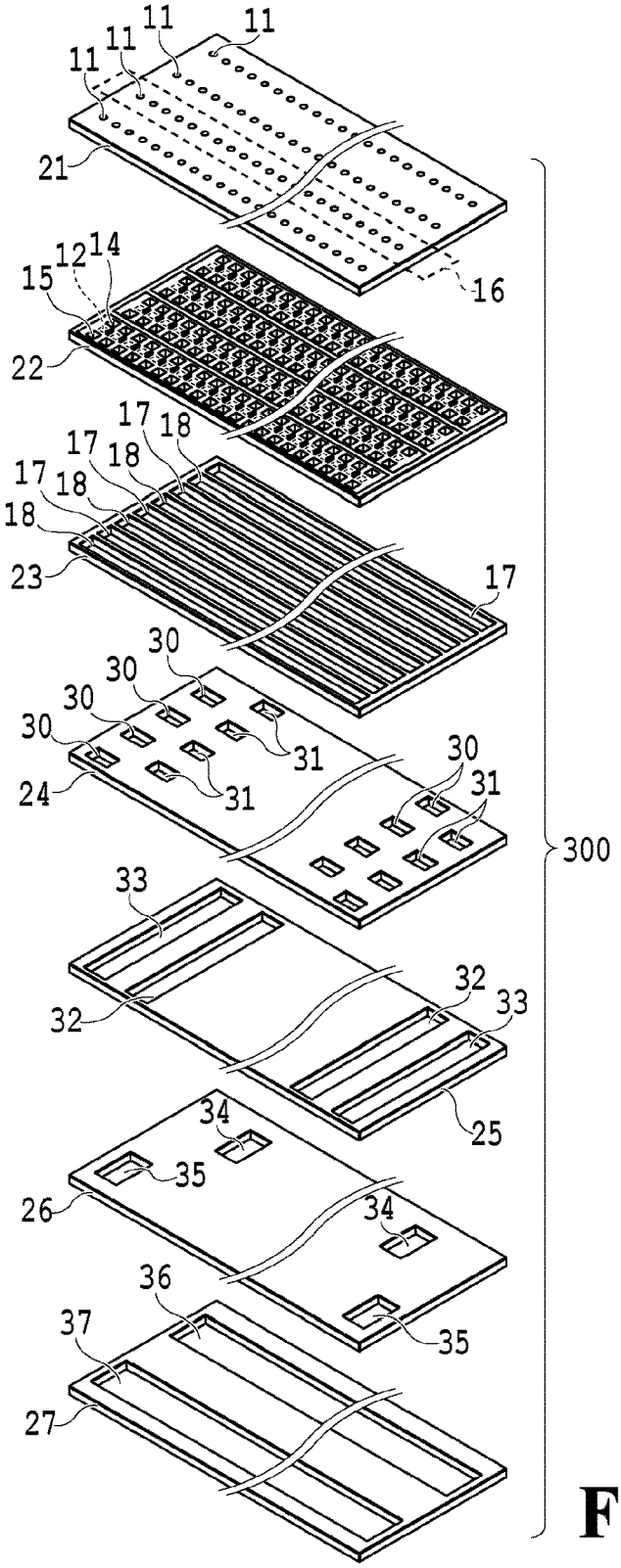
FIG. 13 is an exploded perspective view illustrating a liquid ejection substrate according to a third embodiment of the present invention.
Figure 14:
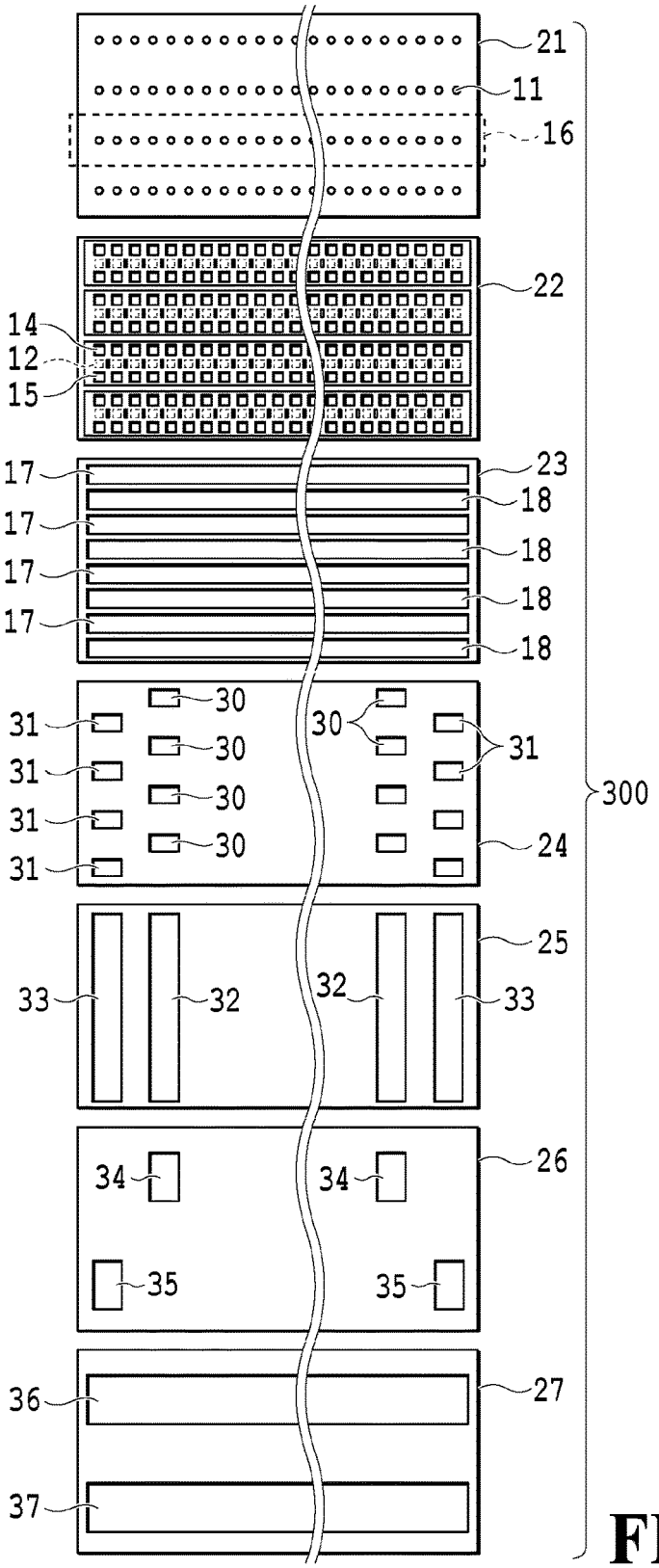
FIG. 14 is an exploded top view illustrating the liquid ejection substrate of FIG. 13.

FIGS. 13 and 14 are explanatory diagrams illustrating the liquid ejection unit 300 according to a third embodiment of the present invention and the same description as that of the above-described embodiment will be omitted while the same reference numerals are given thereto. FIG. 13 is an exploded perspective view illustrating the liquid ejection unit 300 and FIG. 14 is an exploded top view illustrating the liquid ejection unit 300.

In the embodiment, at one end side of the ejection opening array 16, the first common supply passage 17 and the first supply opening 30 communicate with each other and the first common collection passage 18 and the first collection opening 31 communicate with each other. Similarly, at the other end side of the ejection opening array 16, the first common supply passage 17 and the first supply opening 30 communicate with each other and the first common collection passage 18 and the first collection opening 31 communicate with each other even. When the first supply opening 30 and the first collection opening 31 are disposed at both ends of the ejection opening array 16, it is possible to suppress a change in pressure inside each pressure chamber 13 and a change in ink circulation flow amount in the first direction in which the ejection opening array 16 extends compared to the second embodiment. Further, each of the second common supply passage 32 and the second common collection passage 33 may be disposed at two positions.

In this way, in the embodiment, since the number of the first supply openings 30 and the second collection openings 31 decreases, the structure of the ink passage can be simplified.

Fourth Embodiment

Figure 15:
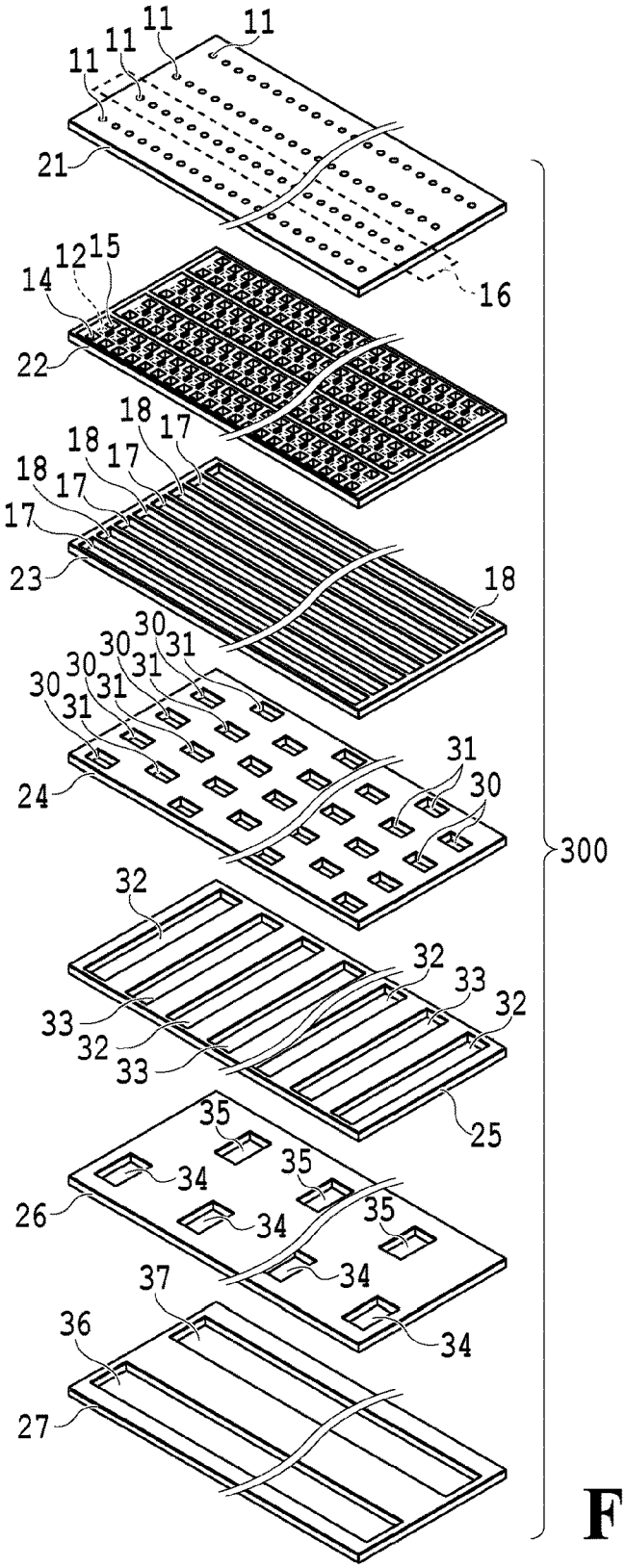
FIG. 15 is an exploded perspective view illustrating a liquid ejection substrate according to a fourth embodiment of the present invention.
Figure 16:
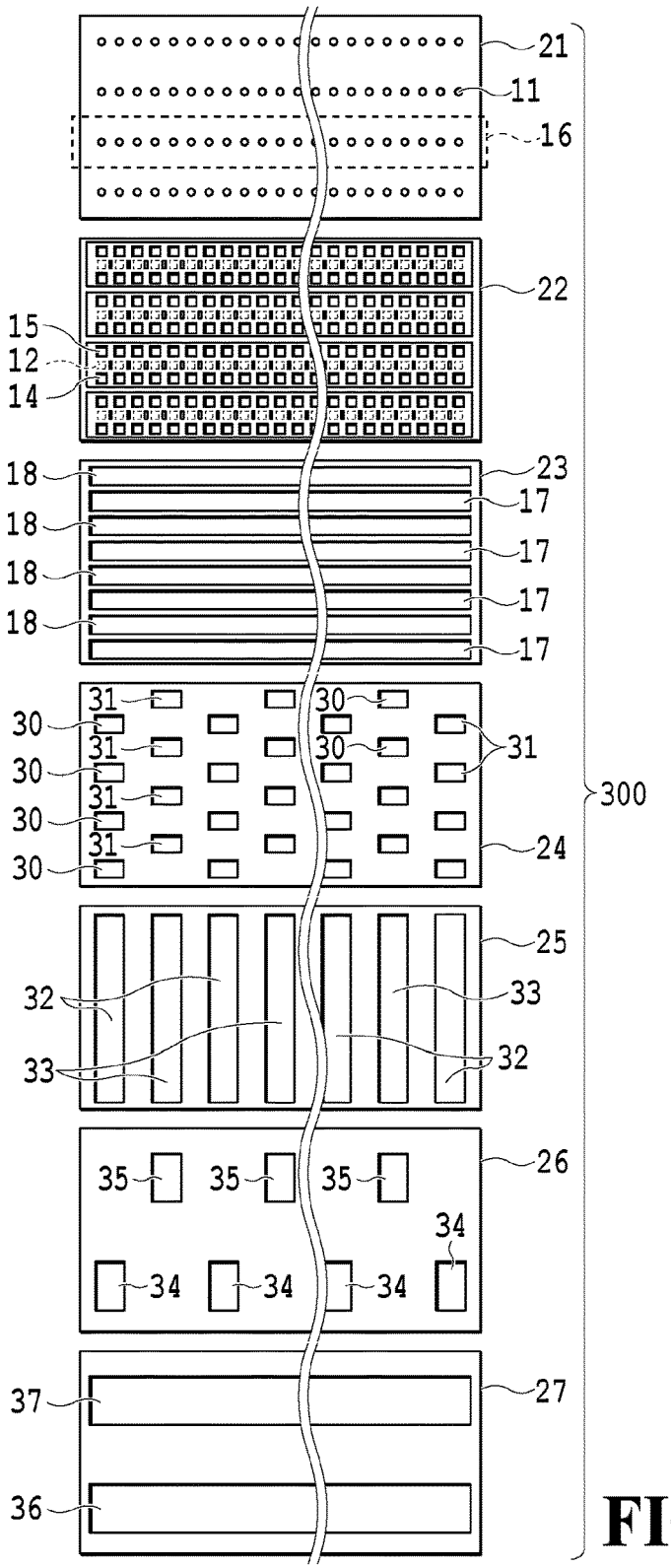
FIG. 16 is an exploded top view illustrating the liquid ejection substrate of FIG. 15.

FIGS. 15 to 18B are explanatory diagrams illustrating the liquid ejection unit 300 according to a fourth embodiment of the present invention and the same description as that of the above-described embodiment will be omitted while the same reference numerals are given thereto. FIG. 15 is an exploded perspective view illustrating the liquid ejection unit 300 and FIG. 16 is an exploded top view illustrating the liquid ejection unit 300. In the embodiment, the plane shape of the liquid ejection unit 300 is formed in a parallelogram shape (parallelogram with no right-angled adjacent sides), but in order to simplify the description, the plane shape is depicted as a rectangular shape. FIG. 17A is a top view illustrating the liquid ejection substrate 100 according to the embodiment and FIG. 17B is a perspective view illustrating a structure of an end of the ejection opening array 16.

Figure 17A:
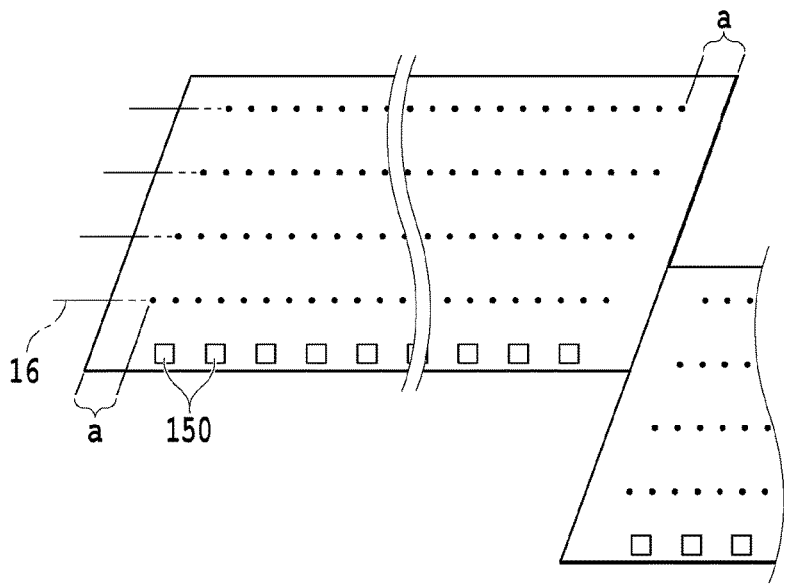
FIG. 17A is a top view illustrating a main part of the liquid ejection substrate of FIG. 15.

As illustrated in FIG. 17A, the plane shape of the liquid ejection substrate 100 of the embodiment is formed in a parallelogram shape and the area "a" between the end of the ejection opening array 16 and the end of the element substrate is smaller than that of the liquid ejection substrate 100 of the part (a) of FIG. 7 of the first embodiment. In the embodiment, the connection pad 150 for transmitting and receiving electric signals between the liquid ejection substrate 100 and the outside, and the driving circuits of for the ejection energy generation element 12 and the like are disposed on the long side of the liquid ejection substrate 100 as illustrated in FIG. 17A. In a case where an elongated printing head (line head) is obtained by the combination of the liquid ejection substrates 100, the liquid ejection substrates 100 can be arranged in a substantially one array shape as illustrated in FIG. 17A instead of a zigzag shape. By such an arrangement, the ends of the ejection opening arrays 16 of the adjacent liquid ejection substrates 100 can easily overlap each other in the second direction as illustrated in FIG. 17A. Here, the "arrangement in the substantial one array shape" indicates a state where the adjacent liquid ejection substrates 100 partially overlap each other in both the first direction and the second direction.

Figure 17B:
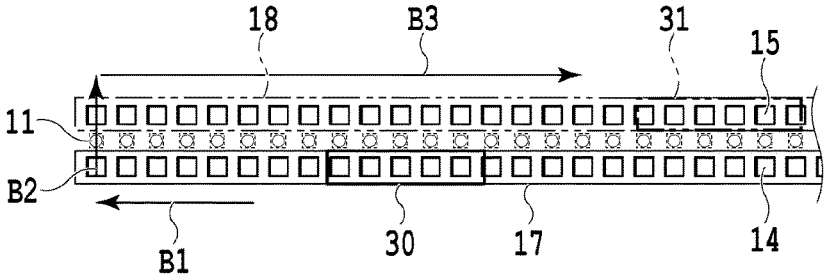
FIG. 17B is an explanatory diagram illustrating an end of an ejection array of FIG. 17A.

In this way, in the embodiment, the ejection openings 11 are disposed to the vicinity of the end of the liquid ejection substrate 100. In such an embodiment, it is difficult to dispose the first supply opening 30 or the first collection opening 31 at a position overlapping the end of the ejection opening array 16 of the liquid ejection substrate 100 as illustrated in the parts (b) and (c) of FIG. 7 of the first embodiment. Thus, in the embodiment, the first supply openings 30 or the first collection openings 31 are disposed at a position displaced toward the center in relation to the end of the ejection opening array 16 as illustrated in FIG. 17B.

In the embodiment, in order to suppress a change in ink circulation flow amount and a change in pressure of each pressure chamber 13 and to suppress a temperature distribution inside the liquid ejection substrate 100, the first supply opening 30 is disposed near each of both ends of the ejection opening array 16 as illustrated in FIGS. 15 and 16.

As in the embodiment, in a case where the first supply opening 30 is disposed near the end of the ejection opening array 16, a differential pressure between the first common supply passage 17 and the first common collection passage 18 located at the end of the ejection opening array 16 is large during the ink ejection operation compared to the ink circulation operation using an initial differential pressure. Meanwhile, in a case where the first collection opening 31 is disposed at the end of the ejection opening array 16 as in the first embodiment, the differential pressure between the first common supply passage 17 and the first common collection passage 18 at the end of the ejection opening array 16 is small during the ink ejection operation compared to the ink circulation operation using an initial differential pressure. When the differential pressure between the first common supply passage 17 and the first common collection passage 18 decreases, the ink circulation flow amount decreases. Accordingly, an effect of suppressing an influence caused by the evaporation of moisture in the ink from the ejection opening 11 decreases. That is, an effect of suppressing a decrease in ink ejection speed and a change in color concentration of the ink decreases. For that reason, the differential pressure is preferably set to be large. As in the embodiment, since the first supply opening 30 is disposed near both ends of the ejection opening array 16, an influence of a change in ink circulation flow amount can be reduced.

Since the pressure inside the first supply opening 30 is set to be higher than the pressure inside the first collection opening 31 in order to generate the ink circulation flow, the ink is easily supplied into the pressure chamber 13 through the first supply opening 30 during the ink ejection operation. In this way, since the first supply opening 30 easily supplying the ink is disposed near the end of the ejection opening array 16, it is possible to reduce the pressure loss generated between the first common supply passage 17 and the first common collection passage 18 when the ink is simultaneously ejected from the plurality of ejection openings 11.

Further, in the embodiment, as described above, since the area "a" between the end of the ejection opening array 16 and the end of the element substrate is small, a degree in which heat generated by the ink ejection operation is radiated from the area "a" is small. Since the area "a" is small, a portion of the first common supply passage 17 from the first supply opening 30 to the end of the ejection opening array 16 increases in length as illustrated in FIG. 17B. Similarly, a portion of the first common collection passage 18 from the first collection opening 31 to the end of the ejection opening array 16 increases in length. Thus, the ink passing through the portions of the first common supply passage 17 and the first common collection passage 18 easily receive heat from the liquid ejection substrate 100. For that reason, when the ink is simultaneously ejected from the plurality of ejection openings 11, there is a tendency that the temperature of the end of the ejection opening array 16 becomes higher than those of the other portions. Further, the pressure loss generated in each ink passage increases during the ink ejection operation and thus the pressure at the end of the ejection opening array 16 becomes uneven.

However, in the embodiment, as described above, since the first supply opening 30 is disposed at each of both ends of the ejection opening array 16, a large amount of the ink is supplied to the ejection opening 11 near the end of the ejection opening array 16 from the first supply opening 30 disposed in the vicinity thereof. As a result, when the ink is simultaneously ejected from the plurality of ejection openings 11, the amount of the high-temperature ink supplied from the first supply opening 30 decreases and thus an increase in temperature of the end of the ejection opening array 16 can be decreased.

Specifically, the ink supplied from the first supply opening 30 first flows from the first common supply passage 17 into the supply passage 14 as indicated by an arrow B1 of FIG. 17B. Subsequently, the ink passes through the pressure chamber 13 and the collection passage 15 located at the end of the ejection opening array 16 as indicated by an arrow B2 and flows out from the first collection opening 31 through the first common collection passage 18 as indicated by the arrow B3.

Figure 18A:
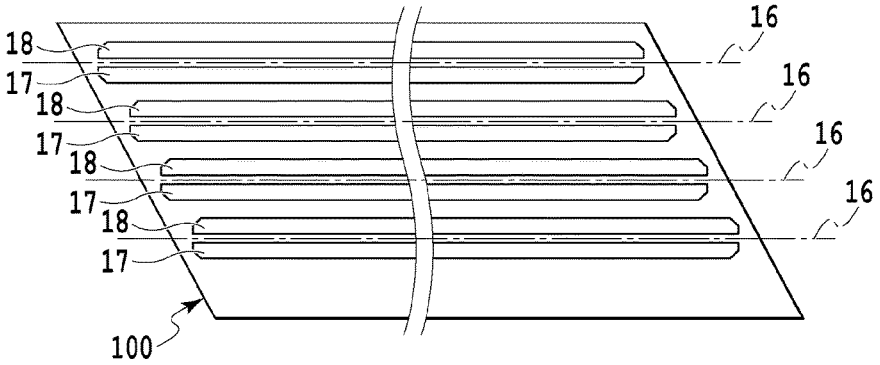
FIG. 18A is an explanatory diagram illustrating shapes of a first common supply passage and a first common collection passage.
Figure 18B:
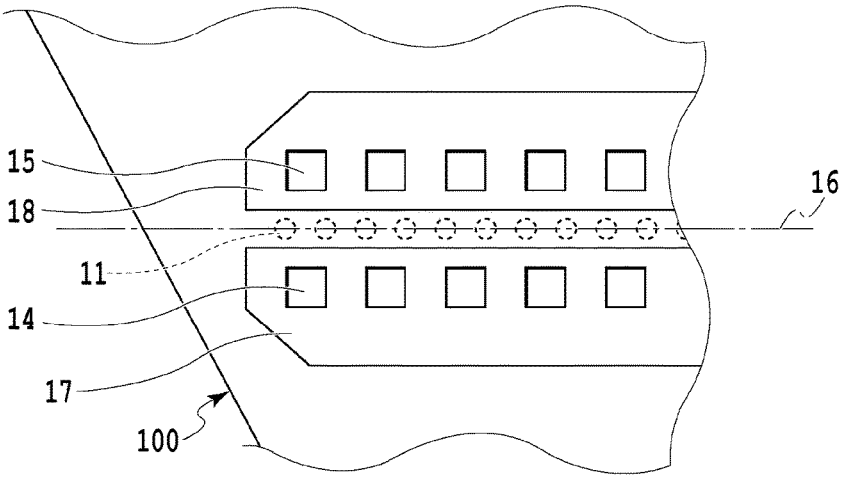
FIG. 18B is an explanatory diagram illustrating ends of the first common supply passage and the first common collection passage of FIG. 18A.

In this way, in the embodiment, since the first supply opening 30 is disposed at each of both ends of the ejection opening array 16, a change in ink circulation flow amount and pressure can be suppressed and a temperature distribution inside the printing head can be suppressed to be small. Thus, it is possible to print a high-quality image with higher accuracy by suppressing a decrease in ink ejection speed, a change in ink color concentration, and a change in ejection characteristic caused by the evaporation of moisture in the ink from the ejection opening 11. Further, it is desirable that the first common supply passage 17 and the first common collection passage 18 of the embodiment have the shape illustrated in FIG. 18B. FIG. 18A is a diagram illustrating the liquid ejection substrate 100 when viewed from the rear face side thereof and FIG. 18B is an enlarged view illustrating the ends of the first common supply passage 17 and the first common collection passage 18 in the longitudinal direction of FIG. 18A. Both ends of the first common supply passage 17 and the first common collection passage 18 communicating with the same ejection opening array 16 in the longitudinal direction are provided at the same position illustrated in FIG. 18B. Further, as illustrated in FIG. 18A, in two ejection opening arrays 16 provided in parallel to be adjacent to each other, the first common supply passage 17 and the first common collection passage 18 at one side of the adjacent ejection opening arrays 16 and the first common supply passage 17 and the first common collection passage at the other side of the adjacent ejection opening arrays 16 have a positional relation as below. That is, both ends of the first common supply passage 17 and the first common collection passage 18 communicating with one side of the adjacent ejection opening arrays 16 in the longitudinal direction and both ends of the first common supply passage 17 and the first common collection passage 18 communicating with the other side thereof in the longitudinal direction are deviated obliquely.

By the passages 17 and 18 having such a shape, the width between each of the ends of the passages 17 and and the end of the liquid ejection substrate 100 is widened to ensure the strength of the liquid ejection substrate 100 while the ink is reliably supplied to the ejection openings 11 located at both ends of the ejection opening array 16. More specifically, as illustrated in FIG. 18A, a distance between the right end of the passage 17 and the right end of the liquid ejection substrate 100 can be set to be long and a distance between the left end of the passage 18 and the left end of the liquid ejection substrate 100 can be set to long. Further, as illustrated in FIG. 18B, both ends of the first common supply passage 17 and the first common collection passage 18 in the longitudinal direction are formed in a shape in which a corner is removed. In the case of this example, a chamfered shape is illustrated, but a round shape may be used. With such a shape, it is possible to suppress a possibility in which stress concentrates on both ends of the first common supply passage 17 and the first common collection passage 18 when an external force or strain is caused by heat and thus to suppress damage of the liquid ejection substrate 100 caused by a crack or the like.

Fifth Embodiment

Figure 19:
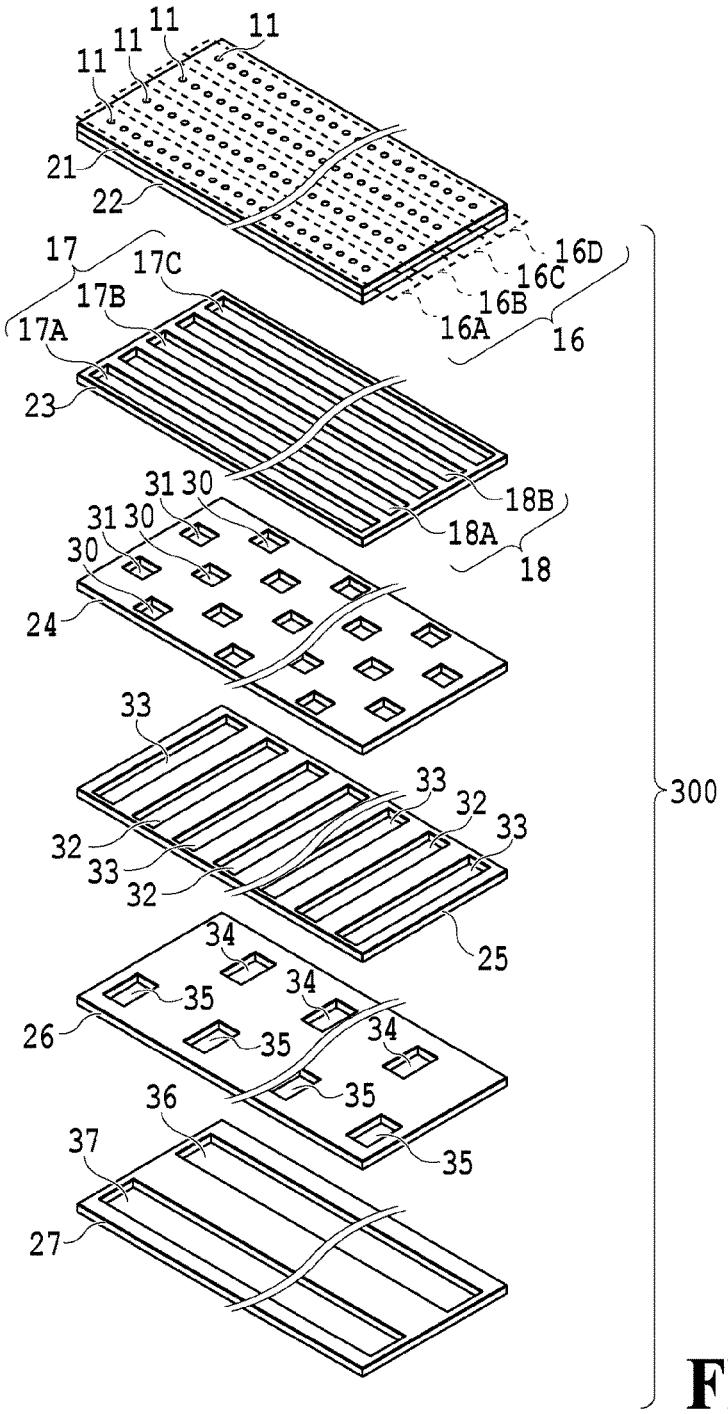
FIG. 19 is an exploded perspective view illustrating a liquid ejection substrate according to a fifth embodiment of the present invention.
Figure 20:
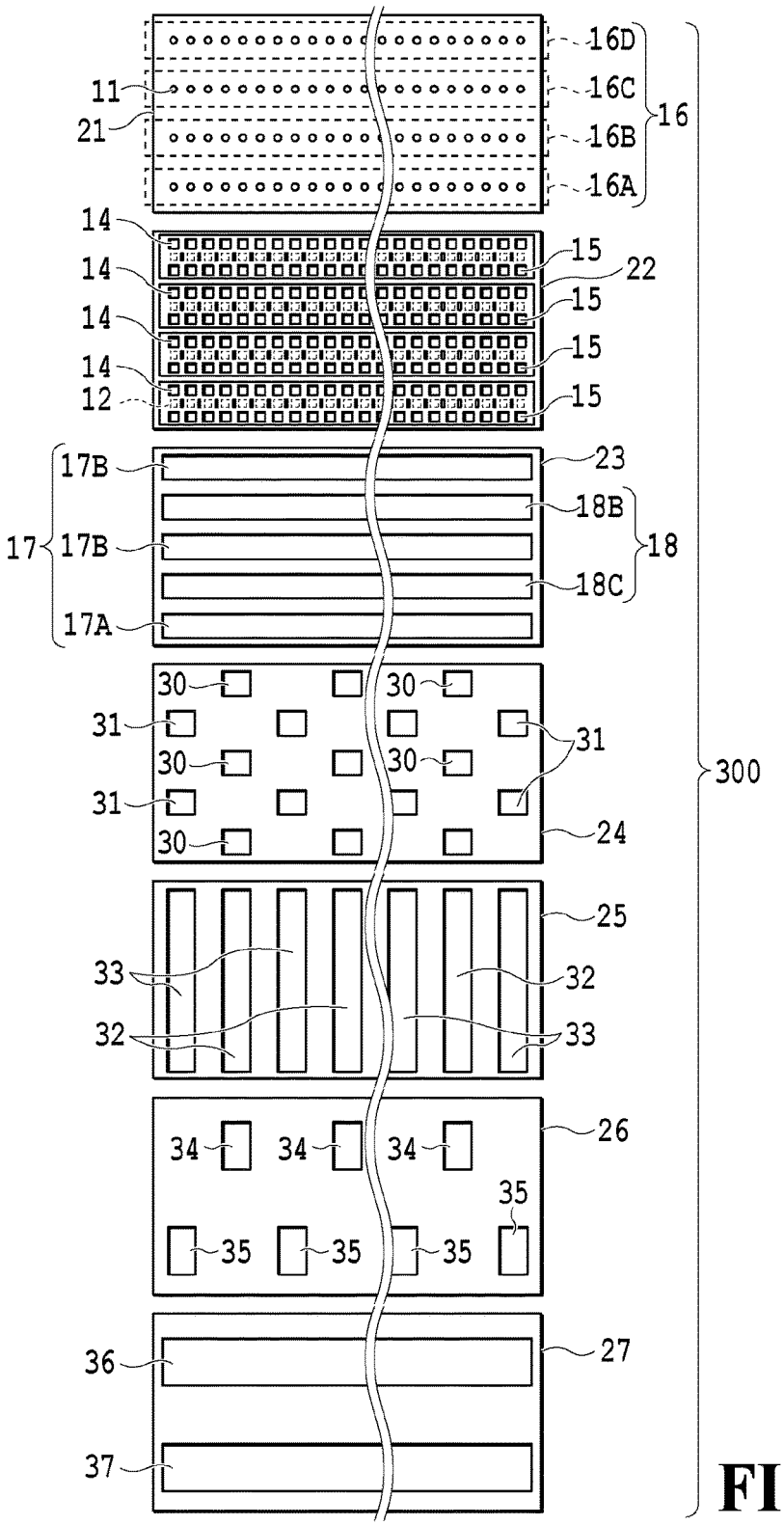
FIG. 20 is an exploded top view illustrating the liquid ejection substrate of FIG. 19.

FIGS. 19 and 20 are explanatory diagrams illustrating the liquid ejection unit 300 according to a fifth embodiment of the present invention and the same description as that of the above-described embodiment will be omitted while the same reference numerals are given thereto. FIG. 19 is an exploded perspective view illustrating the liquid ejection unit 300 and FIG. 20 is an exploded top view illustrating the liquid ejection unit 300.

In the example, as illustrated in FIG. 19, three first common supply passages 17 (17A, 17B, and 17C) and two first common collection passages 18 (18A and 18B) are disposed with respect to four ejection opening arrays 16 (16A, 16B, 16C, and 16D). As illustrated in FIG. 20, between the ejection opening arrays 16A and 16B, the collection passage 15 common to these arrays 16A and 16B is disposed, and the collection passage 15 communicates with the first common collection passage 18A. Further, between the ejection opening arrays 16B and 16C, the supply passage 14 common to these arrays 16B and 16C is disposed, and the supply passage 14 communicates with the first common supply passage 17A. Further, between the ejection opening arrays 16C and 16D, the collection passage 15 common to these arrays 16C and 16D is disposed, and the collection passage 15 communicates with the first common collection passage 18B. The supply passage 14 of the ejection opening array 16A communicates with the first common supply passage 17A, and the supply passage 14 of the ejection opening array 16D communicates with the first common supply passage 17C.

In this way, one first common supply passage 17B communicates with the pressure chambers 13 of the ejection opening arrays 16B and 16C through the supply passage 14 common to these arrays 16B and 16C. Further, one first common collection passage 18A communicates with the pressure chambers 13 of the ejection opening arrays 16A and 16B through the collection passage 15 common to these arrays 16A and 16B. Similarly, one first common collection passage 18B communicates with the pressure chambers 13 of the ejection opening arrays 16C and 16D through the collection passage 15 common to these arrays 16C and 16D.

According to the embodiment, the following effect can be obtained in addition to the effect of the above-described embodiment.

That is, since two adjacent ejection opening arrays share the first common supply passage 17 and the first common collection passage 18, the number of the partition walls between the ink passages and the number of the ink passages can be reduced. Thus, the gap between the ejection opening arrays 16 can be narrowed and the width of the ink passage can be increased. As a result, a change in ink circulation flow amount and a change in pressure of each pressure chamber 13 are further suppressed. Then, the ejection opening arrays 16 are further densely arranged compared to the above-described embodiment so that the substrate and the printing head can be decreased in size. Further, in a case where the arrangement density of the ejection opening arrays 16 is the same, a change in ink circulation flow amount and a change in pressure of each pressure chamber 13 are further suppressed, and furthermore the number of the first supply openings 30 and the first collection openings 31 can be decreased. Therefore the structure of the ink passage of the substrate can be simplified.

Sixth Embodiment

Figure 21:
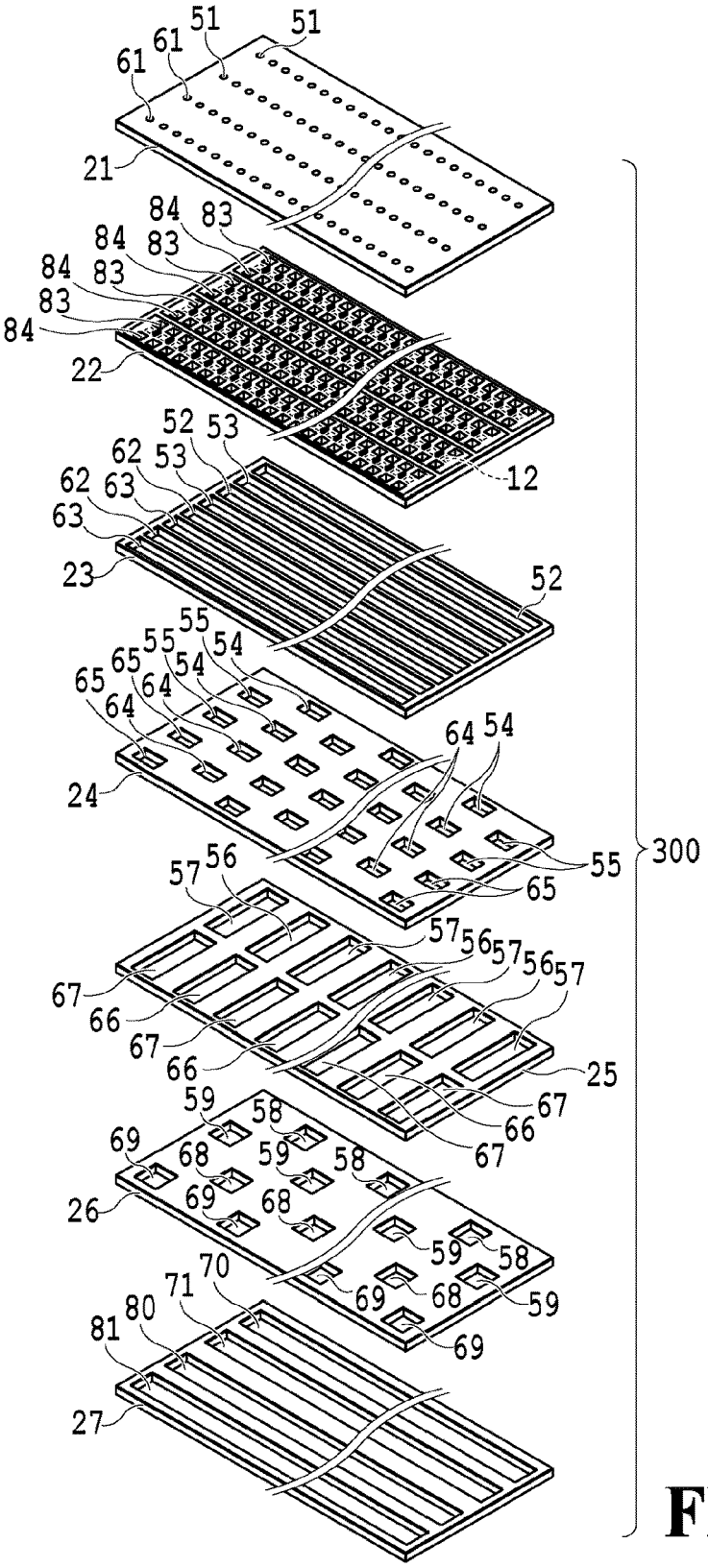
FIG. 21 is an exploded perspective view illustrating a liquid ejection substrate according to a sixth embodiment of the present invention.
Figure 22:
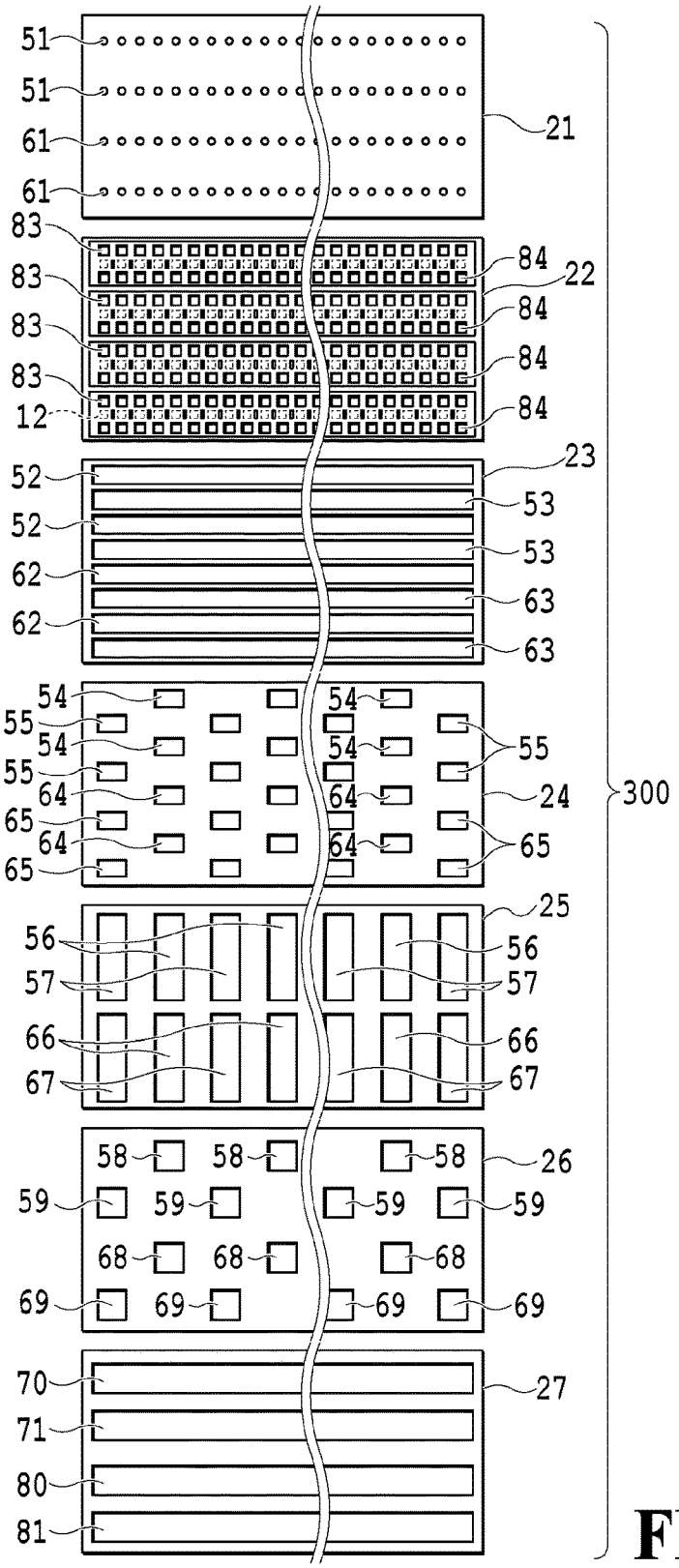
FIG. 22 is an exploded top view illustrating the liquid ejection substrate of FIG. 21.
Figure 23:
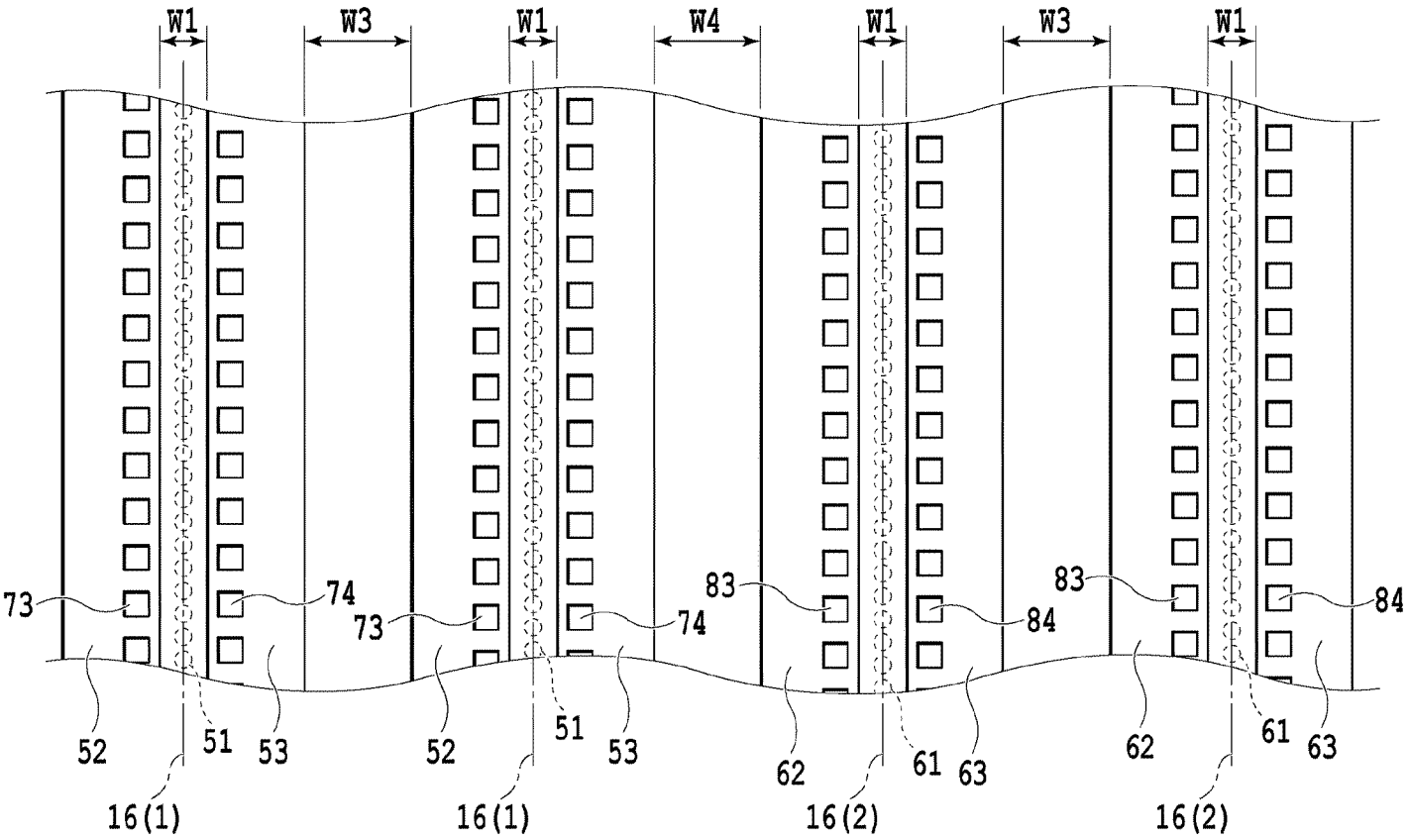
FIG. 23 is an explanatory diagram illustrating an arrangement relation between a first ink passage and a second ink passage.

FIGS. 21 to 23 are explanatory diagrams illustrating the liquid ejection unit 300 according to a sixth embodiment of the present invention and the same description as that of the above-described embodiment will be omitted while the same reference numerals are given thereto. FIG. 21 is an exploded perspective view illustrating the liquid ejection unit 300 and FIG. 22 is an exploded top view illustrating the liquid ejection unit 300.

In the embodiment, an ejection opening array having ejection openings 51 for first ink and an ejection opening array having ejection openings 61 for second ink are formed in order to eject different colors of inks or a plurality of kinds of inks into one substrate. The second passage layer 23 is provided with a first common supply passage 52 for the first ink, a first common supply passage 62 for the second ink, a first common collection passage 53 for the first ink, and a first common collection passage 63 for the second ink. The third passage layer 24 is provided with a supply opening 54 for the first ink, a supply opening 64 for the second ink, a collection opening 55 for the first ink, and a collection opening 65 for the second ink. The fourth passage layer 25 is provided with a second common supply passage 56 for the first ink, a second common supply passage 66 for the second ink, a third common collection passage 57 for the first ink, and a third common collection passage 67 for the second ink. The fifth passage layer 26 is provided with a second supply opening 58 for the first ink, a second supply opening 68 for the second ink, a second collection opening 59 for the first ink, and a second collection opening 69 for the second ink. The sixth passage layer 27 is provided with a third common supply passage 70 for the first ink, a third common supply passage 80 for the second ink, a third common collection passage 71 for the first ink, and a third common collection passage 81 for the second ink.

Similarly to the first embodiment, the first and second inks are respectively supplied from the third common supply passages 70 and 80, pass through the corresponding pressure chambers 13, and then flow out from the third common collection passages 71 and 81.

Similarly to the fifth embodiment, one first common supply passage may commonly communicate with the pressure chambers of two ejection opening arrays. Similarly, one first common collection passage may commonly communicate with the pressure chambers of two ejection opening arrays. Further, the width of the sixth passage layer 27 in the second direction may be set to be larger than the width of the first passage layer 22 in the second direction.

In this way, even in the printing head for a plurality of colors of inks or a plurality of kinds of inks, a change in ink circulation amount and a change in pressure of each pressure chamber can be suppressed while the widths of the first common supply passage and the first common collection passage are not widened. Thus, it is possible to print a high-quality image with higher accuracy by suppressing a decrease in ink ejection speed and a change in ink color concentration caused by the evaporation of moisture in the ink from the ejection opening.

(Arrangement Relation Between Passages 52 and 53 and Passages 62 and 63)

It is desirable to set an arrangement relation between the first common supply passage 52 and the first common collection passage 53 for the first ink and the first common supply passage 62 and the first common collection passage 63 for the second ink as below.

That is, as illustrated in FIG. 23, a beam width W4 between the first common collection passage 53 and the first common supply passage 62 between an ejection opening array 16(1) for the first ink and an ejection opening array 16(2) for the second ink is set to be larger than the beam width W1. When the beam width W4 is set to be large, a leakage of the ink between the first common collection passage 53 and the first common supply passage 62 can be suppressed so that the colors of the ink are not mixed with each other. The beam width W3 and the beam width W4 may be equal or different from each other. Particularly in a case where the beam width W3 between the passages for the same ink is set to be smaller than the beam width W4 between the passages for the different inks, the pressure loss of the passage for the flow of the ink is reduced and thus the ink ejection characteristics can be improved. In this way, since the reverse flow of the ink circulation flow is suppressed, it is possible to suppress the colors of the inks from being mixed with each other while keeping the pressure inside the first common supply passage 17 at the negative pressure.

(Configuration Examples of Liquid Ejection Head)

FIGS. 24A to 24E are perspective views illustrating configuration examples having different inkjet printing heads serving as the liquid ejection head of the present invention.

Figure 24A:
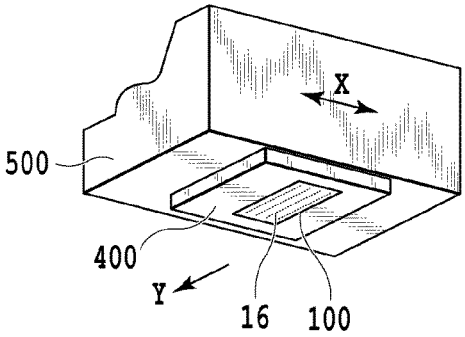
FIGS. 24A, 24B, 24C, 24D, and 24E are perspective views respectively illustrating configuration examples having different liquid ejection heads employing the liquid ejection substrate of the present invention.

A printing head of FIG. 24A includes one liquid ejection substrate 100 and the support member 400 and the liquid ejection substrate 100 are sequentially disposed on the first passage member 500. The printing head is used in a so-called serial scan type inkjet printing apparatus. The printing apparatus prints an image on a print medium by repeating a printing operation of ejecting the ink from the ejection opening while moving the printing head in a main scan direction indicated by an arrow X and a conveying operation of conveying the print medium in a sub-scan direction indicated by an arrow Y intersecting (in this example, orthogonal to) the main scan direction. The main scan direction is a direction intersecting (in this example, orthogonal to) the first direction in which the ejection opening array 16 extends.

Figure 24C:
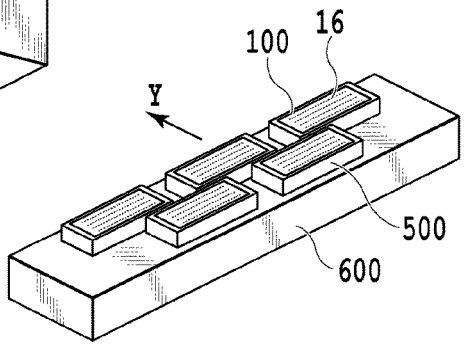
Figure 24B:
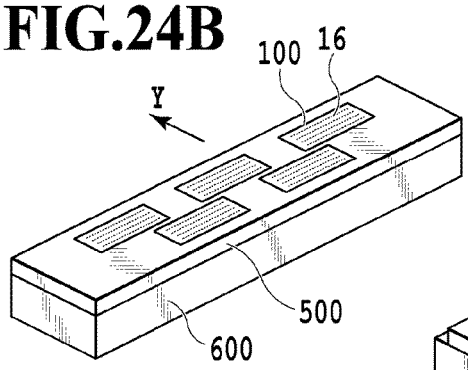

Printing heads of FIGS. 24B and 24C are elongated line heads in which the plurality of liquid ejection substrates 100 are disposed in a zigzag shape. In the configuration of FIG. 24B, the first passage member 500 is commonly disposed to the plurality of liquid ejection substrates 100. In the configuration of FIG. 24C, the first passage member 500 is individually disposed to each of the liquid ejection substrates 100. The first passage member 500 is disposed on the second passage member 600. Such printing heads are used in a so-called full line type inkjet printing apparatus. The printing apparatus continuously prints an image on the print medium by ejecting the ink from the printing head at a fixed position while continuously conveying the print medium in a direction indicated by the arrow Y intersecting (in this example, orthogonal to) the first direction in which the ejection opening array 16 extends.

Figure 24D:
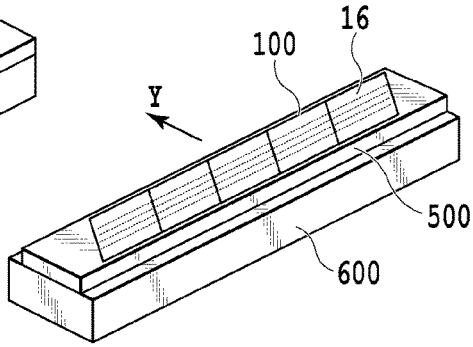
Figure 24E:
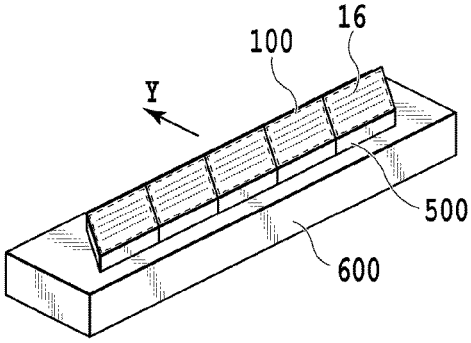

Printing heads of FIGS. 24D and 24E are elongated line heads in which the liquid ejection substrate 100 is disposed in a one array shape and is used in a so-called full line type inkjet printing apparatus. In the configuration of FIG. 24D, the first passage member 500 is commonly disposed to the plurality of liquid ejection substrates 100. In the configuration of FIG. 24E, the first passage member 500 is individually disposed to each of the liquid ejection substrates 100. The first passage member 500 is disposed on the second passage member 600. It is desirable to form the liquid ejection substrate 100 of such a printing head into a shape of the fourth embodiment.

In such various printing heads, by generating the ink circulation flow as described above, a high-quality image can be printed with high accuracy while a decrease in ink ejection speed and a change in ink color concentration caused by the evaporation of moisture in the ink from the ejection opening are suppressed.

(Configuration Examples of Liquid Ejection Apparatus)

Figure 25A:
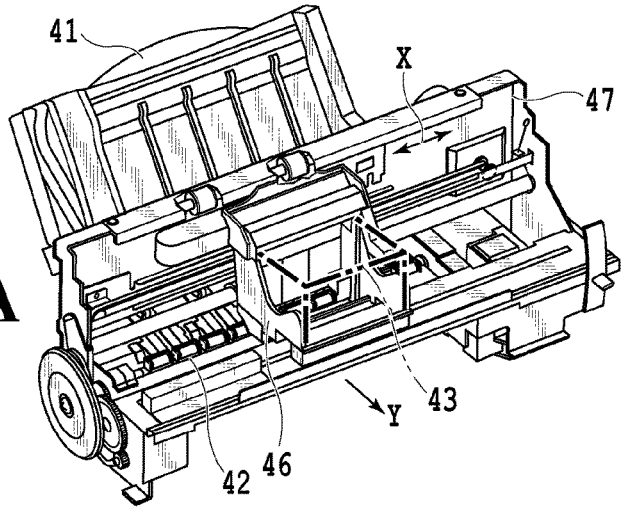
FIGS. 25A and 25B are schematic perspective views respectively illustrating configuration examples having different inkjet printing apparatuses employing the liquid ejection head of the present invention.
Figure 25B:
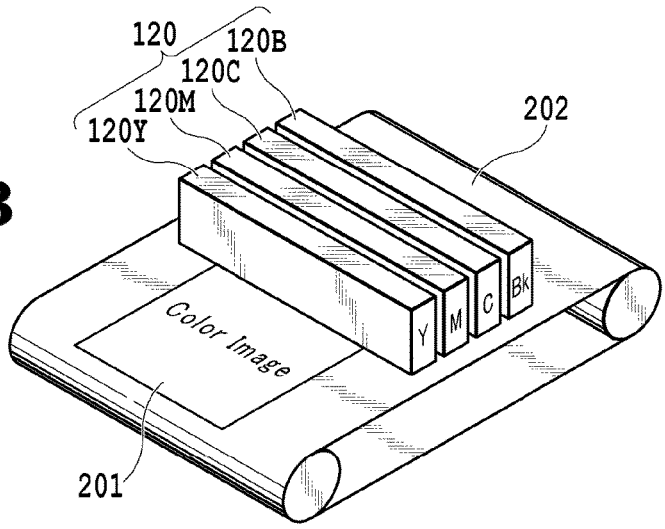
Figure 25C:
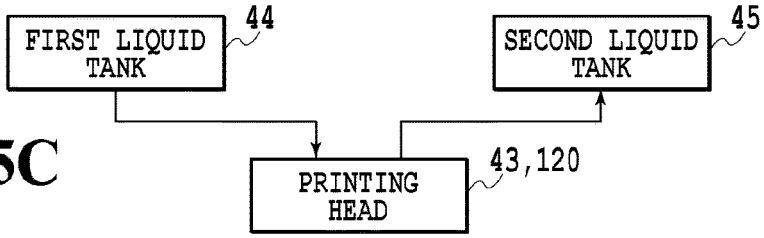
FIG. 25C is an explanatory diagram illustrating an ink supply system for a printing head.

FIGS. 25A to 25C are diagrams illustrating configuration examples having different inkjet printing apparatuses employing the liquid ejection apparatus of the present invention.

An inkjet printing apparatus of FIG. 25A is a serial scan type printing apparatus that uses a printing head having a configuration of FIG. 24A as a printing head 43. A chassis 47 is formed by a plurality of plate-shaped metal members having predetermined rigidity and forms a frame of the printing apparatus. A feeding unit 41, a conveying unit 42, and a carriage 46 equipped with the printing head 43 and movable in the main scan direction indicated by the arrow X are assembled to the chassis 47. The main scan direction is a direction intersecting (in this example, orthogonal to) the extension direction of the ejection opening array in the printing head 43. The feeding unit 41 automatically feeds a sheet-shaped print medium (not illustrated) into the printing apparatus and the conveying unit 42 conveys the print medium fed one by one from the feeding unit 41 in the sub-scan direction indicated by the arrow Y. The sub-scan direction is a direction intersecting (in this example, orthogonal to) the main scan direction. Such a printing apparatus prints an image on the print medium by repeating a printing operation of ejecting the ink from the ejection opening of the printing head 43 while moving the printing head 43 in the main scan direction along with the carriage 46 and a conveying operation of conveying the print medium in the sub-scan direction. The ink is supplied from an ink tank (not illustrated) to the printing head 43.

An inkjet printing apparatus of FIG. 25B is a full line type printing apparatus that uses the elongated printing head 120 described in FIGS. 24B, 24C, 24D, and 24E and includes a conveying mechanism 202 that continuously conveys a sheet (a print medium) 201 in a direction indicated by the arrow Y. As the conveying mechanism 202, a structure using a conveying roller or the like may be used instead of the structure of this example using a conveyor belt. In this example, four printing heads 120Y, 120M, 120C, and 120B ejecting inks of yellow (Y), magenta (M), cyan (C), and black (Bk) are provided as the printing head 120. Corresponding inks are supplied to the printing heads 120 (120Y, 120M, 120C, 120B). When the ink is ejected from the printing head 120 at a fixed position while the sheet 201 is continuously conveyed in a direction indicated by the arrow Y, a color image can be continuously printed on the sheet 201.

FIG. 25C is an explanatory diagram illustrating an ink supply system for the printing heads 43 and 120. The ink inside a first ink tank 44 is supplied to the third common supply passage 36 of the printing head 43 or 120, passes through the pressure chamber 13, and is collected from the third common collection passage 37 into a second ink tank 45. As a method of generating the ink circulation flow inside the printing head 43 or 120, for example, there is known a method of using a water head difference between the first ink tank 44 and the second ink tank 45. Alternatively, there is known a method of generating a difference in pressure between the first ink tank 44 and the second ink tank 45 by controlling the pressures inside the first ink tank 44 and the second ink tank 45. Furthermore, there is known a method of generating the ink circulation flow by using a pump or the like. A configuration of the ink supply system and a method of generating the ink circulation flow are not limited to this example and can be arbitrarily set. The configuration and the method do not matter as long as a differential pressure generator capable of generating a difference in pressure necessary for the circulation of the ink inside the pressure chamber can be configured.

In such printing apparatus, by generating the ink circulation flow in the printing head, a high-quality image can be printed with high accuracy while a decrease in ink ejection speed and a change in ink color concentration caused by the evaporation of moisture in the ink from the ejection opening are suppressed.

First Application Example

FIGS. 26 to 38 are diagrams illustrating a first application example to which the present invention is applicable.

(Description of Inkjet Printing Apparatus)

Figure 26:
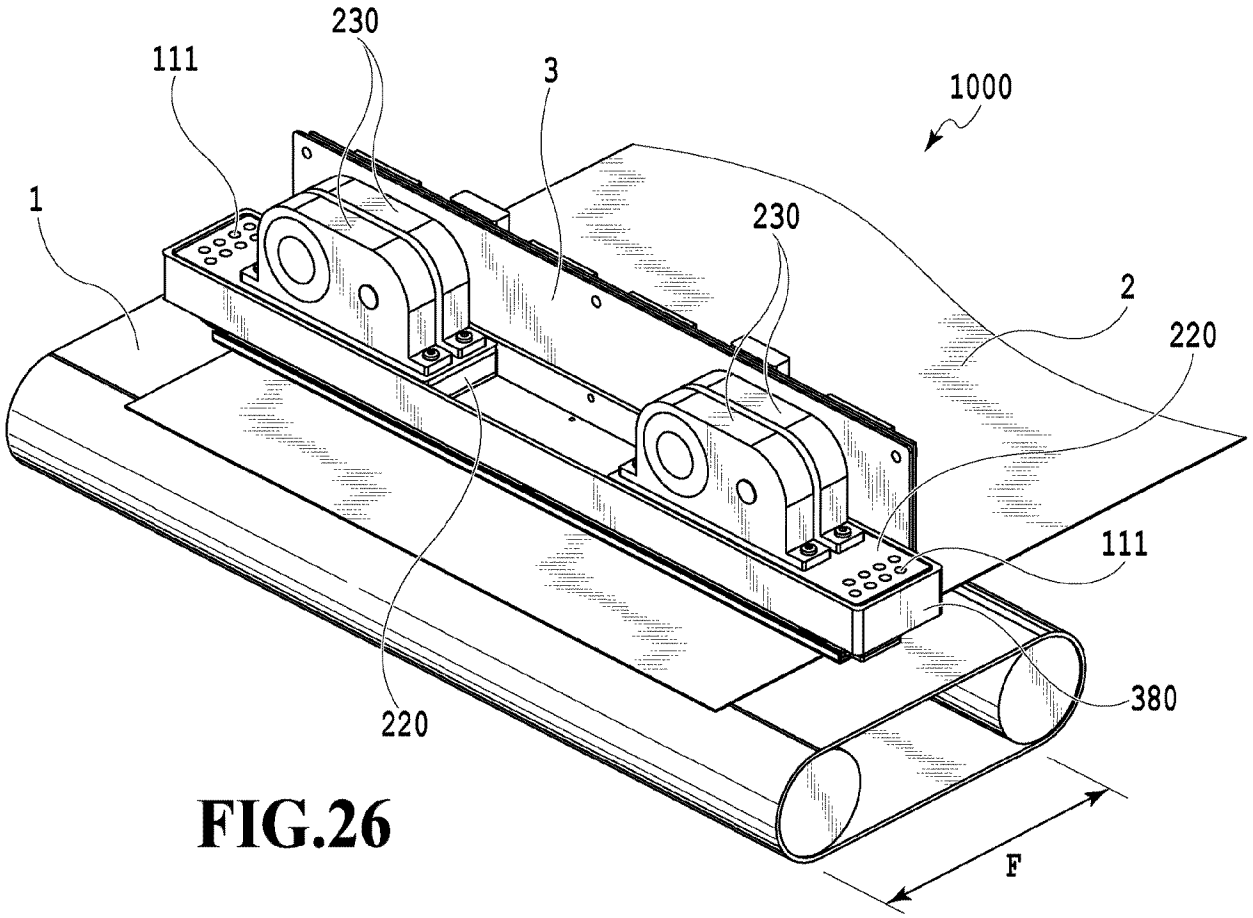
FIG. 26 is an explanatory diagram illustrating a printing apparatus according to a first application example of the present invention.

FIG. 26 is a diagram illustrating a schematic configuration of a liquid ejection apparatus in the present invention that ejects a liquid and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230, a liquid connection portion 111 which serves as an ink supply opening and an ink discharge opening of the liquid supply unit 220, and a casing 380. The print medium 2 is not limited to a cut sheet and may be also a continuous roll medium. The liquid ejection head 3 can print a full color image by inks of cyan C, magenta M, yellow Y, and black K and is fluid-connected to a liquid supply member, a main tank, and a buffer tank (see FIG. 27 to be described later) which serve as a supply path supplying a liquid to the liquid ejection head 3. Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation configuration includes a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head 3. Hereinafter, the first circulation configuration and the second circulation configuration of the circulation will be described.

(Description of First Circulation Configuration)

Figure 27:
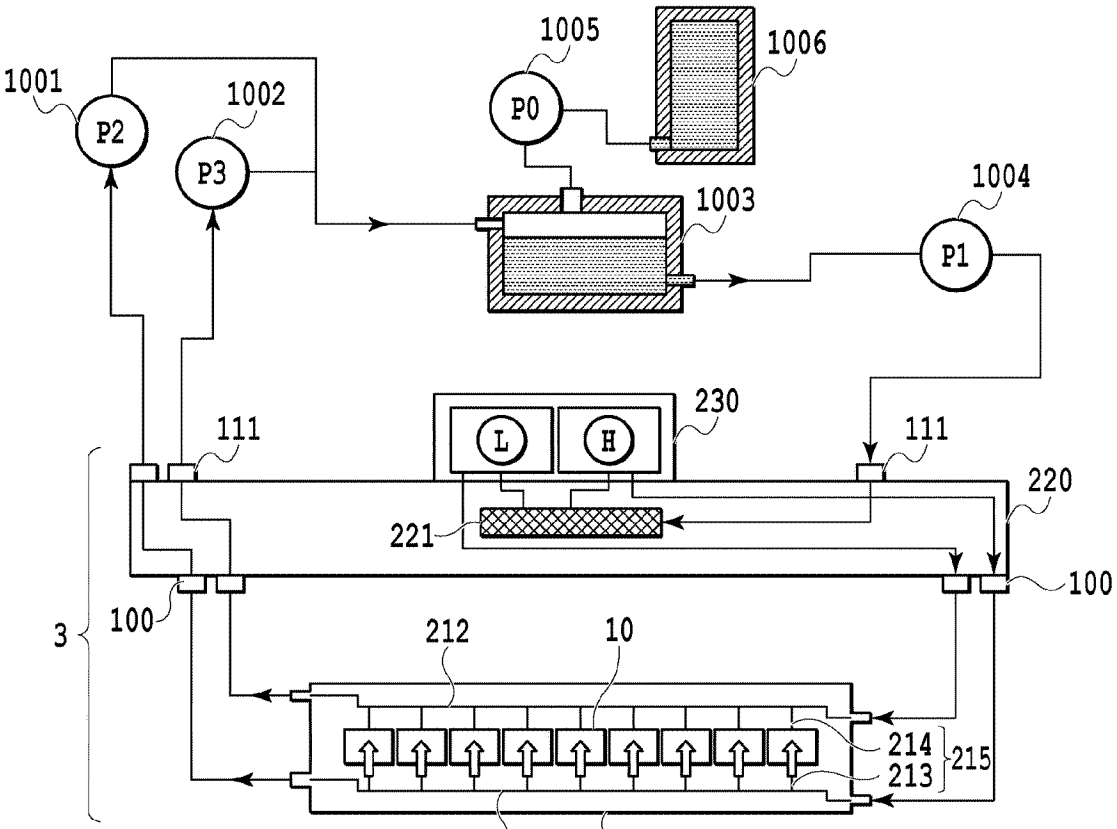
FIG. 27 is an explanatory diagram illustrating a first circulation configuration in a circulation path applied to the printing apparatus of FIG. 26.

FIG. 27 is a schematic diagram illustrating the first circulation configuration in the circulation path applied to the printing apparatus 1000 of the application example. The liquid ejection head 3 is fluid-connected to a first circulation pump (the high pressure side) 1001, a first circulation pump (the low pressure side) 1002, and a buffer tank 1003. Further, in FIG. 27, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation configuration, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003.

The buffer tank 1003 as a sub-tank is connected to the main tank 1006, and includes an atmosphere communication opening (not illustrated) communicating the inside of the tank 1003 with the outside and thus can discharge bubbles in the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (discharge) of the ink from the ejection opening of the liquid ejection head 3 in a printing operation and a suction recovery operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during the printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality. Above all, when a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even when the flow rate of the ink changes in the circulation system due to a difference in ink ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure. As an example, a mechanism such as a so-called "pressure reduction regulator" can be employed. In the circulation passage of the application example, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004. As illustrated in FIG. 27, the negative pressure control unit 230 includes two negative pressure adjustment mechanisms respectively having different control pressures. Among two negative pressure adjustment mechanisms, a relatively high pressure side (indicated by "H" in FIG. 27) and a relatively low pressure side (indicated by "L" in FIG. 27) are respectively connected to the common supply passage 211 and the common collection passage 212 inside the liquid ejection unit 300 through the liquid supply unit 220. The liquid ejection unit 300 is provided with the common supply passage 211, the common collection passage 212, and individual passages 215 (individual supply passages 213 and individual collection passages 214) communicating with the print element board. The negative pressure control mechanism H is connected to the common supply passage 211, the negative pressure control mechanism L is connected to the common collection passage 212, and a differential pressure is formed between two common passages 211 and 212. Then, since the individual passage 215 communicates with the common supply passage 211 and the common collection passage 212, a flow (a flow indicated by an arrow direction of FIG. 27) is generated in which a part of the liquid flows from the common supply passage 211 to the common collection passage 212 through the passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the application example can print a high-quality image at a high speed.

(Description of Second Circulation Configuration)

Figure 28:
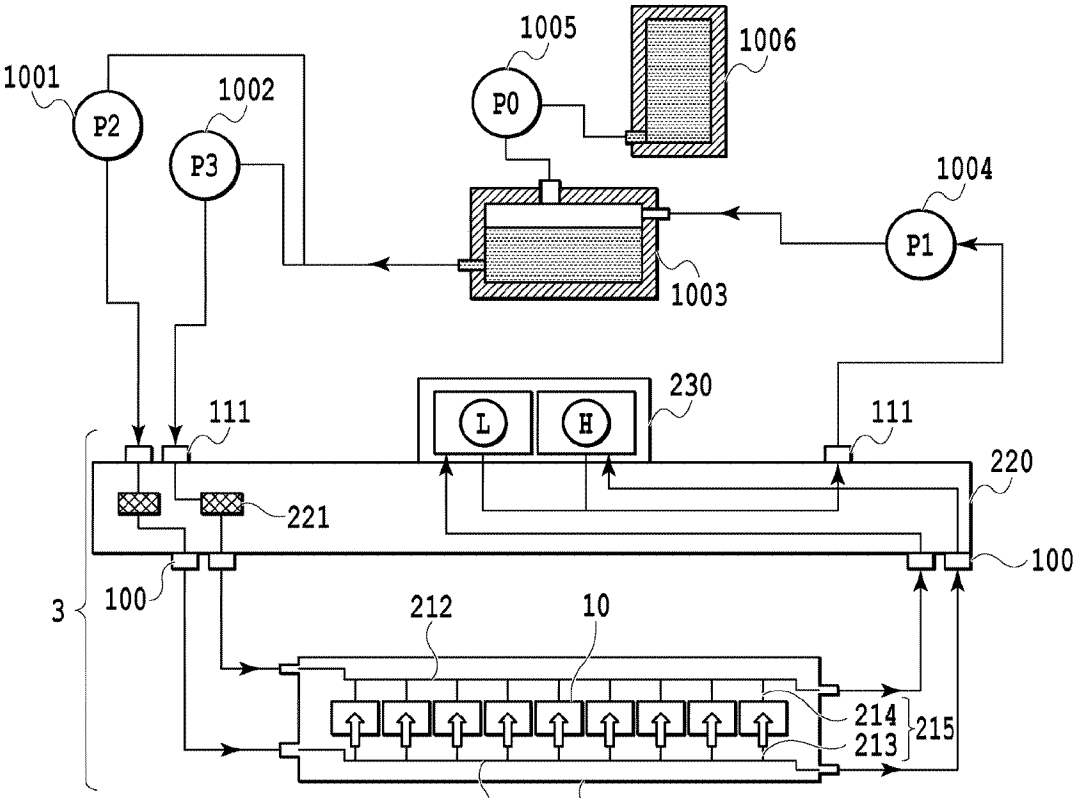
FIG. 28 is an explanatory diagram illustrating a second circulation configuration in the circulation path applied to the printing apparatus of FIG. 26.

FIG. 28 is a schematic diagram illustrating the second circulation configuration which is a circulation configuration different from the first circulation configuration in the circulation path applied to the printing apparatus of the application example. A main difference from the first circulation configuration is that two negative pressure control mechanisms constituting the negative pressure control unit 230 both control a pressure at the upstream side of the negative pressure control unit 230 within a predetermined range from a desired set pressure. Further, another difference from the first circulation configuration is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation configuration, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the negative pressure control unit 230 and the liquid connection portion 111. The discharged ink is returned to the buffer tank 1003 by the second circulation pump 1004.

In the second circulation configuration, the negative pressure control unit 230 stabilizes a change in pressure at the upstream side (that is, the liquid ejection unit 300 side) of the negative pressure control unit 230 within a predetermined range from a predetermined pressure even when a change in flow rate is caused by a change in ink ejection amount per unit area. In the circulation passage of the application example, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options. Instead of the second circulation pump 1004, for example, a water head tank disposed to have a predetermined water head difference with respect to the negative pressure control unit 230 can be also used. Similarly to the first circulation configuration, in the second circulation configuration, the negative pressure control unit 230 includes two negative pressure control mechanisms respectively having different control pressures. Among two negative pressure adjustment mechanisms, a high pressure side (indicated by "H" in FIG. 28) and a low pressure side (indicated by "L" in FIG. 28) are respectively connected to the common supply passage 211 and the common collection passage 212 inside the liquid ejection unit 300 through the liquid supply unit 220. When the pressure of the common supply passage 211 is set to be higher than the pressure of the common collection passage 212 by two negative pressure adjustment mechanisms, a flow of the liquid is formed from the common supply passage 211 to the common collection passage 212 through the individual passage 215 and the passages formed inside the print element boards 10.

In such a second circulation configuration, the same liquid flow as that of the first circulation configuration can be obtained inside the liquid ejection unit 300, but has two advantages different from those of the first circulation configuration. As a first advantage, in the second circulation configuration, since the negative pressure control unit 230 is disposed at the downstream side of the liquid ejection head 3, there is low concern that a foreign material or a trash produced from the negative pressure control unit 230 flows into the liquid ejection head 3. As a second advantage, in the second circulation configuration, a maximal value of the flow rate necessary for the liquid supplied from the buffer tank 1003 to the liquid ejection head 3 is smaller than that of the first circulation configuration. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening×the ejection frequency per unit time×the number of the ejection openings).

Figure 29:
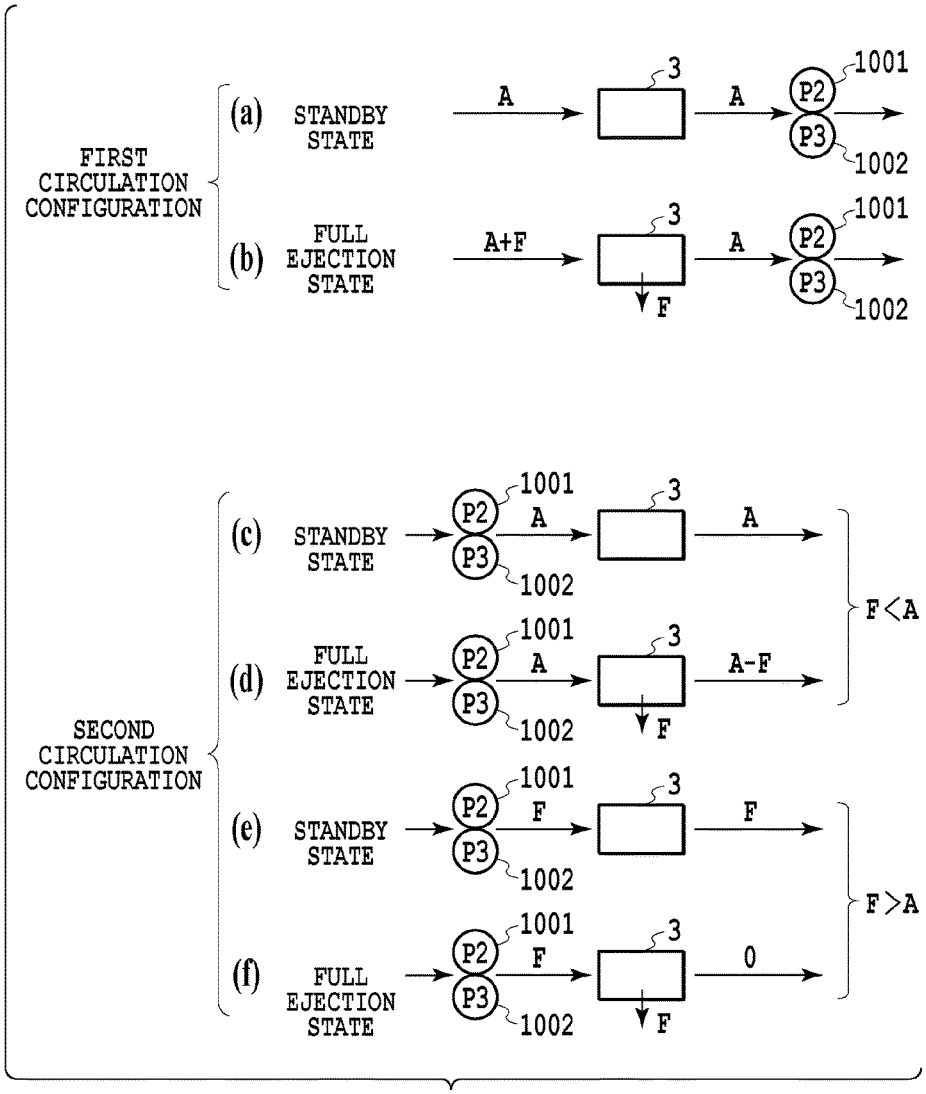
FIG. 29 is an explanatory diagram illustrating an ink circulation amount in the first circulation configuration and the second circulation configuration.

FIG. 29 is a schematic diagram illustrating a difference in ink inflow amount to the liquid ejection head between the first circulation configuration and the second circulation configuration. A part (a) of FIG. 29 illustrates the standby state in the first circulation configuration and a part (b) of FIG. 29 illustrates the full ejection state in the first circulation configuration. Parts (c) to (f) of FIG. 29 illustrate the second circulation configuration. Here, the parts (c) and (d) of FIG. 29 illustrate a case where the flow rate F is lower than the flow rate A and the parts (e) and (f) of FIG. 29 illustrate a case where the flow rate F is higher than the flow rate A. In this way, the flow rates in the standby state and the full ejection state are illustrated.

In the case of the first circulation configuration (the parts (a) and (b) of FIG. 29) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of {(the flow rate A)+(the flow rate F)} since the flow rate F is added to the flow rate A (part (b) of FIG. 29).

Meanwhile, in the case of the second circulation configuration (parts (c) and (d) of FIG. 29) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation configuration. Thus, when the flow rate A is higher than the flow rate F (parts (c) and (d) of FIG. 29) in the second circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of {(the flow rate A)−(the flow rate F)} (part (d) of FIG. 29). However, when the flow rate F is higher than the flow rate A (parts (e) and (f) of FIG. 29), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (part (f) of FIG. 29). In addition, if the liquid is ejected but not ejected in the full ejection state when the flow rate F is higher than the flow rate A, the liquid which is attracted by the amount consumed by the ejection of the flow rate F is discharged from the liquid ejection head 3. the liquid which is reduced by the amount consumed by the ejection from the flow rate F is discharged from the liquid ejection head 3. Further, when the flow rate A and the flow rate F are equal to each other, the flow rate A (or the flow rate F) is supplied to the liquid ejection head 3 and the flow rate F is consumed by the liquid ejection head 3. For this reason, the flow rate discharged from the liquid ejection head 3 becomes almost zero.

In this way, in the case of the second circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation configuration becomes smaller than the maximal value {(the flow rate A)+(the flow rate F)} of the supply flow rate necessary for the first circulation configuration.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a long longitudinal length among the line heads is beneficial.

Meanwhile, the first circulation configuration has more advantageous than the second circulation configuration. That is, in the second circulation configuration, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with a main droplet of the ink.

Meanwhile, in the case of the first circulation configuration, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation configurations can be desirably selected in consideration of the specifications (the ejection flow rate F, the minimal circulation flow rate A, and the passage resistance inside the head) of the liquid ejection head and the printing apparatus body.

(Description of Third Circulation Configuration)

Figure 48:
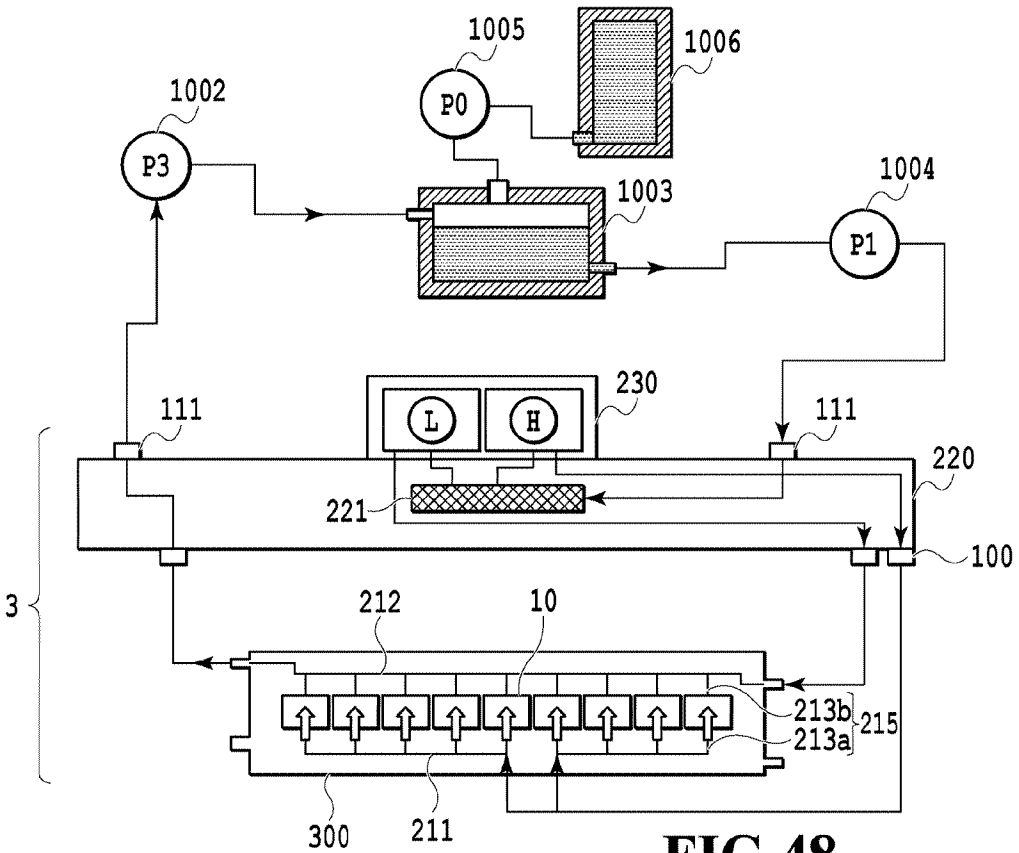
FIG. 48 is an explanatory diagram illustrating a third circulation configuration of an ink circulation path.

FIG. 48 is a schematic diagram illustrating a third circulation configuration which is one of the circulation paths used in the printing apparatus of the embodiment. A description of the same functions and configurations as those of the first and second circulation paths will be omitted and only a difference will be described.

In the circulation path, the liquid is supplied into the liquid ejection head 3 from three positions including two positions of the center portion of the liquid ejection head 3 and one end side of the liquid ejection head 3. The liquid flowing from the common supply passage 211 to each pressure chamber 23 is collected by the common collection passage 212 and is collected to the outside from the collection opening at the other end of the liquid ejection head 3. The individual passage 215 communicates with the common supply passage 211 and the common collection passage 212, and the print element board 10 and the pressure chamber 23 disposed inside the print element board 10 are provided in the path of the individual passage 215. Accordingly, a part of the liquid flowing from the first circulation pump 1002 flows from the common supply passage 211 to the common collection passage 212 while passing through the pressure chamber 23 of the print element board 10 (see an arrow of FIG. 48). This is because a differential pressure is generated between a pressure adjustment mechanism H connected to the common supply passage 211 and a pressure adjustment mechanism L connected to the common collection passage 212, and the first circulation pump 1002 is connected only to the common collection passage 212.

In this way, in the liquid ejection unit 300, a flow of the liquid passing through the common collection passage 212 and a flow of the liquid flowing from the common supply passage 211 to the common collection passage 212 while passing through the pressure chamber 23 inside each print element board 10 are generated. For this reason, heat generated by each print element board 10 can be discharged to the outside of the print element board 10 by the flow from the common supply passage 211 to the common collection passage 212 while pressure loss is suppressed. Further, according to the circulation path, the number of the pumps which are liquid transporting units can be decreased compared with the first and second circulation paths.

(Description of Configuration of Liquid Ejection Head)

Figure 30A:
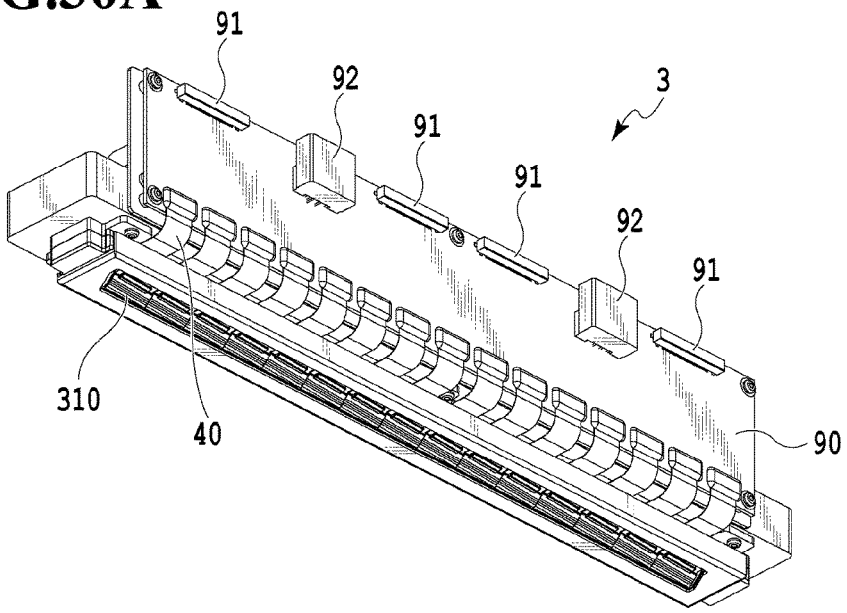
FIG. 30A and FIG. 30B are perspective views respectively illustrating the liquid ejection head of FIG. 26.
Figure 30B:
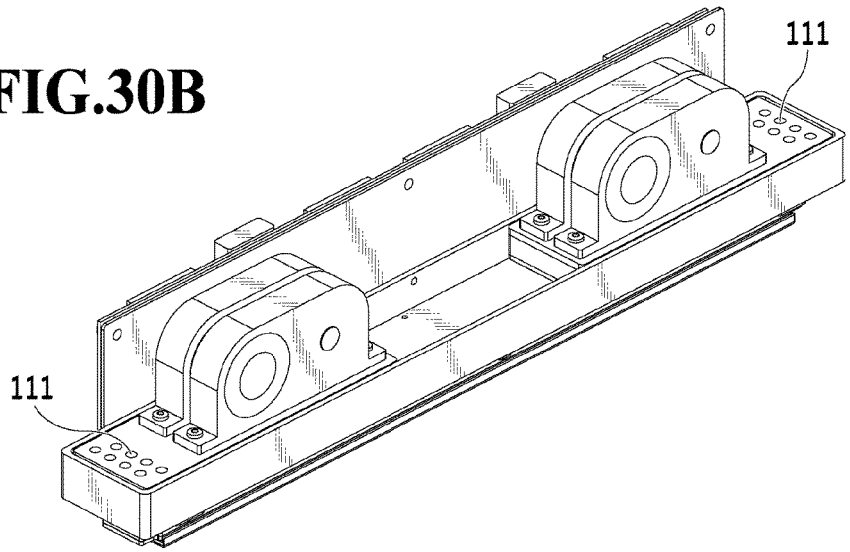

A configuration of the liquid ejection head 3 according to the first application example will be described. FIGS. 30A and 305 are perspective views illustrating the liquid ejection head 3 according to the application example. The liquid ejection head 3 is a line type liquid ejection head in which fifteen print element boards 310 capable of ejecting inks of four colors of cyan C, magenta M, yellow Y, and black K are arranged in series (an in-line arrangement). As illustrated in FIG. 30A, the liquid ejection head 3 includes the print element boards 310 and a signal input terminal 91 and a power supply terminal 92. These terminals 91 and 92 are electrically connected to the print element board 310 through a flexible circuit board 40 and an electric wiring board 90. The signal input terminal 91 and the power supply terminal 92 are electrically connected to the control unit of the printing apparatus 1000 so that an ejection drive signal and power necessary for the ejection are supplied to the print element board 310. When the wirings are integrated by the electric circuit inside the electric wiring board 90, the number of the signal input terminals 91 and the power supply terminals 92 can be decreased compared with the number of the print element boards 310. Accordingly, the number of electrical connection components to be separated when the liquid ejection head 3 is assembled to the printing apparatus 1000 or the liquid ejection head is replaced decreases. As illustrated in FIG. 30B, the liquid connection portions 111 which are provided at both ends of the liquid ejection head 3 are connected to the liquid supply system of the printing apparatus 1000. Accordingly, the inks of four colors including cyan C, magenta M, yellow Y, and black K are supplied from the supply system of the printing apparatus 1000 to the liquid ejection head 3, and the inks passing through the liquid ejection head 3 are collected by the supply system of the printing apparatus 1000. In this way, the inks of different colors can be circulated through the path of the printing apparatus 1000 and the path of the liquid ejection head 3.

Figure 31:
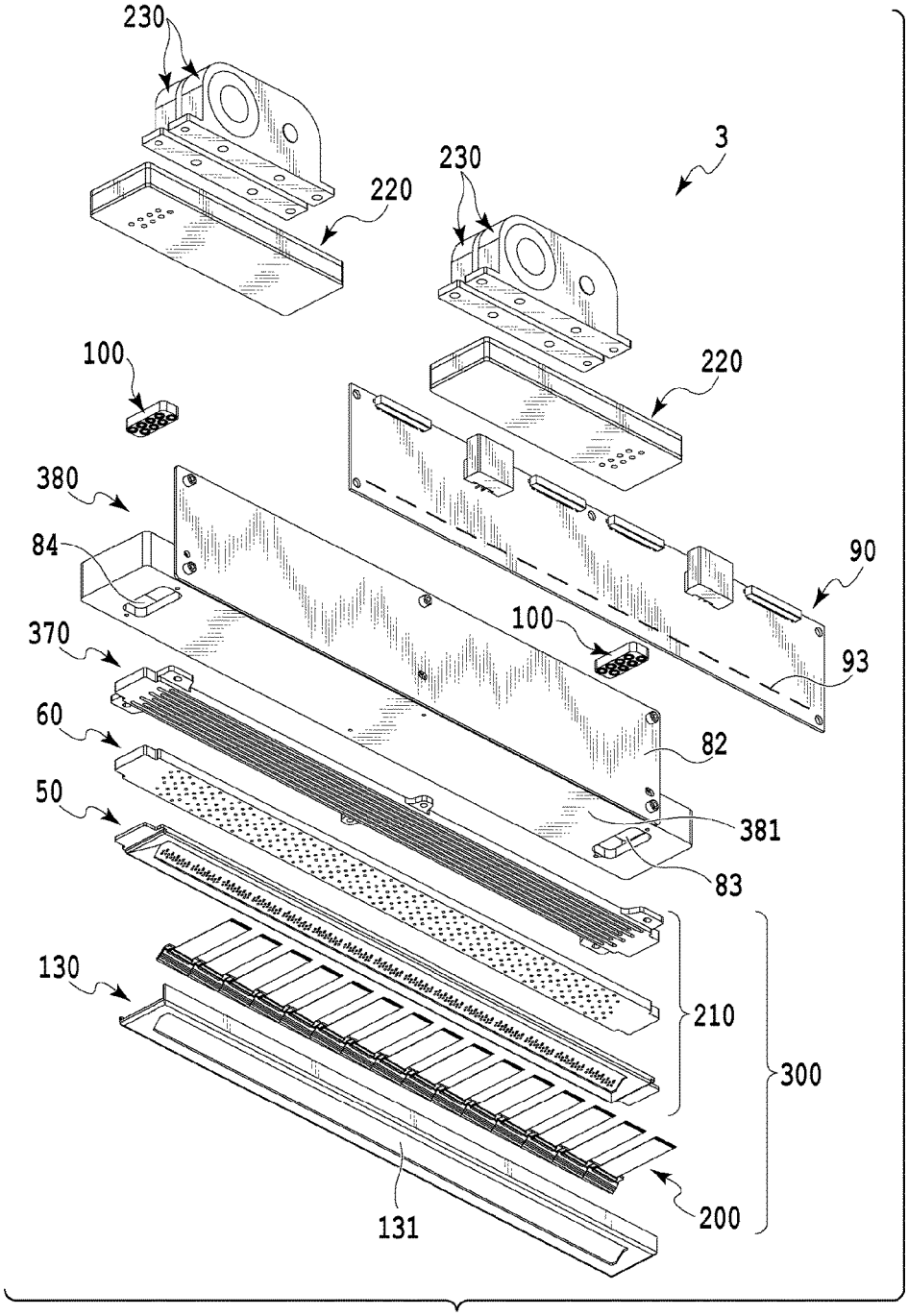
FIG. 31 is an exploded perspective view illustrating the liquid ejection head.

FIG. 31 is an exploded perspective view illustrating components or units constituting the liquid ejection head 3. The liquid ejection unit 300, the liquid supply unit 220, and the electric wiring board 90 are attached to the casing 380. The liquid connection portions 111 (see FIG. 28) are provided in the liquid supply unit 220. Also, in order to remove a foreign material in the supplied ink, filters 221 (see FIGS. 27 and 28) for different colors are provided inside the liquid supply unit 220 while communicating with the openings of the liquid connection portions 111. Two liquid supply units 220 respectively provided with the filters 221 corresponding to two colors. In the first circulation configuration as illustrated in FIG. 27, the liquid passing through the filter 221 is supplied to the negative pressure control unit 230 disposed on the liquid supply unit 220 disposed to correspond to each color. The negative pressure control unit 230 is a unit which includes negative pressure control valves corresponding to different colors. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change negative pressure at the downstream side (liquid ejection unit 300 side) of the negative pressure control unit within a predetermined range. As described in FIG. 27, two negative pressure control valves corresponding to each color are built inside the negative pressure control unit 230. Two negative pressure control valves are respectively set to different control pressures. Here, the high pressure side of the two negative pressure control valves communicates with the common supply passage 211 (see FIG. 27) inside the liquid ejection unit 300 through the liquid supply unit 220, and the low pressure side of the two negative pressure control valves communicates with the common collection passage 212 (see FIG. 27) through the liquid supply unit 220.

The casing 380 includes a liquid ejection unit support portion 381 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 381 by screws. The liquid ejection unit support portion 381 is used to correct the warpage or deformation of the liquid ejection unit 300 to ensure the relative position accuracy among the print element boards 310. Accordingly, stripe and unevenness of an image printed on the medium is suppressed. For that reason, it is desirable that the liquid ejection unit support portion 381 have sufficient rigidity. As a material, metal such as SUS or aluminum or ceramic such as alumina is desirable. The liquid ejection unit support portion 381 is provided with openings 83 and 84 into which a joint rubber 100 is inserted. The liquid supplied from the liquid supply unit 220 is led to a third passage member 370 constituting the liquid ejection unit 300 through the joint rubber 100.

The liquid ejection unit 300 includes a plurality of ejection modules 200 and a passage member 210, and a cover member 130 is attached to a face near the print medium in the liquid ejection unit 300. Here, the cover member 130 is a member having a picture frame shaped surface and provided with an elongated opening 131 as illustrated in FIG. 31, and the print element board 310 and a sealing member 110 (see FIG. 35A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 31, the passage member 210 is obtained by laminating a first passage member 50, a second passage member 60, and a third passage member 370, and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 381 by screws and thus the warpage or deformation of the passage member 210 is suppressed.

Figure 32:
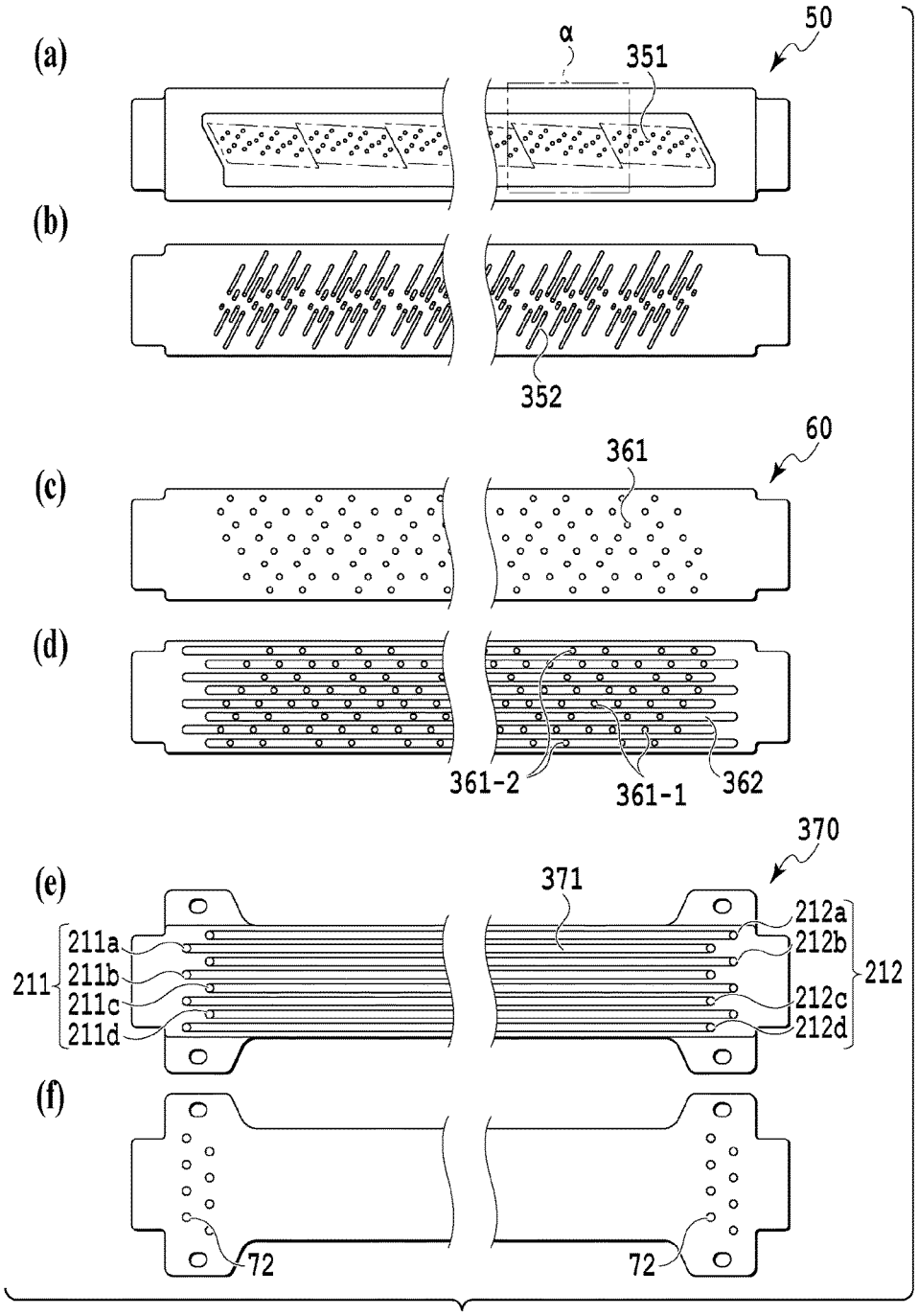
FIG. 32 is a diagram illustrating front and rear faces of first, second, and third passage members in the liquid ejection head.

Parts (a) to (f) of FIG. 32 are diagrams illustrating front and rear faces of the first to third passage members. The part (a) of FIG. 32 illustrates a face of the first passage member 50 onto which the ejection module 200 is mounted, and the part (f) of FIG. 32 illustrates a face of the third passage member 370 with which the liquid ejection unit support portion 381 comes into contact. The first passage member 50 and the second passage member 60 are bonded to teach other so that the parts illustrated in the parts (b) and (c) of FIG. 32 corresponding to the contact faces of the passage members 50 and 60 face each other. The second passage member 60 and the third passage member 370 are bonded to each other so that the parts illustrated in the parts (d) and (e) of FIG. 32 corresponding to the contact faces of the passage members 60 and 370 face each other. When the second passage member 60 and the third passage member 370 are bonded to each other, eight common passages (211*a*, 211*b*, 211*c*, 211*d*, 212*a*, 212*b*, 212*c*, 212*d*) extending in the longitudinal direction of the passage member are formed by common passage grooves 362 and 371 of the passage members. Accordingly, a set of the common supply passage 211 and the common collection passage 212 is formed inside the passage member 210 to correspond to each color. The ink is supplied from the common supply passage 211 to the liquid ejection head 3, and the ink supplied to the liquid ejection head 3 is collected by the common collection passage 212. A communication opening 72 (see the part (f) of FIG. 32) of the third passage member 370 communicates with the corresponding hole of the joint rubber 100, and is fluid-connected to the liquid supply unit 220 (see FIG. 31). A bottom face of the common passage groove 362 of the second passage member 60 is provided with a plurality of communication openings 361 (a communication opening 361-1 communicating with the common supply passage 211 and a communication opening 361-2 communicating with the common collection passage 212). Such a communication openings 361 communicates with one end of a corresponding individual passage groove 352 of the first passage member 50. The other end of the individual passage groove 352 of the first passage member 50 is provided with a communication opening 351, and is fluid-connected to the ejection modules 200 through the communication opening 351. By the individual passage groove 352, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 33:
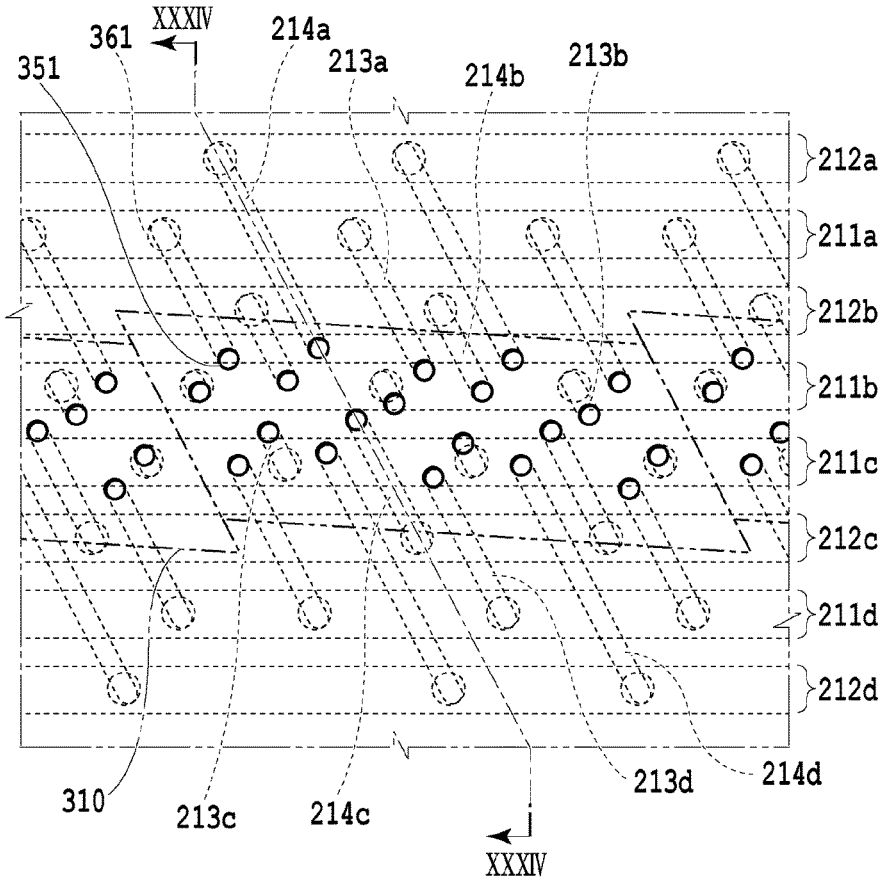
FIG. 33 is an enlarged perspective view illustrating passages formed by bonding the first, second, and third passage members.

FIG. 33 is a partially enlarged perspective view illustrating a part α of the part (a) of FIG. 32 and illustrating the passages inside the passage member 210 formed by bonding the first to third passage members to one another when viewed from a face onto which the ejection module 200 is mounted on the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

In the passage member 210, the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 are provided for each color. The individual supply passages 213 (213*a*, 213*b*, 213*c*, 213*d*) which are formed by the individual passage grooves 352 are connected to the common supply passages 211 of different colors through the communication openings 361. Further, the individual collection passages 214 (214*a*, 214*b*, 214*c*, 214*d*) formed by the individual passage grooves 352 are connected to the common collection passages 212 of different colors through the communication openings 361. With such a passage configuration, the ink can be intensively supplied to the print element board 310 located at the center portion of the passage member from the common supply passages 211 through the individual supply passages 213. Further, the ink can be collected from the print element board 310 to the common collection passages 212 through the individual collection passages 214.

Figure 34:
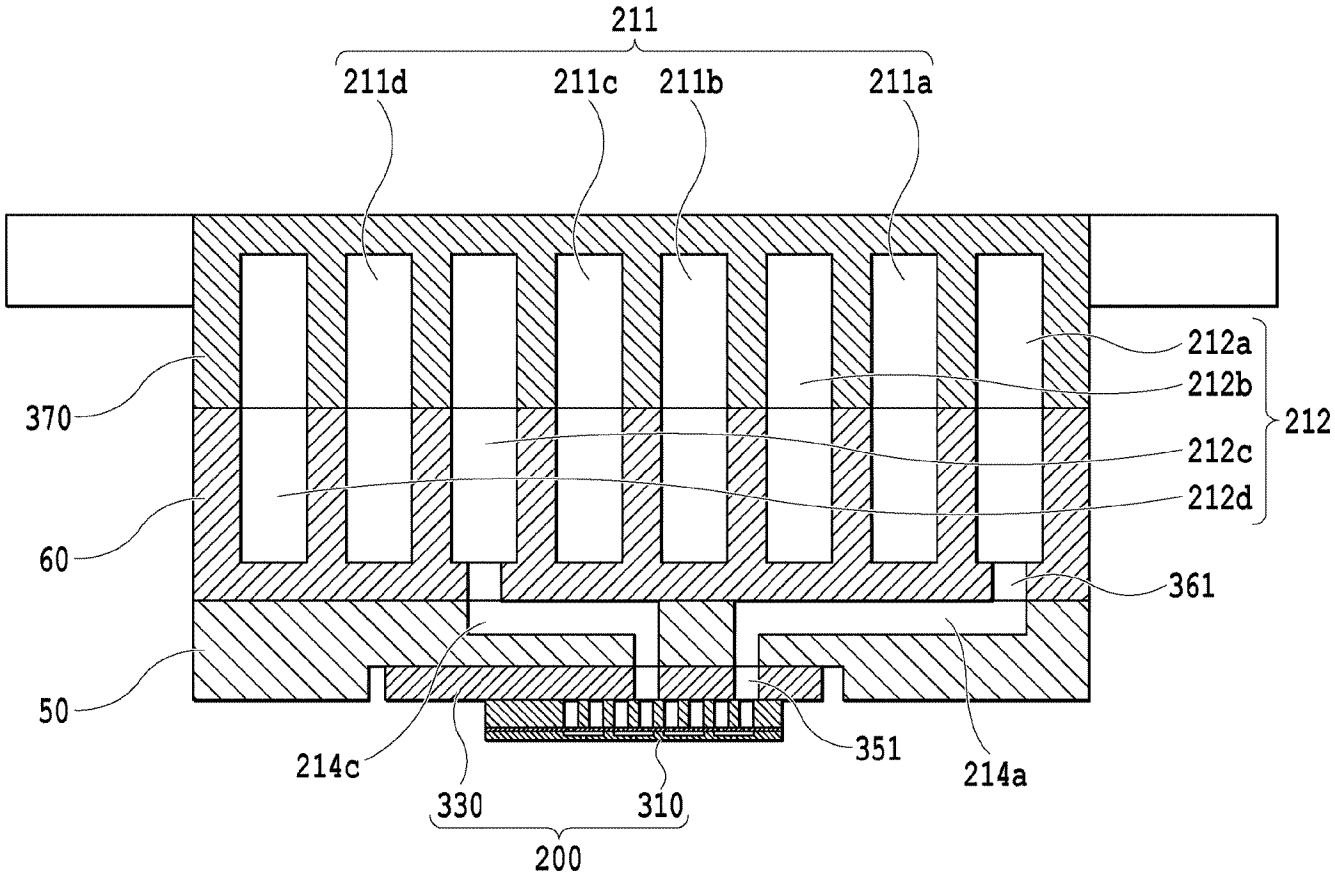
FIG. 34 is a cross-sectional view taken along a line XXXIV-XXXIV of FIG. 33.

FIG. 34 is a cross-sectional view taken along a line XXXIV-XXXIV of FIG. 33. The individual collection passages (214*a*, 214*c*) communicate with the ejection module 200 through the communication openings 351. In FIG. 34, only the individual collection passages (214*a*, 214*c*) are illustrated, but in a different cross-section, the individual supply passages 213 and the ejection module 200 communicates with each other as illustrated in FIG. 33. A support member 330 and the print element board 310 which are included in each ejection module 200 are provided with passages which supply the ink from the first passage member 50 to a print element 315 provided in the print element board 310. Further, the support member 330 and the print element board 310 are provided with passages which collect (re-circulate) a part or the entirety of the liquid supplied to the print element 315 to the first passage member 50.

Here, the common supply passage 211 of each color is connected to the negative pressure control unit 230 (the high pressure side) of corresponding color through the liquid supply unit 220, and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 33 and 34, a liquid flow of each color is generated in order of the common supply passage 211, the individual supply passage 213, the print element board 310, the individual collection passage 214, and the common collection passage 212 inside the liquid ejection head of the application example having the passages connected to one another.

(Description of Ejection Module)

Figure 35A:
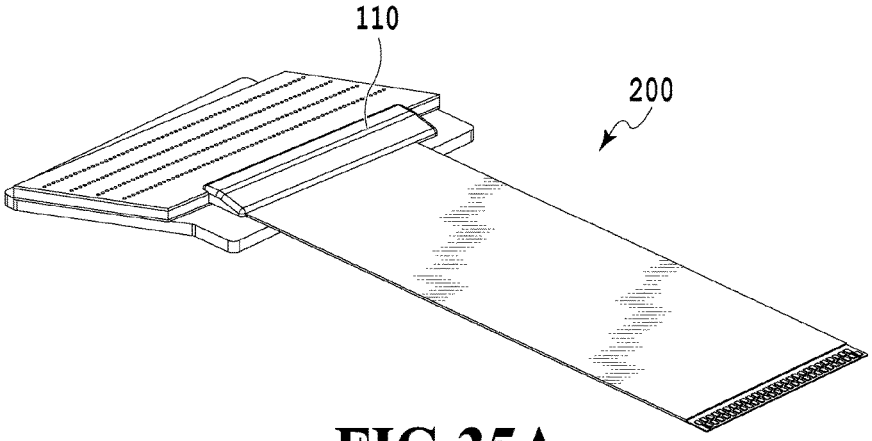
FIGS. 35A and 35B are perspective views respectively illustrating an ejection module.
Figure 35B:
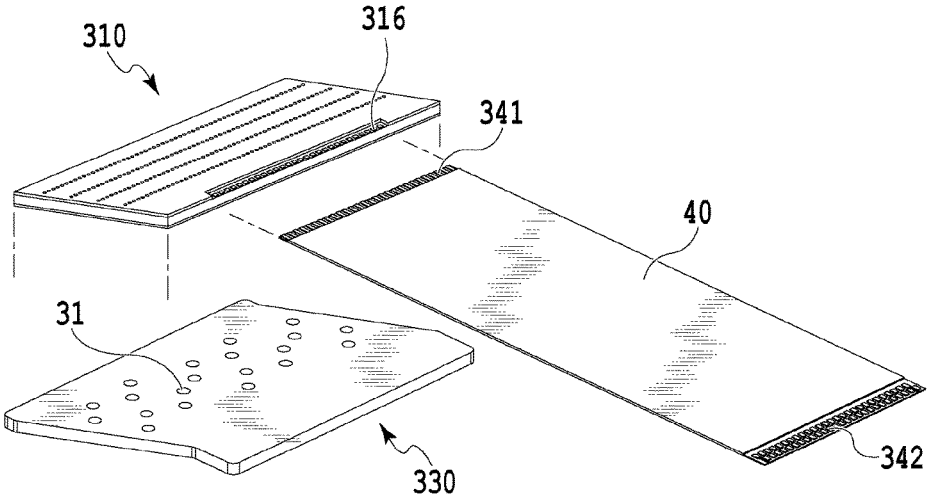

FIG. 35A is a perspective view illustrating one ejection module 200 and FIG. 35B is an exploded view thereof. As a method of manufacturing the ejection module 200, first, the print element board 310 and the flexible circuit board 40 are adhered onto the support member 330 provided with a liquid communication opening 31. Subsequently, a terminal 316 on the print element board 310 and a terminal 341 on the flexible circuit board 40 are electrically connected to each other by wire bonding, and the wire bonded portion (the electrical connection portion) is sealed by the sealing member 110. A terminal 342 which is opposite to the print element board 310 of the flexible circuit board 40 is electrically connected to a connection terminal 93 (see FIG. 31) of the electric wiring board 90. Since the support member 330 serves as a support body that supports the print element board 310 and a passage member that fluid-communicates the print element board 310 and the passage member 210 to each other, it is desirable that the support member 330 have high flatness and sufficiently high reliability while being bonded to the print element board. As a material, for example, alumina or resin is desirable.

(Description of Structure of Print Element Board)

Figure 36A:
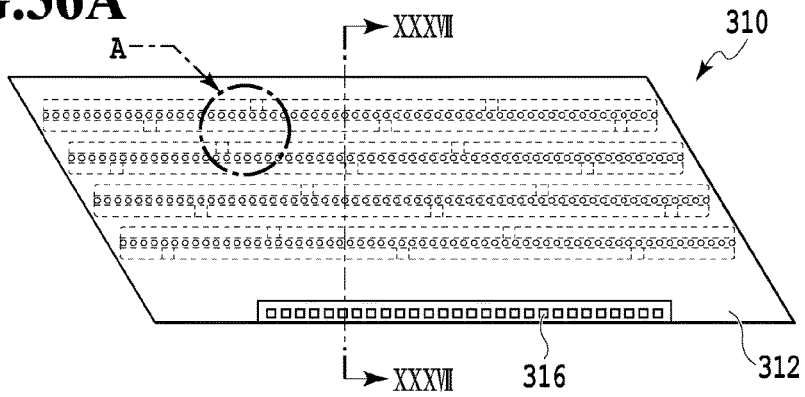
FIGS. 36A, 36B, and 36C are explanatory diagrams respectively illustrating a print element board.
Figure 36B:
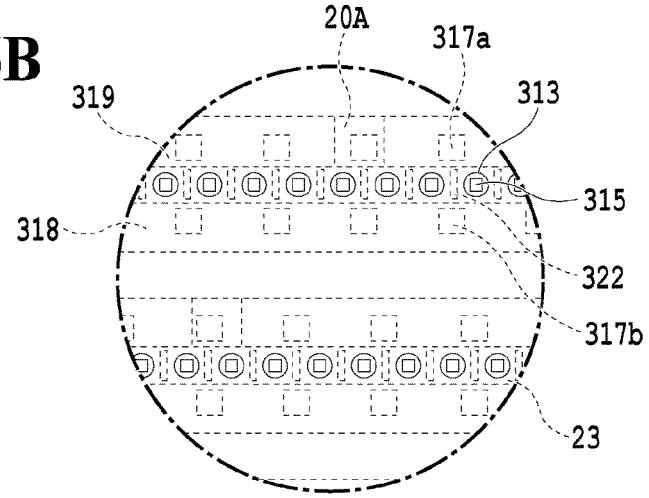
Figure 36C:
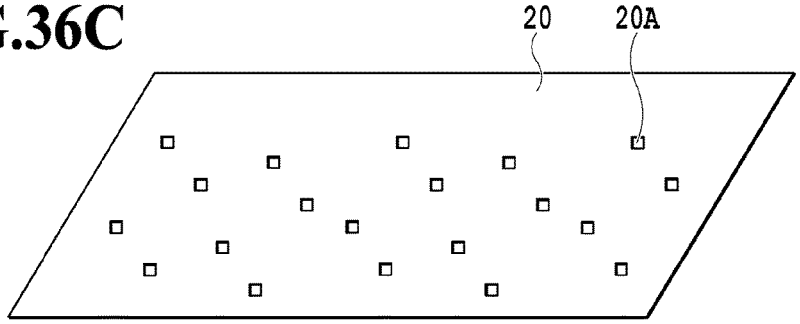

FIG. 36A is a top view illustrating a face provided with an ejection opening 313 of the print element board 310, FIG. 36B is an enlarged view of a part A of FIG. 36A, and FIG. 36C is a top view illustrating a rear face of FIG. 36A. Here, a configuration of the print element board 310 of the application example will be described. As illustrated in FIG. 36A, an ejection opening forming member 312 of the print element board 310 is provided with four ejection opening arrays corresponding to different colors of inks. Further, the extension direction of the ejection opening arrays of the ejection openings 313 will be referred to as an "ejection opening array direction". As illustrated in FIG. 36B, the print element 315 serving as an ejection energy generation element for ejecting the liquid by heat energy is disposed at a position corresponding to each ejection opening 313. A pressure chamber 323 providing the print element 315 is defined by a partition wall 22. The print element 315 is electrically connected to the terminal 316 by an electric wire (not illustrated) provided in the print element board 310. Then, the print element 315 boils the liquid while being heated on the basis of a pulse signal input from a control circuit of the printing apparatus 1000 via the electric wiring board 90 (see FIG. 31) and the flexible circuit board 40 (see FIG. 35B). The liquid is ejected from the ejection opening 313 by a foaming force caused by the boiling. As illustrated in FIG. 36B, a liquid supply path 318 extends at one side along each ejection opening array and a liquid collection path 319 extends at the other side along the ejection opening array. The liquid supply path 318 and the liquid collection path 319 are passages that extend in the ejection opening array direction provided in the print element board 310 and communicate with the ejection opening 313 through a supply opening 317*a* and a collection opening 317*b*.

As illustrated in FIG. 36C, a sheet-shaped cover plate (lid member) 20 is laminated on a rear face of a face provided with the ejection opening 313 of the print element board 310, and the cover plate 20 is provided with a plurality of openings 20A communicating with the liquid supply path 318 and the liquid collection path 319. In the application example, the cover plate 20 is provided with three openings 20A for each liquid supply path 318 and two openings 20A for each liquid collection path 319. As illustrated in FIG. 36B, openings 20A of the cover plate 20 communicate with the communication openings 351 illustrated the part (a) of FIG. 32. It is desirable that the cover plate 20 have sufficient corrosion resistance for the liquid. From the viewpoint of preventing mixed color, the opening shape and the opening position of the opening 20A need to have high accuracy. For this reason, it is desirable to form the opening 20A by using a photosensitive resin material or a silicon plate as a material of the cover plate 20 through photolithography. In this way, the cover plate 20 changes the pitch of the passages by the opening 20A. Here, it is desirable to form the cover plate by a film-shaped member with a thin thickness in consideration of pressure loss.

Figure 37:
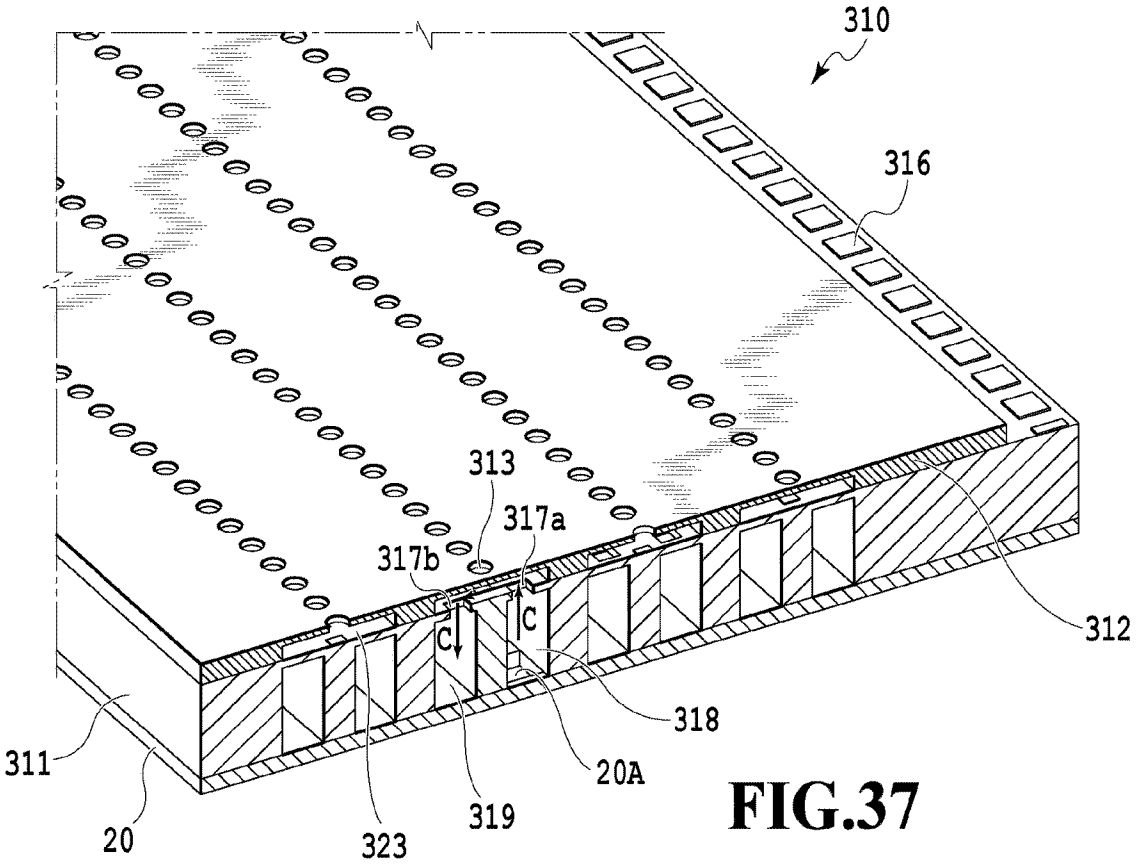
FIG. 37 is a perspective view illustrating cross-sections of the print element board taken along a line XXXVII-XXXVII of FIG. 36A.

FIG. 37 is a perspective view illustrating cross-sections of the print element board 310 and the cover plate 20 when taken along a line XXXVII-XXXVII of FIG. 36A. Here, a flow of the liquid inside the print element board 310 will be described. The cover plate 20 serves as a lid that forms a part of walls of the liquid supply path 318 and the liquid collection path 319 formed in a substrate 311 of the print element board 310. The print element board 310 is formed by laminating the substrate 311 formed of Si and an ejection opening forming member 312 formed of photosensitive resin, and the cover plate 20 is bonded to a rear face of the substrate 311. One face of the substrate 311 is provided with the print element 315 (see FIG. 36B) and a rear face thereof is provided with grooves forming the liquid supply path 318 and the liquid collection path 319 extending along the ejection opening array. The liquid supply path 318 and the liquid collection path 319 which are formed by the substrate 311 and the cover plate 20 are respectively connected to the common supply passage 211 and the common collection passage 212 inside each passage member 210, and a differential pressure is generated between the liquid supply path 318 and the liquid collection path 319. When the liquid is ejected from the ejection opening 313 to print an image, at the ejection opening not ejecting the liquid, the liquid inside the liquid supply path 318 provided inside the substrate 311 flows toward the liquid collection path 319 through the supply opening 317*a*, the pressure chamber 323, and the collection opening 317*b* by the differential pressure (see an arrow C of FIG. 37). By the flow, foreign materials, bubbles, and thickened ink produced by the evaporation from the ejection opening 313, at the ejection opening 313 or the pressure chamber 323 not involved with a printing operation, can be collected by the liquid collection path 319. Further, the thickening of the ink in the ejection opening 313 or the pressure chamber 323 can be suppressed. The liquid which is collected to the liquid collection path 319 is collected in order of the communication opening 351 inside the passage member 210, the individual collection passage 214, and the common collection passage 212 through the opening 20A of the cover plate 20 and the liquid communication opening 31 (see FIG. 35B) of the support member 330. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 371 provided in the third passage member, the common passage groove 362 and the communication opening 361 provided in the second passage member, and the individual passage groove 353 and the communication opening 351 provided in the first passage member. Subsequently, the liquid is supplied to the pressure chamber 23 while sequentially passing through the liquid communication opening 31 provided in the support member 330, the opening 20A provided in the cover plate 20, and the liquid supply path 318 and the supply opening 317*a* provided in the substrate 311. In the liquid supplied to the pressure chamber 23, the liquid which is not ejected from the ejection opening 313 sequentially flows through the collection opening 317*b* and the liquid collection path 319 provided in the substrate 311, the opening 20A provided in the cover plate 20, and the liquid communication opening 31 provided in the support member 330. Subsequently, the liquid sequentially flows through the communication opening 351 and the individual passage groove 352 provided in the first passage member, the communication opening 361 and the common passage groove 362 provided in the second passage member, the common passage groove 371 and the communication opening 72 provided in the third passage member 370, and the hole of joint rubber 100. Then, the liquid flows from the liquid connection portion 111 provided in the liquid supply unit 220 to the outside of the liquid ejection head 3.

In the first circulation configuration illustrated in FIG. 27, the liquid which flows from the liquid connection portion 111 is supplied to the hole of the joint rubber 100 through the negative pressure control unit 230. Further, in the second circulation configuration illustrated in FIG. 28, the liquid which is collected from the pressure chamber 323 passes through the hole of joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 323 through the individual supply passage 213*a*. That is, the liquid which flows from one end of the common supply passage 211 may flow from the other end of the common supply passage 211 to the liquid supply unit 220 while not flowing into the individual supply passage 213*a*. In this way, since the path is provided so that the liquid flows therethrough without passing through the print element board 310, the reverse flow of the circulation flow of the liquid can be suppressed even in the print element board 310 including the small passage with a large flow resistance as in the application example. In this way, since the thickening of the liquid in the vicinity of the ejection opening and the pressure chamber 23 can be suppressed in the liquid ejection head 3 of the application example, a slippage or a non-ejection of the liquid can be suppressed. As a result, a high-quality image can be printed.

(Description of Positional Relation Among Print Element Boards)

Figure 38:
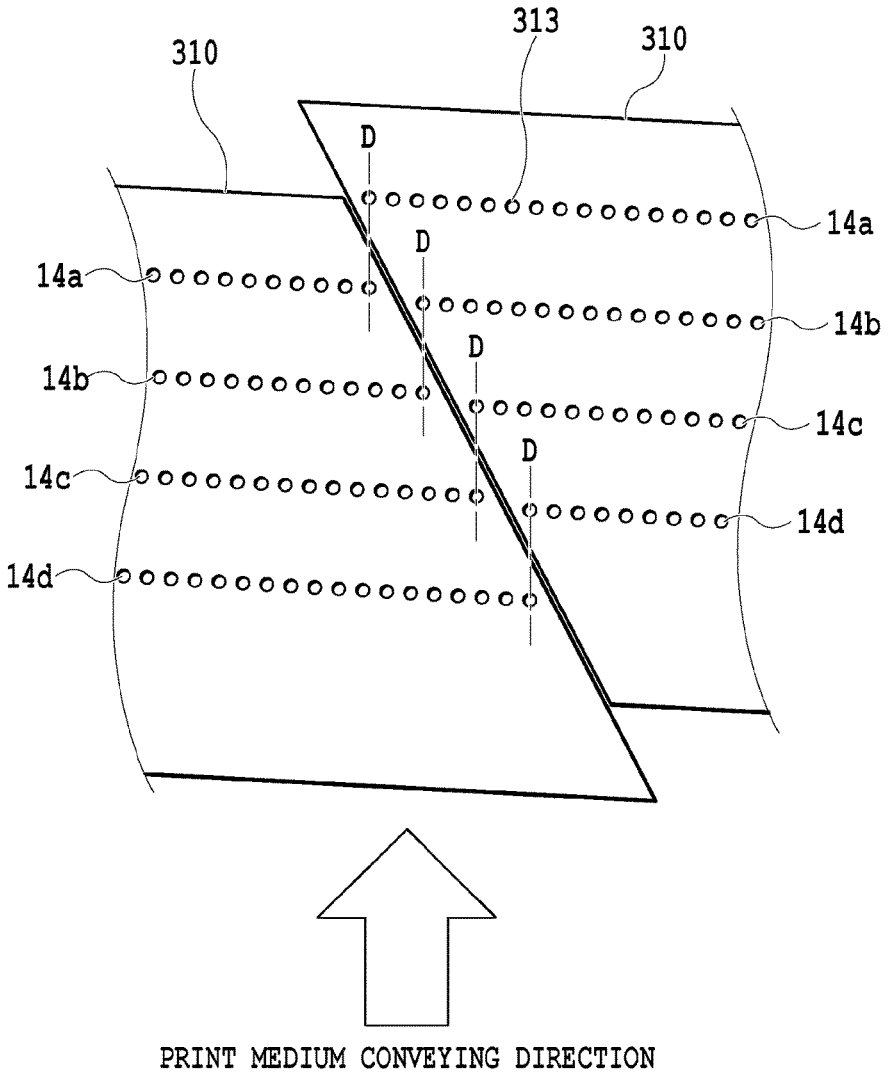
FIG. 38 is an enlarged top view of an adjacent portion of two print element boards.

FIG. 38 is a partially enlarged top view illustrating an adjacent portion of the print element board in two adjacent ejection modules. In the application example, a substantially parallelogram print element board is used. Ejection opening arrays (14*a* to 14*d*) having the ejection openings 313 arranged in each print element board 310 are disposed to be inclined while having a predetermined angle with respect to the longitudinal direction of the liquid ejection head 3. Then, the ejection opening array at the adjacent portion between the print element boards 310 is formed such that at least one ejection opening overlaps in the print medium conveying direction. In FIG. 38, two ejection openings on a line D overlap each other. With such an arrangement, even when a position of the print element board 310 is slightly deviated from a predetermined position, black streaks or missing of a print image can be rendered less noticeable by a driving control of the overlapping ejection openings. Even when the print element boards 310 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 38. Further, in the application example, a principal plane of the print element board has a parallelogram shape, but the present invention is not limited thereto. For example, even when the print element boards having a rectangular shape, a trapezoid shape, and the other shapes are used, the configuration of the present invention can be desirably used.

(Description of Modified Example of Configuration of Liquid Ejection Head)

Figure 47:
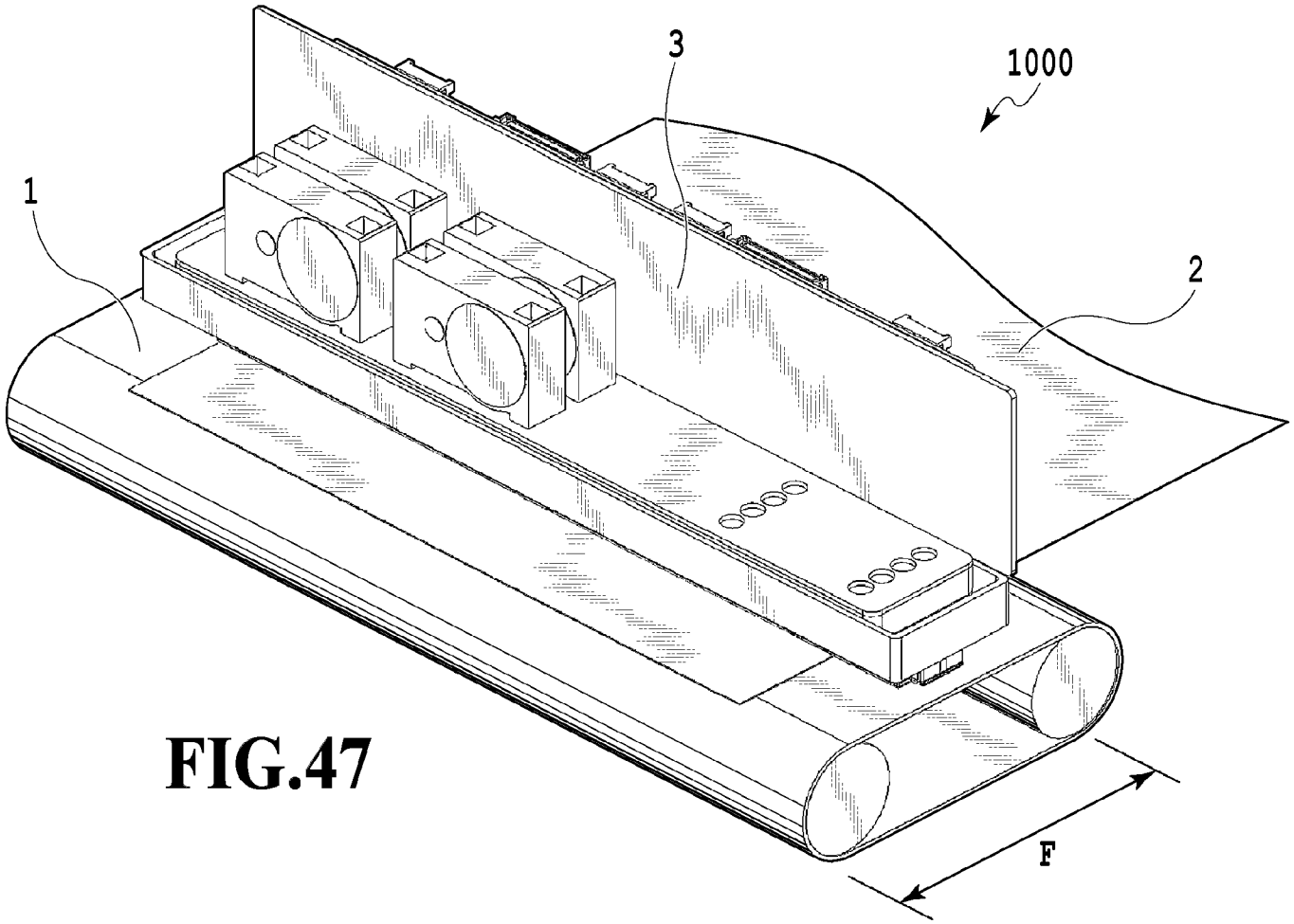
FIG. 47 is an explanatory diagram illustrating a printing apparatus of the present invention.
Figure 49A:
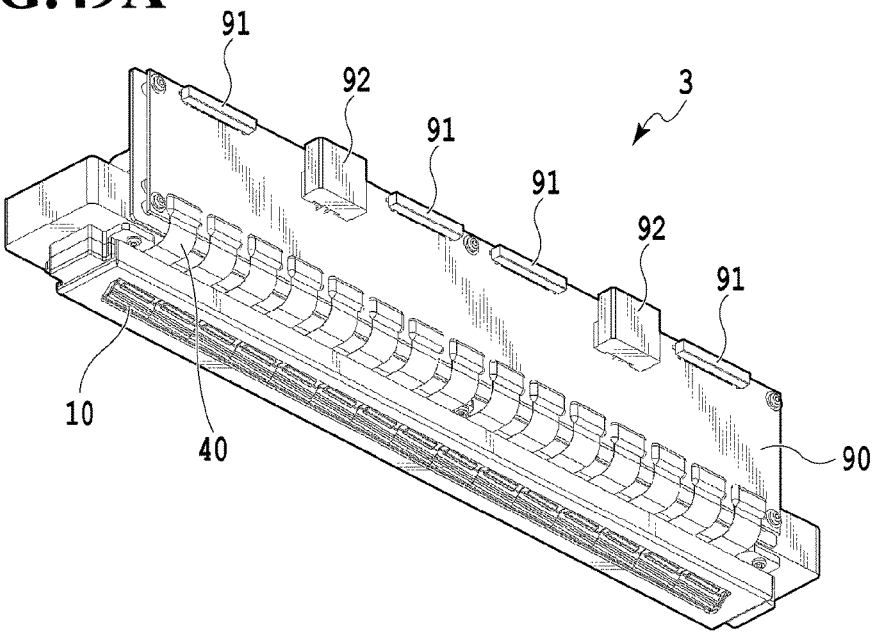
FIGS. 49A and 49B are explanatory diagrams illustrating a liquid ejection head of the present invention.
Figure 49B:
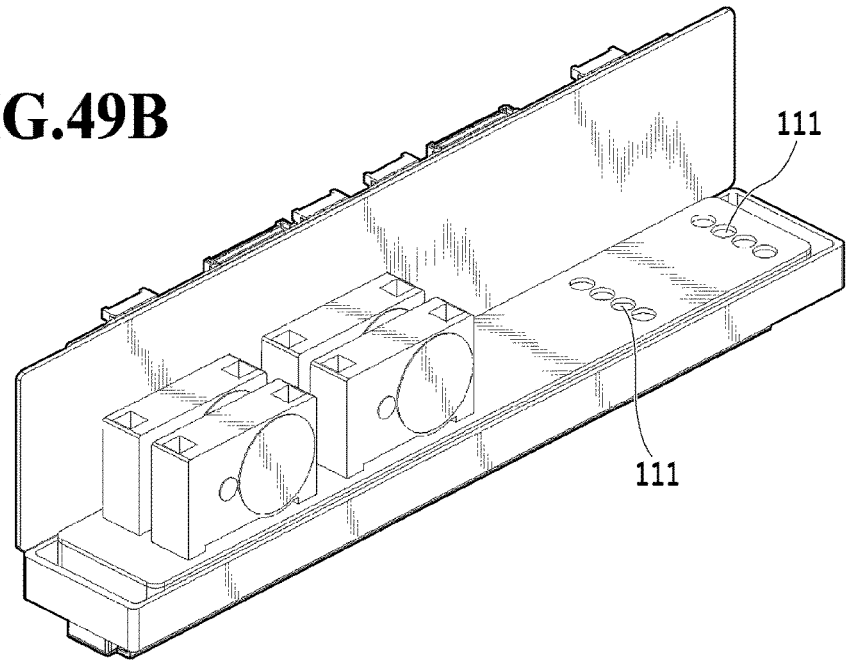
Figure 50:
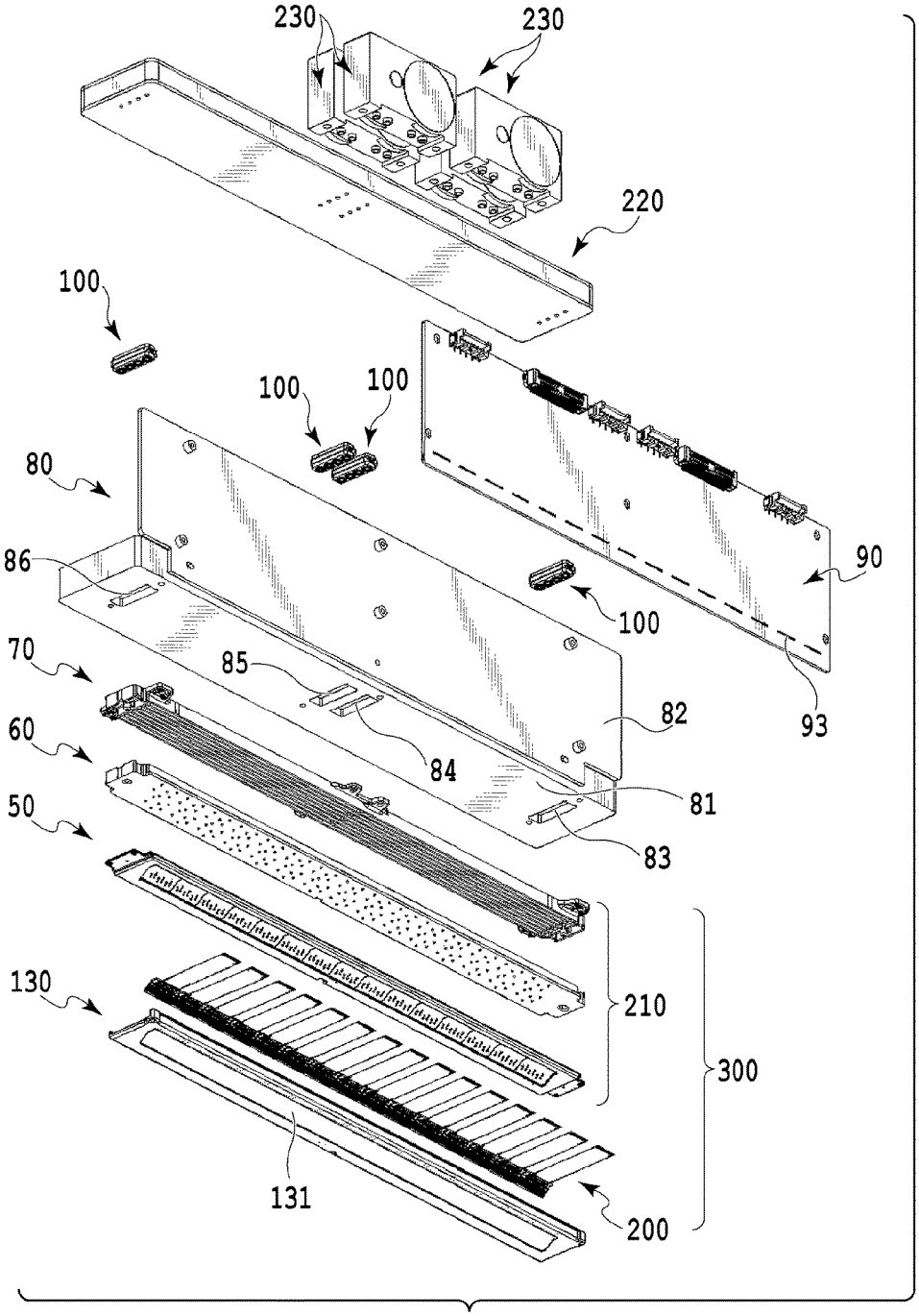
FIG. 50 is an exploded perspective view illustrating the liquid ejection head of the present invention.

A modified example of a configuration of the liquid ejection head illustrated in FIG. 47 and FIG. 49 to 51 will be described. A description of the same configuration and function as those of the above-described example will be omitted and only a difference will be mainly described. In the modified example, as illustrated in FIGS. 47, 49A, and 49B, the liquid connection portions 111 between the liquid ejection head 3 and the outside are intensively disposed at one end side of the liquid ejection head in the longitudinal direction. The negative pressure control units 230 are intensively disposed at the other end side of the liquid ejection head 3 (FIG. 50). The liquid supply unit 220 that belongs to the liquid ejection head 3 is configured as an elongated unit corresponding to the length of the liquid ejection head 3 and includes passages and filters 221 respectively corresponding to four color liquids to be supplied. As illustrated in FIG. 50, the positions of the openings 83 to 86 provided at the liquid ejection unit support portion 81 are also located at positions different from those of the liquid ejection head 3.

Figure 51:
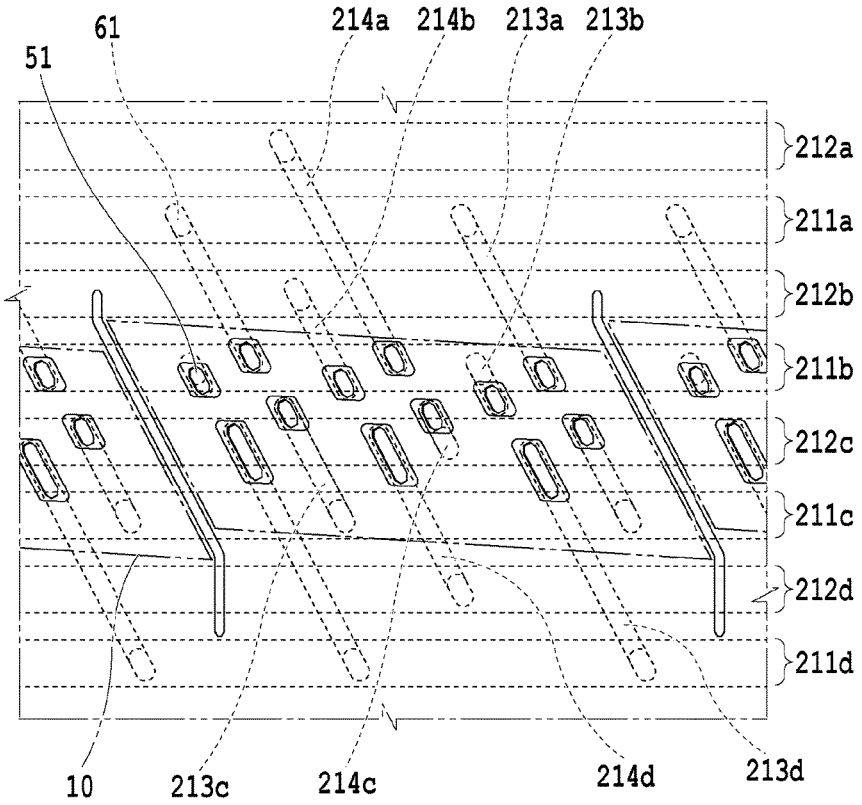
FIG. 51 is a schematic explanatory diagram illustrating a passage member of the present invention.

FIG. 51 illustrates a lamination state of the passage members 50, 60, and 70. The print element boards 10 are arranged linearly on the upper face of the passage member 50 which is the uppermost layer among the passage members 50, 60, and 70. As the passage which communicates with the opening 20A (FIG. 36C) of the lid member 20 positioned at the rear face side of each print element board 10, two individual supply passages 213 and one individual collection passage 214 are provided for each color of the liquid. Accordingly, as the opening 21 which is formed at the lid member 20 provided at the rear face of the print element board 10, two supply openings 20A and one collection opening 20A are provided for each color of the liquid. As illustrated in FIG. 51, the common supply passage 211 and the common collection passage 212 extending along the longitudinal direction of the liquid ejection head 3 are alternately arranged.

Second Application Example

Hereinafter, configurations of an inkjet printing apparatus 2000 and a liquid ejection head 2003 according to a second application example of the present invention will be described with reference to the drawings. In the description below, only a difference from the first application example will be described and a description of the same components as those of the first application example will be omitted.

(Description of Inkjet Printing Apparatus)

Figure 46:
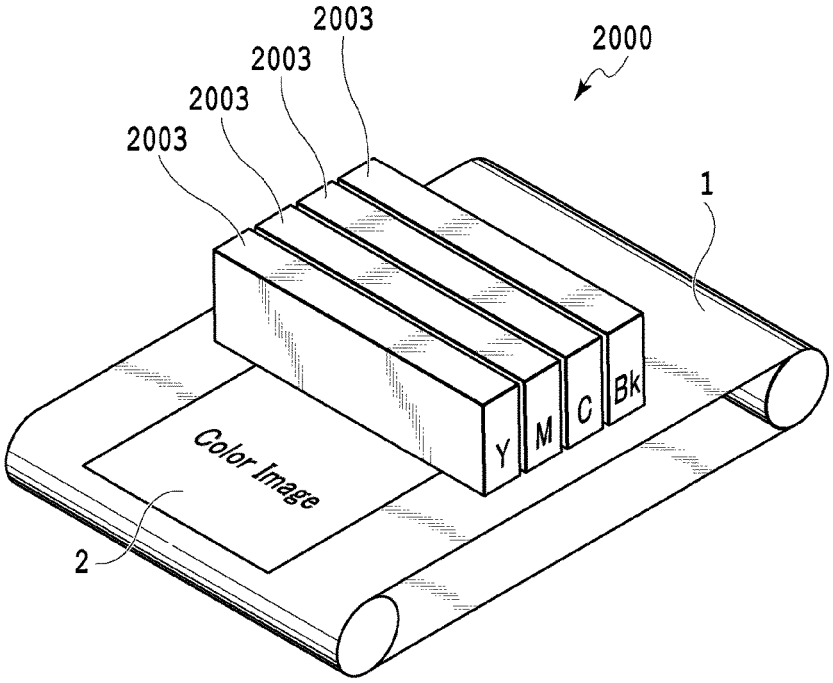
FIG. 46 is a diagram illustrating a second example of the printing apparatus to which the present invention is applied.

FIG. 46 is a diagram illustrating the inkjet printing apparatus 2000 according to the application example used to eject the liquid. The printing apparatus 2000 of the application example is different from the first application example in that a full color image is printed on the print medium by a configuration in which four monochromic liquid ejection heads 2003 respectively corresponding to the inks of cyan C, magenta M, yellow Y, and black K are disposed in parallel. In the first application example, the number of the ejection opening arrays which can be used for one color is one. However, in the application example, the number of the ejection opening arrays which can be used for one color is twenty. For this reason, when print data is appropriately distributed to a plurality of ejection opening arrays to print an image, an image can be printed at a higher speed. Further, even when there are the ejection openings that do not eject the liquid, the liquid is ejected complementarily from the ejection openings of the other arrays located at positions corresponding to the non-ejection openings in the print medium conveying direction. The reliability is improved and thus a commercial image can be appropriately printed. Similarly to the first application example, the supply system, the buffer tank 1003 (see FIGS. 27 and 28), and the main tank 1006 (see FIGS. 27 and 28) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the first application example, the first and second circulation configurations illustrated in FIG. 27 or 28 can be used as the liquid circulation configuration between the printing apparatus 2000 and the liquid ejection head 2003.

(Description of Structure of Liquid Ejection Head)

Figure 39A:
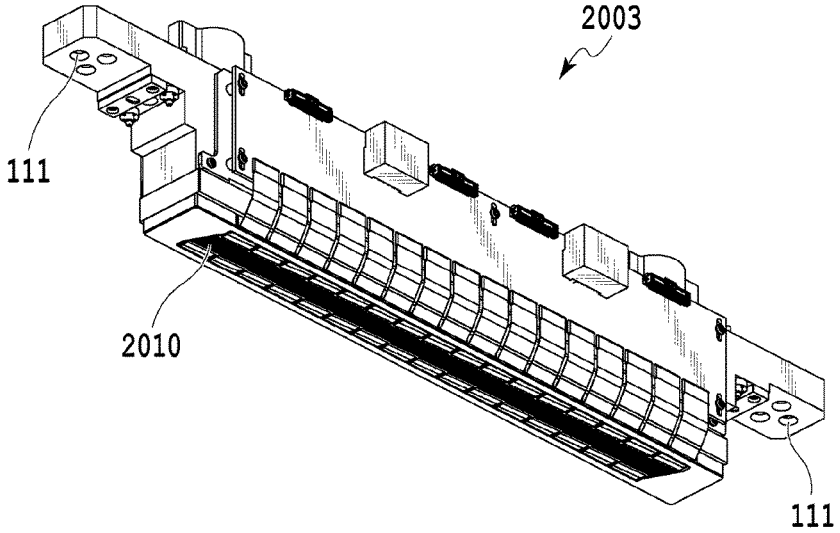
FIGS. 39A and 39B are perspective views respectively illustrating a liquid ejection head according to a second application example of the present invention.
Figure 39B:
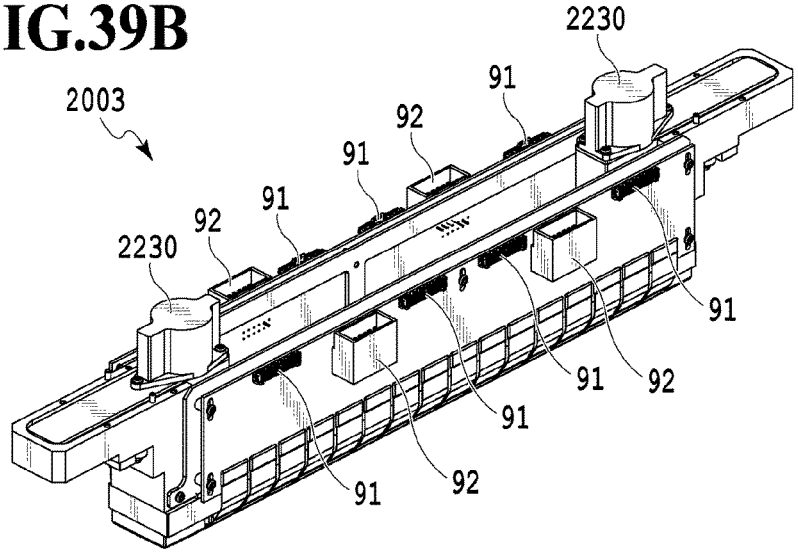

FIGS. 39A and 39B are perspective views illustrating the liquid ejection head 2003 according to the application example. Here, a structure of the liquid ejection head 2003 according to the application example will be described. The liquid ejection head 2003 is an inkjet line type print head which includes sixteen print element boards 2010 arranged linearly in the longitudinal direction of the liquid ejection head 2003 and can print an image by one kind of liquid. Similarly to the first application example, the liquid ejection head 2003 includes the liquid connection portion 111, the signal input terminal 91, and the power supply terminal 92. However, since the liquid ejection head 2003 of the application example includes many ejection opening arrays compared with the first application example, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 40:
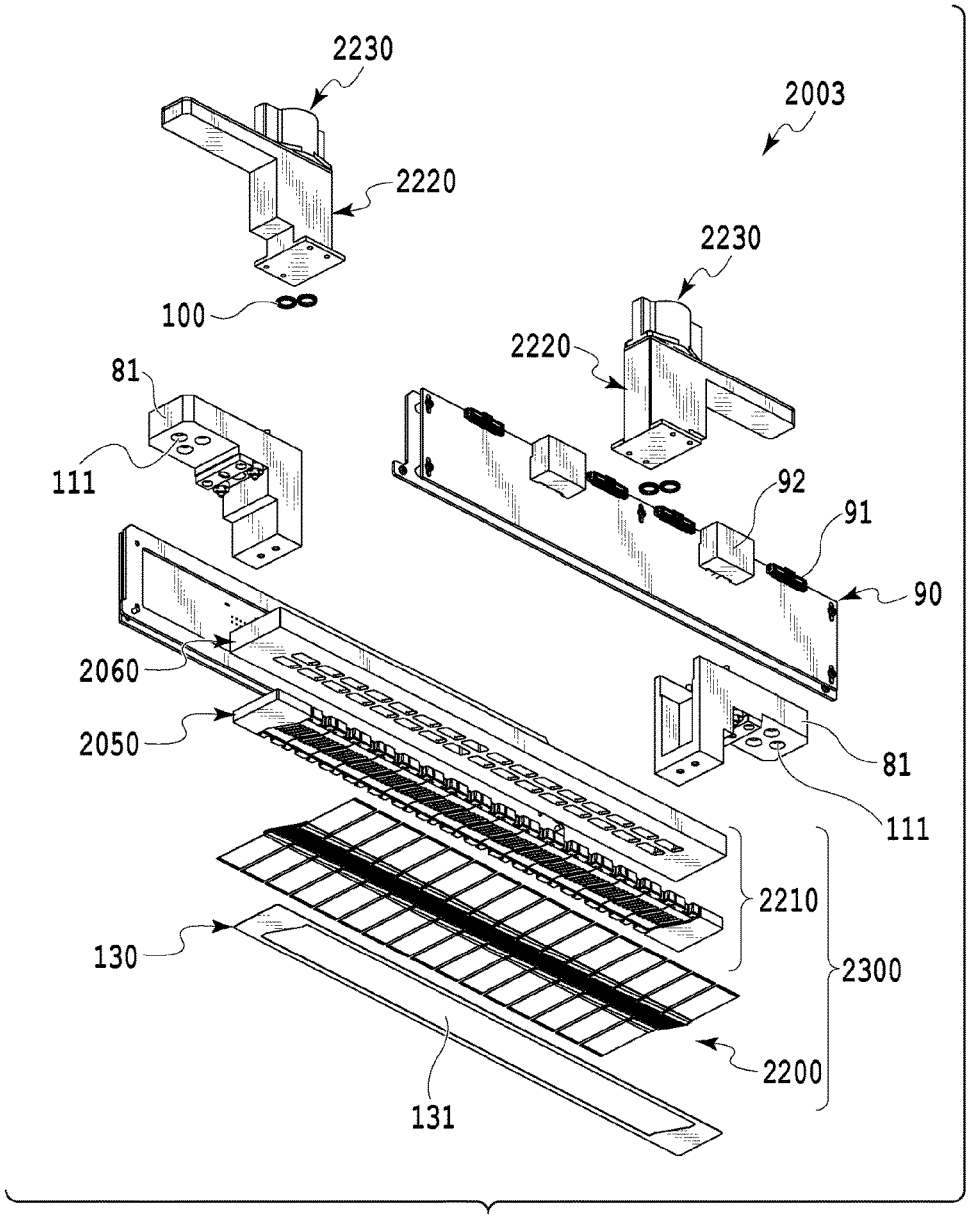
FIG. 40 is an exploded perspective view illustrating the liquid ejection head.

FIG. 40 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the first application example, but the function of guaranteeing the rigidity of the liquid ejection head is different. In the first application example, the rigidity of the liquid ejection head is mainly guaranteed by the liquid ejection unit support portion 381, but in the liquid ejection head 2003 of the second application example, the rigidity of the liquid ejection head 2003 is guaranteed by a second passage member 2060 included in a liquid ejection unit 2300. The liquid ejection unit support portion 381 of the application example is connected to both ends of the second passage member 2060, and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 381. Each of two liquid supply units 2220 includes a filter (not illustrated) built therein.

Two negative pressure control units 2230 are set to control a pressure at different (relatively high and low negative pressures). Further, as in FIGS. 39A, 39B, and 40, when the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 40, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 41:
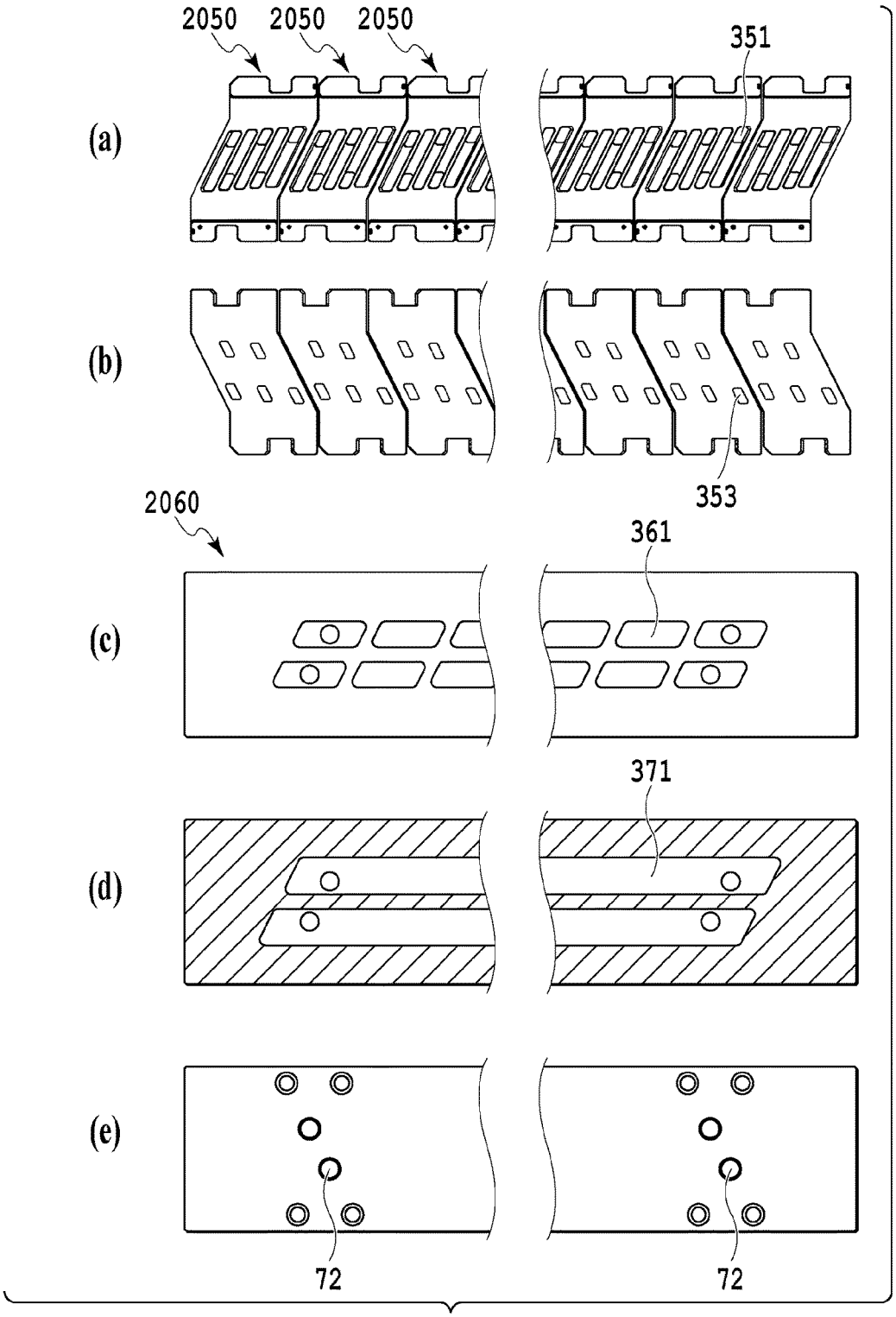
FIG. 41 is an explanatory diagram illustrating a passage member constituting the liquid ejection head.

A part (a) of FIG. 41 is a diagram illustrating a face of the first passage member 2050 onto which the ejection module 2200 is mounted, and a part (b) of FIG. 41 is a diagram illustrating a rear face thereof and a face contacting the second passage member 2060. Differently from the first application example, the first passage member 2050 of the application example has a configuration in which a plurality of members corresponding to the ejection modules 2200 are disposed adjacently. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in the part (a) of FIG. 41, the communication opening 351 of the first passage member 2050 fluid-communicates with the ejection module 2200. As illustrated in the part (b) of FIG. 41, the individual communication opening 353 of the first passage member 2050 fluid-communicates with the communication opening 361 of the second passage member 2060. A part (c) of FIG. 41 illustrates a contact face of the second passage member 60 with respect to the first passage member 2050, a part (d) of FIG. 41 illustrates a cross-section of a center portion of the second passage member 60 in the thickness direction, and a part (e) of FIG. 41 is a diagram illustrating a contact face of the second passage member 2060 with respect to the liquid supply unit 2220. The function of the communication opening and the passage of the second passage member 2060 is similar to each color of the first application example. The common passage groove 371 of the second passage member 2060 is formed such that one side thereof is a common supply passage 2211 illustrated in FIG. 42 and the other side thereof is a common collection passage 2212. These passages 2211 and 2212 are respectively provided along the longitudinal direction of the liquid ejection head 2003 so that the liquid is supplied from one end thereof to the other end thereof. The application example is different from the first application example in that the liquid flow directions in the common supply passage 2211 and the common collection passage 2212 are opposite to each other.

Figure 42:
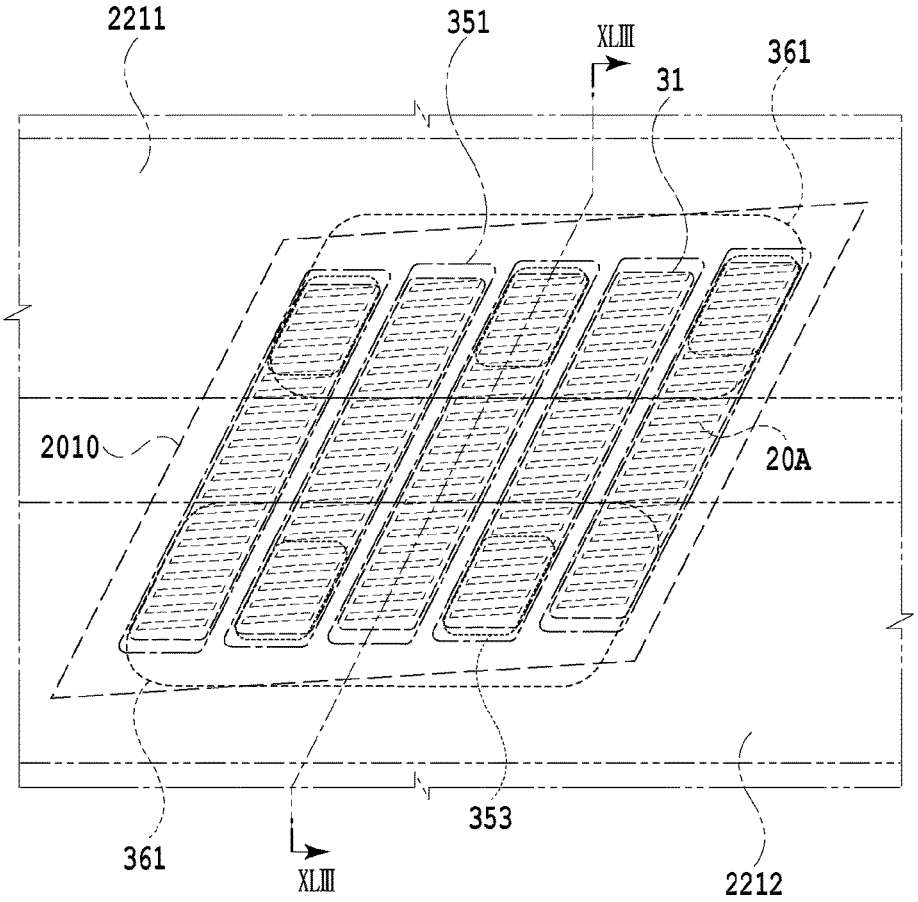
FIG. 42 is a perspective view illustrating a liquid connection relation between the print element board and the passage member in the liquid ejection head.

FIG. 42 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 361 of the second passage member 2060 is connected to the individual communication opening 353 of the first passage member 2050 so that both positions match each other. And thus a liquid supply passage communicating with the communication opening 351 of the first passage member 2050 through the communication opening 361 from the common supply passage 2211 of the second passage member 2060 is formed. Similarly, a liquid the supply path communicating with the communication opening 351 of the first passage member 2050 through the common collection passage 2212 from the communication opening 72 of the second passage member 2060 is also formed.

Figure 43:
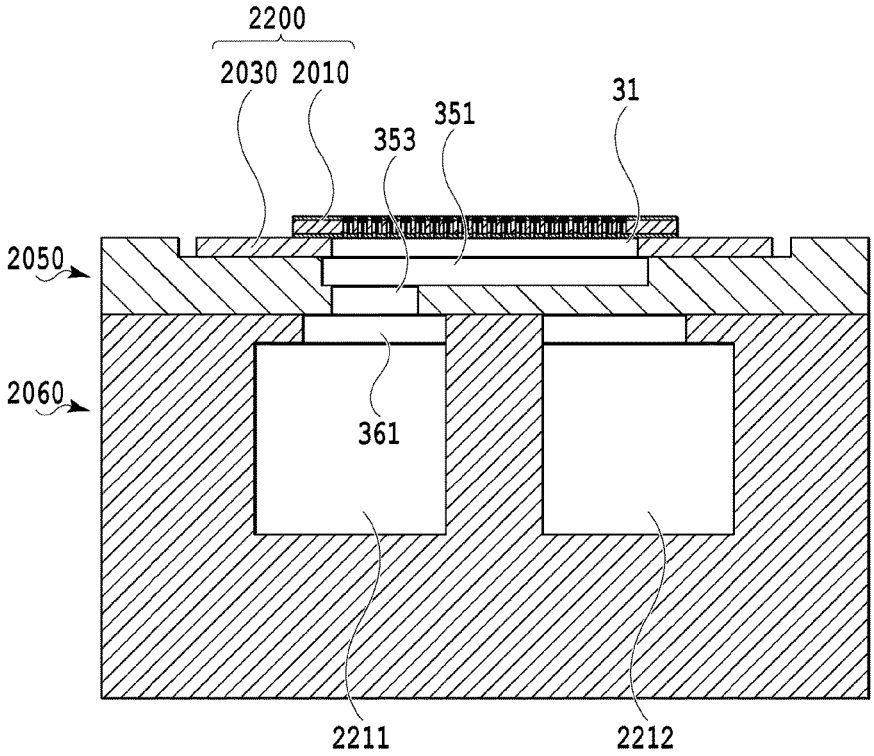
FIG. 43 is a cross-sectional view taken along a line XXXXII-XXXXII of FIG. 42.

FIG. 43 is a cross-sectional view taken along a line XLIII-XLIII of FIG. 42. The common supply passage 2211 is connected to the ejection module 2200 through the communication opening 361, the individual communication opening 353, and the communication opening 351. Although not illustrated in FIG. 43, it is obvious that the common collection passage 2212 is connected to the ejection module 2200 by the same path in a different cross-section in FIG. 42. Similarly to the first application example, each of the ejection module 2200 and the print element board 2010 is provided with a passage communicating with each ejection opening and thus a part or the entirety of the supplied liquid can be circulated while passing through the ejection opening that does not perform the ejection operation. Further, similarly to the first application example, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 44A:
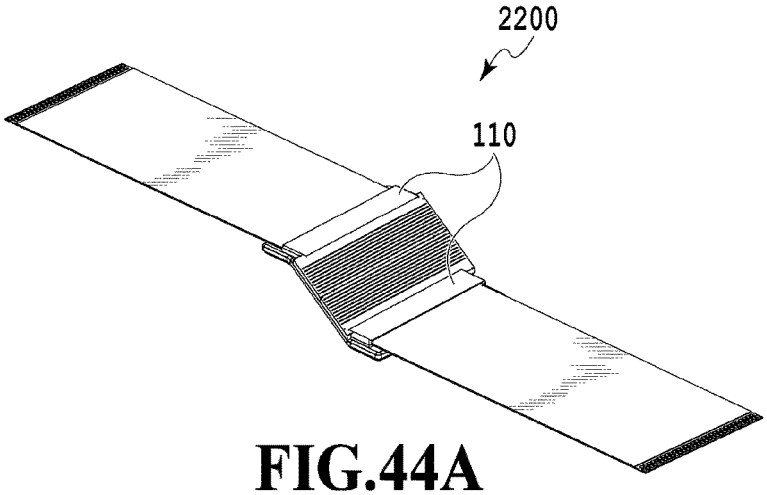
FIGS. 44A and 44B are perspective views illustrating an ejection module of the liquid ejection head.
Figure 44B:
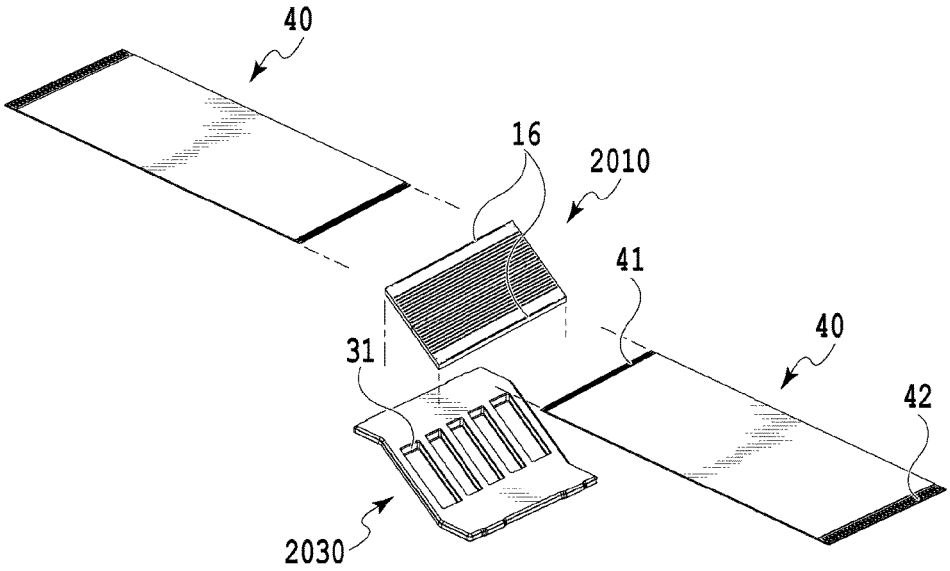

FIG. 44A is a perspective view illustrating one ejection module 2200 and FIG. 44B is an exploded view thereof. A difference from the first application example is that the terminals 316 are respectively disposed at both sides (the long side portions of the print element board 2010) in the ejection opening array directions on the print element board 2010. Accordingly, two flexible circuit boards 40 electrically connected to the print element board 2010 are disposed for each print element board 2010. Since the number of the ejection opening arrays provided in the print element board 2010 is twenty, the ejection opening arrays are more than eight ejection opening arrays of the first application example. Here, since a maximal distance from the terminal 316 to the print element is shortened, a decrease in voltage or a delay of a signal generated in the wiring portion inside the print element board 2010 is reduced. Further, the liquid communication opening 31 of the support member 2030 is opened along the entire ejection opening array provided in the print element board 2010. The other configurations are similar to those of the first application example.

(Description of Structure of Print Element Board)

Figure 45A:
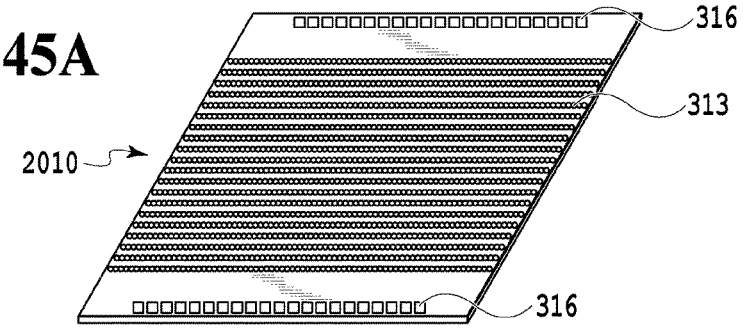
FIGS. 45A and 45B are explanatory diagrams illustrating the print element board.
Figure 45B:
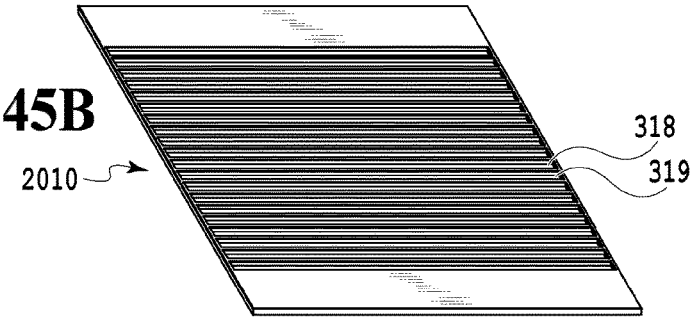
Figure 45C:
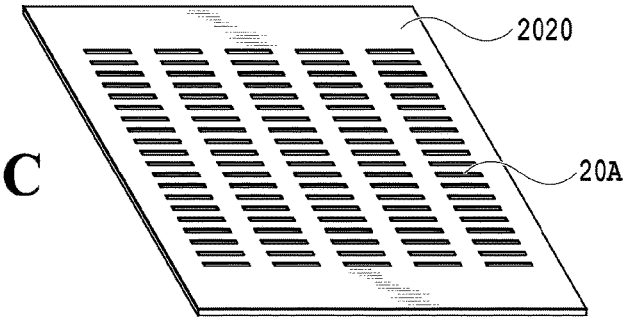
FIG. 45C is explanatory diagram illustrating the cover plate.

FIG. 45A is a schematic diagram illustrating a face of the print element board 2010 on which the ejection opening 313 is disposed, and FIG. 45C is a schematic diagram illustrating a rear face of the face of FIG. 45A. FIG. 45B is a schematic diagram illustrating a face of the print element board 2010 when a cover plate 2020 provided on the rear face of the print element board 2010 in FIG. 45C is removed. As illustrated in FIG. 45B, the liquid supply path 318 and the liquid collection path 319 are alternately provided along the ejection opening array direction at the rear face of the print element board 2010. The number of the ejection opening arrays is larger than that of the first application example. However, a basic difference from the first application example is that the terminal 316 is disposed at both sides of the print element board in the ejection opening array direction as described above. A basic configuration is similar to the first application example in that a pair of the liquid supply path 318 and the liquid collection path 319 is provided in each ejection opening array and the cover plate 2020 is provided with the opening 20A communicating with the liquid communication opening 31 of the support member 2030.

In addition, the description of the above-described application example does not limit the scope of the present invention. As an example, in the application example, a thermal type has been described in which bubbles are generated by a heating element to eject the liquid. However, the present invention can be also applied to the liquid ejection head which employs a piezo type and the other various liquid ejection types.

In the application example, the inkjet printing apparatus (the printing apparatus) has been described in which the liquid such as ink is circulated between the tank and the liquid ejection head, but the other application examples may be also used. In the other application examples, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the application example, an example of using a so-called line type head having a length corresponding to the width of the print medium has been described, but the present invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the present invention is not limited thereto. That is, a liquid ejection head which is shorter than the width of the print medium and includes a plurality of print element boards disposed so that the ejection openings overlap each other in the ejection opening array direction may be provided and the liquid ejection head may be scanned with respect to the print medium.

Third Application Example

Configurations of the inkjet printing apparatus 1000 and the liquid ejection head 3 according to a third application example of the present invention will be described. The liquid ejection head of the third application example is of a page wide type in which an image is printed on a print medium of a B2 size through one scan. Since the third application example is similar to the second application example in many respects, only difference from the second application example will be mainly described in the description below and a description of the same configuration as that of the second application example will be omitted.

(Description of Inkjet Printing Apparatus)

Figure 52:
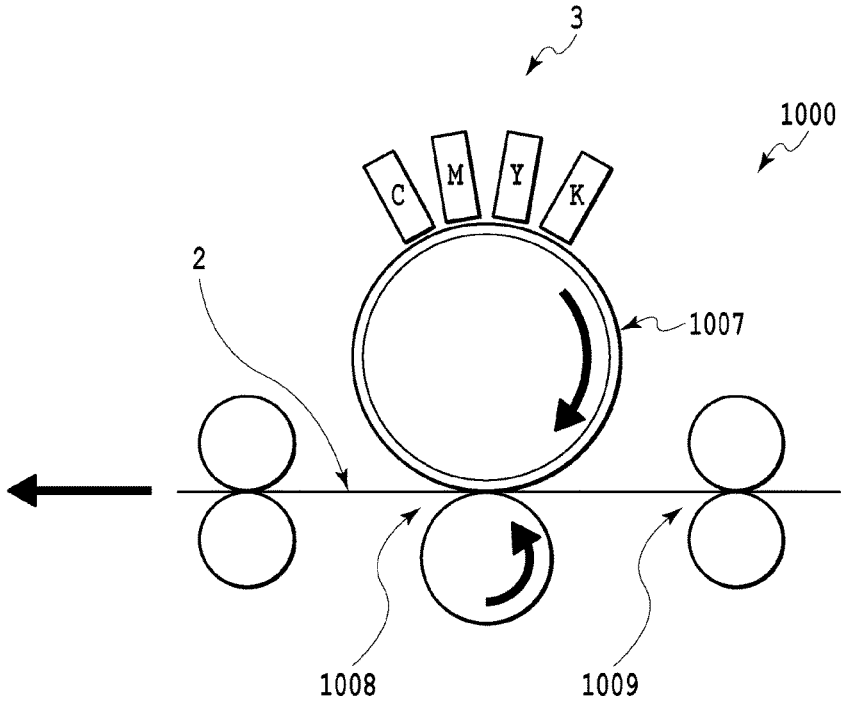
FIG. 52 is an explanatory diagram illustrating a printing apparatus according to a third application example of the present invention.

FIG. 52 is a schematic diagram illustrating an inkjet printing apparatus according to the application example. The printing apparatus 1000 has a configuration in which an image is not directly printed on a print medium by the liquid ejected from the liquid ejection head 3. That is, the liquid is first ejected to an intermediate transfer member (an intermediate transfer drum) 1007 to form an image thereon and the image is transferred to the print medium 2. In the printing apparatus 1000, the liquid ejection heads 3 respectively corresponding to four colors (C,M,Y,K) of inks are disposed along the intermediate transfer drum 1007 in a circular-arc shape. Accordingly, a full-color printing process is performed on the intermediate transfer member, the printed image is appropriately dried on the intermediate transfer member, and the image is transferred to the print medium 2 conveyed by a sheet conveying roller 1009 to a transfer portion 1008. The sheet conveying system of the second application example is mainly used to convey a cut sheet in the horizontal direction. However, the sheet conveying system of this application example can be also applied to a continuous sheet supplied from a main roll (not illustrated). In such a drum conveying system, since the sheet is easily conveyed while a predetermined tension is applied thereto, a conveying jam hardly occurs even at a high-speed printing operation. For this reason, the reliability of the apparatus is improved and thus the apparatus is suitable for a commercial printing purpose. Similarly to the first and second application examples, the supply system of the printing apparatus 1000, the buffer tank 1003, and the main tank 1006 are fluid-connected to each liquid ejection head 3. Further, an electrical control unit which transmits an ejection control signal and power to the liquid ejection head 3 is electrically connected to each liquid ejection head 3.

(Description of Fourth Circulation Configuration)

Figure 53:
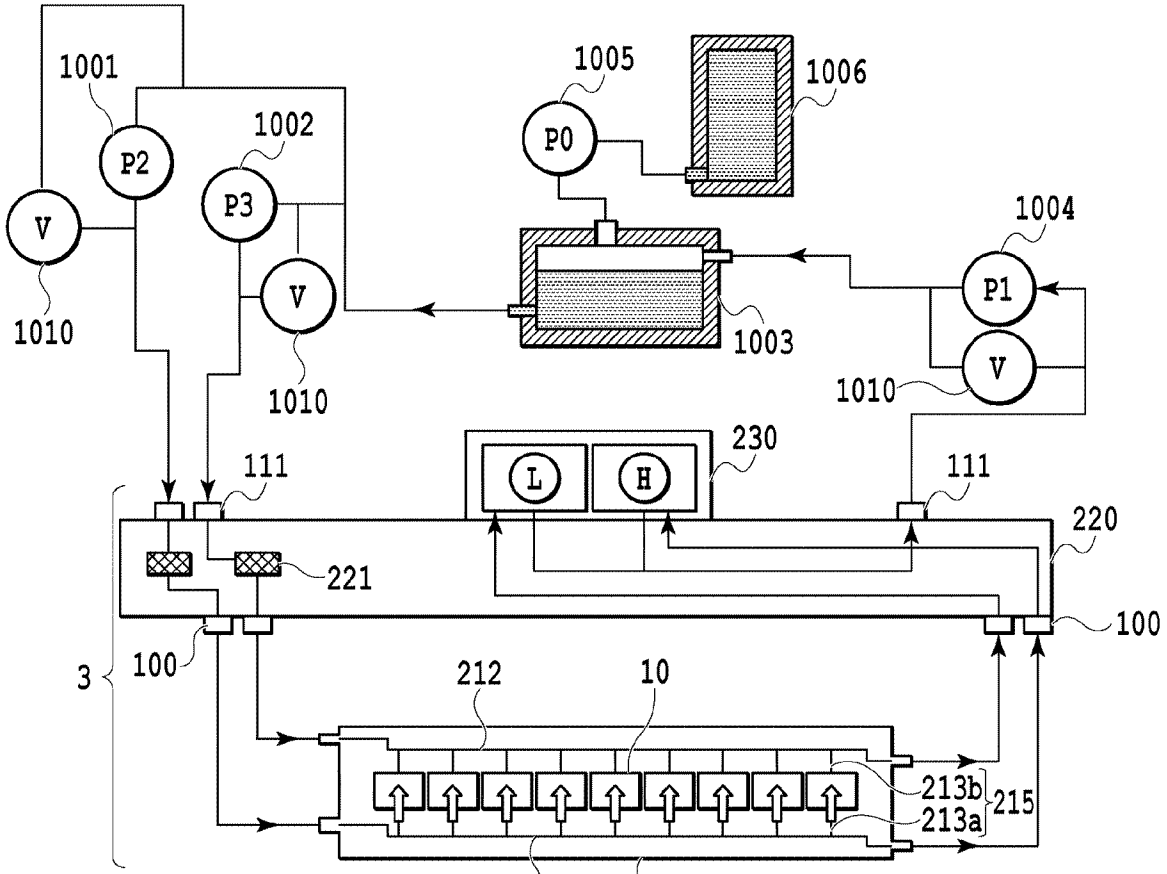
FIG. 53 is an explanatory diagram illustrating a fourth circulation configuration of an ink circulation path.

Similarly to the second application example, the first and second circulation paths illustrated in FIG. 27 or 28 can be also applied as the liquid circulation path between the liquid ejection head 3 and the tank of the printing apparatus 1000, but the circulation path illustrated in FIG. 53 is desirable. A main difference from the second circulation path of FIG. 28 is that a bypass valve 1010 is additionally provided to communicate with each of the passages of the first circulation pumps 1001 and 1002 and the second circulation pump 1004. The bypass valve 1010 has a function (a first function) of decreasing the upstream pressure of the bypass valve 1010 by opening the valve when a pressure exceeds a predetermined pressure. Further, the bypass valve 1010 has a function (a second function) of opening and closing the valve at an arbitrary timing by a signal from a control substrate of the printing apparatus body.

By the first function, it is possible to suppress a large or small pressure from being applied to the downstream side of the first circulation pumps 1001 and 1002 or the upstream side of the second circulation pump 1004. For example, when the functions of the first circulation pumps 1001 and 1002 are not operated properly, there is a case in which a large flow rate or pressure may be applied to the liquid ejection head 3. Accordingly, there is concern that the liquid may leak from the ejection opening of the liquid ejection head 3 or each bonding portion inside the liquid ejection head 3 may be broken. However, when the bypass valves 1010 are added to the first circulation pumps 1001 and 1002 as in the application example, the bypass valve 1010 is opened in the event of a large pressure. Accordingly, since the liquid path is opened to the upstream side of each circulation pump, the above-described trouble can be suppressed.

Further, by the second function, when the circulation driving operation is stopped, all bypass valves 1010 are promptly opened on the basis of the control signal of the printing apparatus body after the operation of the first circulation pumps 1001 and 1002 and the second circulation pump 1004 are stopped. Accordingly, a high negative pressure (for example, several to several tens of kPa) at the downstream portion (between the negative pressure control unit 230 and the second circulation pump 1004) of the liquid ejection head 3 can be released within a short time. When a displacement pump such as a diaphragm pump is used as the circulation pump, a check valve is normally built inside the pump. However, when the bypass valve 1010 is opened, the pressure at the downstream portion of the liquid ejection head 3 can be also released from the downstream portion of the buffer tank 1003. Although the pressure at the downstream portion of the liquid ejection head 3 can be released only from the upstream side, pressure loss exists in the upstream passage of the liquid ejection head and the passage inside the liquid ejection head. For that reason, since some time is taken when the pressure is released, the pressure inside the common passage inside the liquid ejection head 3 transiently decreases too much. Accordingly, there is concern that the meniscus in the ejection opening may be broken. However, since the downstream pressure of the liquid ejection head is further released when the bypass valve 1010 at the downstream side of the liquid ejection head 3 is opened, the risk of the breakage of the meniscus in the ejection opening is reduced.

(Description of Structure of Liquid Ejection Head)

Figure 54A:
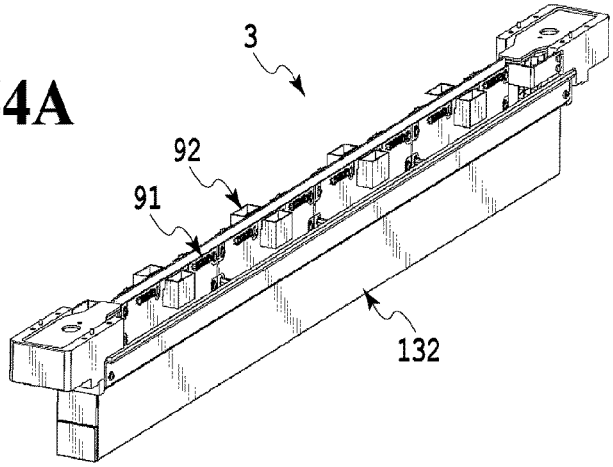
FIGS. 54A and 54B are explanatory diagrams respectively illustrating a liquid ejection head according to a third application example of the present invention.
Figure 54B:
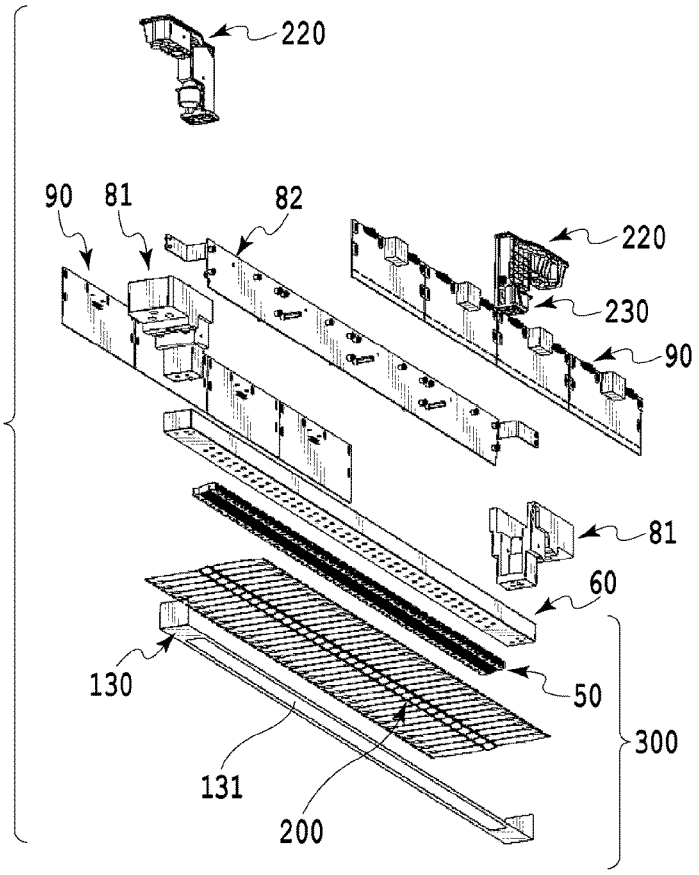

A structure of the liquid ejection head 3 according to the third application example of the present invention will be described. FIG. 54A is a perspective view illustrating the liquid ejection head 3 according to the application example, and FIG. 54B is an exploded perspective view thereof. The liquid ejection head 3 is an inkjet page wide type printing head which includes thirty six print element boards 10 arranged in a line shape (an in-line shape) in the longitudinal direction of the liquid ejection head 3 and prints an image by one color. Similarly to the second application example, the liquid ejection head 3 includes a shield plate 132 which protects a rectangular side face of the head in addition to the signal input terminal 91 and the power supply terminal 92.

FIG. 54B is an exploded perspective view illustrating the liquid ejection head 3. In FIG. 54B, components or units constituting the liquid ejection head 3 are divided according to the functions thereof and illustrated (where the shield plate 132 is not illustrated). The functions of the units and the members, and the liquid circulation sequence inside the liquid ejection head 3 are similar to those of the second application example. A main difference from the second application example is that the divided electric wiring boards 90 and the negative pressure control unit 230 are disposed at different positions and the first passage member has a different shape. As in this application example, for example, in the case of the liquid ejection head 3 having a length corresponding to the print medium of a B2 size, the power consumed by the liquid ejection head 3 is large and thus eight electric wiring boards 90 are provided. Four electric wiring boards 90 are attached to each of both side faces of the elongated electric wiring board support portion 82 attached to the liquid ejection unit support portion 81.

Figure 55A:
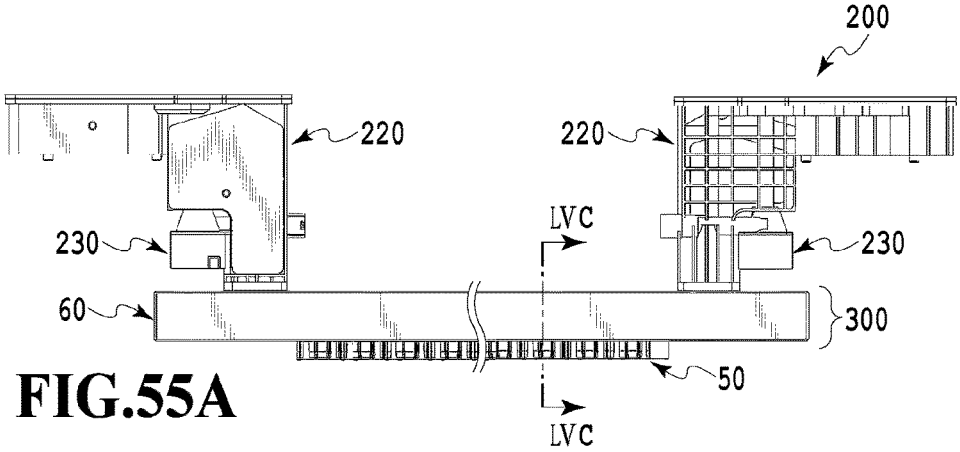
FIGS. 55A, 55B, and 55C are explanatory diagrams respectively illustrating the liquid ejection head according to the third application example of the present invention.
Figure 55B:
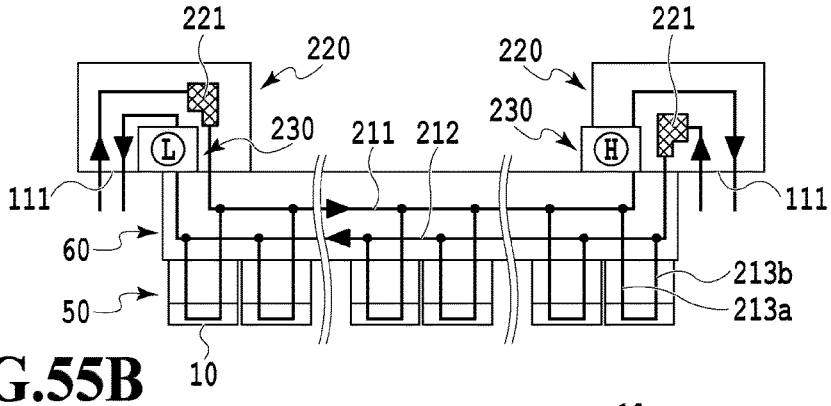
Figure 55C:
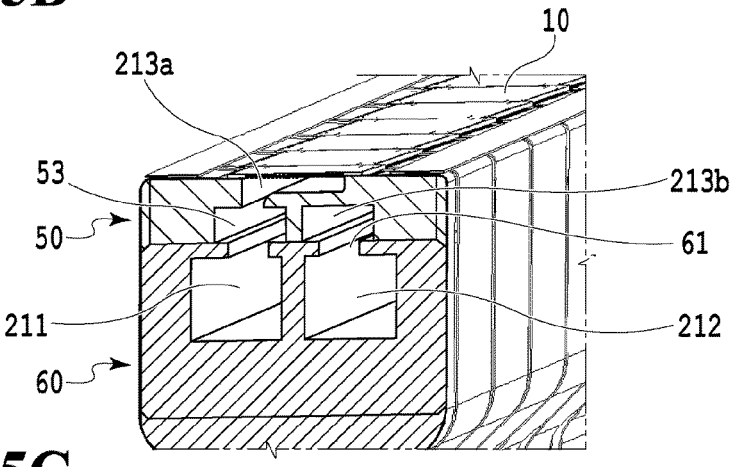

FIG. 55A is a side view illustrating the liquid ejection head 3 including the liquid ejection unit 300, the liquid supply unit 220, and the negative pressure control unit 230, FIG. 55B is a schematic diagram illustrating a flow of the liquid, and FIG. 55C is a perspective view illustrating a cross-section taken along a line LVC-LVC of FIG. 55A. In order to easily understand the drawings, a part of the configuration is simplified.

The liquid connection portion 111 and the filter 221 are provided inside the liquid supply unit 220 and the negative pressure control unit 230 is integrally formed at the lower side of the liquid supply unit 220. Accordingly, a distance between the negative pressure control unit 230 and the print element board 10 in the height direction becomes short compared with the second application example. With this configuration, the number of the passage connection portions inside the liquid supply unit 220 decreases. As a result, there is an advantage that the reliability of preventing the leakage of the printing liquid is improved and the number of components or assembly steps decreases.

Further, since a water head difference between the negative pressure control unit 230 and the ejection opening forming face of the liquid ejection head 3 decreases relatively, this configuration can be suitably applied to the printing apparatus in which the inclination angle of the liquid ejection head 3 illustrated in FIG. 52 is different for each of the liquid ejection heads. Since the water head difference can be decreased, a difference in negative pressure applied to the ejection openings of the print element boards can be reduced even when the liquid ejection heads 3 having different inclination angles are used. Further, since a distance from the negative pressure control unit 230 to the print element board 10 decreases, a flow resistance therebetween decreases. Accordingly, a difference in pressure loss caused by a change in flow rate of the liquid decreases and thus the negative pressure can be more desirably controlled.

FIG. 55B is a schematic diagram illustrating a flow of the printing liquid inside the liquid ejection head 3. Although the circulation path is similar to the circulation path illustrated in FIG. 53 in terms of the circuit thereof, FIG. 55B illustrates a flow of the liquid in the components of the actual liquid ejection head 3. A pair of the common supply passage 211 and the common collection passage 212 extending in the longitudinal direction of the liquid ejection head 3 is provided inside the elongated second passage member 60. The common supply passage 211 and the common collection passage 212 are formed so that the liquid flow therein in the opposite directions and the filter 221 is provided at the upstream side of each passage so as to trap foreign materials intruding from the connection portion 111 or the like. In this way, since the liquid flows through the common supply passage 211 and the common collection passage 212 in the opposite directions, a temperature gradient inside the liquid ejection head 3 in the longitudinal direction can be desirably reduced. In order to simplify the description of FIG. 53, the flows in the common supply passage 211 and the common collection passage 212 are indicated by the same direction.

The negative pressure control unit 230 is connected to the downstream side of each of the common supply passage 211 and the common collection passage 212. Further, a branch portion is provided in the course of the common supply passage 211 to be connected to the individual supply passages 213*a* and a branch portion is provided in the course of the common collection passage 212 to be connected to the individual collection passages 213*b*. The individual supply passage 213*a* and the individual collection passage 213*b* are formed inside the first passage members 50 and each individual passage communicates with the opening 10A (see FIG. 36C) of the lid member 20 provided at the rear face of the print element board 10.

The negative pressure control units 230 indicated by "H" and "L" of FIG. 55B are units at the high pressure side (H) and the low pressure side (L). The negative pressure control units 230 are back pressure type pressure adjustment mechanisms which control the upstream pressures of the negative pressure control units 230 by a relatively high negative pressure (H) and a relatively low negative pressure (L). The common supply passage 211 is connected to the negative pressure control unit 230 (the high pressure side) and the common collection passage 212 is connected to the negative pressure control unit 230 (the low pressure side) so that a differential pressure is generated between the common supply passage 211 and the common collection passage 212. By the differential pressure, the liquid flows from the common supply passage 211 to the common collection passage 212 while sequentially passing through the individual supply passage 213*a*, the ejection opening 11 (the pressure chamber 23) in the print element board 10, and the individual collection passage 213*b*.

FIG. 55C is a perspective view illustrating a cross-section taken along a line LVC-LVC of FIG. 55A. In the application example, each ejection module 200 includes the first passage member 50, the print element board 10, and the flexible circuit board 40. In the application example, the support member 2030 (FIG. 43) described in the second application example does not exist and the print element board 10 including the lid member 20 is directly bonded to the first passage member 50. The liquid is supplied from the communication opening 61 formed at the upper face of the common supply passage 211 provided at the second passage member 60 to the individual supply passage 213*a* through the individual communication opening 53 formed at the lower face of the first passage member 50. Subsequently, the liquid passes through the pressure chamber 23 and passes through the individual collection passage 213*b*, the individual communication opening 53, and the communication opening 61 to be collected to the common collection passage 212.

Here, differently from the second application example illustrated in FIG. 40, the individual communication opening 53 formed at the lower face of the first passage member 50 (the face near the second passage member 60) is sufficiently large with respect to the communication opening 61 formed at the upper face of the second passage member 50. With this configuration, the first passage member and the second passage member reliably fluid-communicate with each other even when a positional deviation occurs when the ejection module 200 is mounted onto the second passage member 60. As a result, the yield in the head manufacturing process is improved and thus a decrease in cost can be realized.

Other Embodiments

The present invention is not limited to the ink ejection substrate, the inkjet printing head, and the inkjet printing apparatus and can be widely applied to a liquid ejection substrate, a liquid ejection head, and a liquid ejection apparatus used to eject various liquids. The invention can be also applied to printing apparatuses of various types such as a full line type and a serial scan type.

Further, the present invention can be widely applied to a liquid ejection apparatus that uses a liquid ejection head capable of ejecting various liquids in addition to the inkjet printing apparatus that prints an image by using the inkjet printing head capable of ejecting the ink. For example, the present invention can be applied to a printer, a copying machine, a facsimile having a communication system, a word processor having a printer, and an industrial printing apparatus combined with various processing devices. Further, the present invention can be used to manufacture a biochip or print an electronic circuit.

According to the present invention, the plurality of supply passages, the plurality of collection passages, the first common supply passage, and the first common collection passage can be formed with high accuracy. Thus, even when the plurality of ejection openings are densely arranged, a liquid can be circulated through the pressure chambers respectively corresponding to the ejection openings. As a result, it is possible to keep a satisfactory ejection performance of ejecting a liquid from the ejection opening. For example, in a case where the ink is ejected from the ejection opening to print an image, it is possible to print a high-quality image with high accuracy by suppressing a decrease in ink ejection speed caused by the evaporation of moisture in the ink from the ejection opening.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-002704, filed Jan. 8, 2016, and No. 2016-239794, filed Dec. 9, 2016, which are hereby incorporated by reference wherein in their entirety.

What is claimed is:

1. A liquid ejection head including:

an ejection opening array in which a plurality ejection openings for ejecting a liquid are arranged in a first direction;

a plurality of pressure chambers communicating with the ejection openings, each of the plurality of the pressure chambers having an element generating energy for ejecting the liquid;

a plurality of supply passages extending in a second direction intersecting the first direction, the plurality of supply passages supplying the liquid to the pressure chambers;

a plurality of collection passages extending in the second direction and collecting the liquid from the pressure chambers;

a common supply passage extending in the first direction and supplying the liquid to the plurality of supply passages; and a common collection passage extending in the first direction and collecting the liquid from the plurality of collection passages.

2. The liquid ejection head according to claim 1, wherein a plurality of the ejection opening arrays are provided along each other, and the common supply passage and the common collection passage are provided for each of the ejection opening arrays.

3. The liquid ejection head according to claim 2, wherein the plurality of ejection opening arrays include ejection opening arrays ejecting different kinds of liquids.

4. The liquid ejection head according to claim 1, wherein the plurality of supply passages are arranged in the first direction.

5. The liquid ejection head according to claim 1, wherein the plurality of collection passages are arranged in the first direction.

6. The liquid ejection head according to claim 1, wherein the common supply passage has a length corresponding to a length of the ejection opening array.

7. The liquid ejection head according to claim 1, wherein the common collection passage has a length corresponding to a length of the ejection opening array.

8. The liquid ejection head according to claim 1, wherein the liquid ejection head includes a supply passage array in which the plurality of supply passages are arranged and a collection passage array in which the plurality of collection passages are arranged, and the ejection opening array is provided between the supply passage array and the collection passage array.

9. The liquid ejection head according to claim 1, wherein the liquid ejection head includes a print element substrate provided with the ejection opening array, the pressure chambers, the plurality of supply passages, the plurality of collection passages, the common supply passage, and the common collection passage.

10. The liquid ejection head according to claim 9, wherein the liquid ejection head is a page wide type liquid ejection head, and a plurality of the print element substrates are arranged in a line.

11. The liquid ejection head according to claim 10, wherein the print element substrate has a parallelogram shape.

12. The liquid ejection head according to claim 9, wherein the liquid ejection head including a support member supporting a plurality of the print element substrates, and the support member includes a second common supply passage supplying the liquid to the plurality of print element substrates and a second common collection passage collecting the liquid from the plurality of print element substrates.

13. The liquid ejection head according to claim 12, wherein the support member includes an individual supply passage supplying the liquid from the second common supply passage to the print element substrate and an individual collection passage collecting the liquid from the print element substrate to the second common collection passage.

14. The liquid ejection head according to claim 13, wherein the individual supply passage supplies the liquid from an end of the support member toward a center portion of the support member in a short-length direction, and the individual collection passage collects the liquid from the center portion toward the end in the short-length direction.

15. The liquid ejection head according to claim 13, wherein the liquid supplied from an outside flows through the second common supply passage, the individual supply passage, the common supply passage, the supply passages, the pressure chambers, the collection passages, the common collection passage, the individual collection passage, and the second common collection passage in this order.

16. The liquid ejection head according to claim 12, wherein the liquid ejection head includes a first negative pressure control unit communicating with the second common supply passage and a second negative pressure control unit communicating with the second common collection passage.

17. The liquid ejection head according to claim 1, wherein the liquid supplied from an outside flows through the common supply passage, the supply passages, the pressure chambers, the collection passages, and the common collection passage in this order.

18. The liquid ejection head according to claim 1, wherein the liquid inside the pressure chambers are circulated between the pressure chambers and an outside.

19. A liquid ejection head including:

an element array in which a plurality of elements generating energy for ejecting a liquid from a plurality of ejection openings are arranged in a first direction;

a substrate provided with the element array;

a plurality of supply passages extending in a second direction intersecting a face of the substrate provided with the element array, the plurality of supply passages supplying the liquid to the elements;

a plurality of collection passages extending in the second direction;

a common supply passage extending in the first direction and communicating with the plurality of supply passages; and a common collection passage extending in the first direction and communicating with the plurality of collection passages, wherein the liquid supplied from an outside flows through the common supply passage, the supply passages, the elements, the collection passages, and the common collection passage in this order.

20. The liquid ejection head according to claim 19, wherein the liquid ejection head includes a pressure chamber in which the elements are provided, and the liquid inside the pressure chamber is circulated between the pressure chamber and an outside.

* * * * *